US011414937B2

(12) United States Patent
DeBerry et al.

(10) Patent No.: US 11,414,937 B2
(45) Date of Patent: Aug. 16, 2022

(54) CONTROL/MONITORING OF INTERNAL EQUIPMENT IN A RISER ASSEMBLY

(71) Applicant: Dril-Quip, Inc., Houston, TX (US)

(72) Inventors: Blake T. DeBerry, Houston, TX (US); Morris B. Wade, Houston, TX (US)

(73) Assignee: DRIL-QUIP, INC., Houston, TX (US)

( * ) Notice: Subject to any disclaimer, the term of this patent is extended or adjusted under 35 U.S.C. 154(b) by 0 days.

(21) Appl. No.: 16/846,096

(22) Filed: Apr. 10, 2020

(65) Prior Publication Data

US 2020/0240220 A1 Jul. 30, 2020

Related U.S. Application Data

(63) Continuation-in-part of application No. 16/378,004, filed on Apr. 8, 2019, now abandoned, which is a continuation of application No. 15/639,865, filed on Jun. 30, 2017, now Pat. No. 10,253,582, which is a continuation-in-part of application No. 14/961,673, filed on Dec. 7, 2015, now Pat. No. 9,708,863, which is a continuation-in-part of application No.
(Continued)

(51) Int. Cl.
*E21B 17/01* (2006.01)
*E21B 19/16* (2006.01)
*E21B 17/08* (2006.01)

(52) U.S. Cl.
CPC ..... *E21B 19/165* (2013.01); *E21B 17/085* (2013.01); *E21B 17/01* (2013.01)

(58) Field of Classification Search
CPC ..... E21B 17/01; E21B 17/085; E21B 19/165
See application file for complete search history.

(56) References Cited

U.S. PATENT DOCUMENTS 2,507,261 A 5/1950 Mercier
3,498,648 A 3/1970 Hallesy
(Continued)

FOREIGN PATENT DOCUMENTS

GB 2346509 A 8/2000
GB 2481699 A 1/2012
(Continued)

OTHER PUBLICATIONS

Search report issued in related United Kingdom patent application No. GB1809605.7 dated Nov. 9, 2018 (4 pages).
(Continued)

*Primary Examiner* — Matthew R Buck
(74) *Attorney, Agent, or Firm* — Baker Botts L.L.P.

(57) ABSTRACT

Systems and methods for control/monitoring of internal equipment in a riser assembly are disclosed. The method includes running a tool through at least a portion of an internal bore of a riser assembly associated with a well, and outputting a control signal from a first wireless communication interface disposed along the internal bore of the riser assembly. The first wireless communication interface is coupled to a communication system on the riser assembly. The method also includes receiving the control signal at a second wireless communication interface disposed on the tool, and actuating at least one equipment component of the tool in response to the second wireless communication interface receiving the control signal.

19 Claims, 30 Drawing Sheets

Related U.S. Application Data

14/618,411, filed on Feb. 10, 2015, now Pat. No. 9,206,654, which is a continuation-in-part of application No. 13/892,823, filed on May 13, 2013, now Pat. No. 8,978,770, said application No. 14/961,673 is a continuation-in-part of application No. 14/618,453, filed on Feb. 10, 2015, now Pat. No. 9,222,318, which is a continuation-in-part of application No. 13/892,823, filed on May 13, 2013, now Pat. No. 8,978,770, said application No. 14/961,673 is a continuation-in-part of application No. 14/618,497, filed on Feb. 10, 2015, now Pat. No. 9,228,397, which is a continuation-in-part of application No. 13/892,823, filed on May 13, 2013, now Pat. No. 8,978,770, said application No. 15/639,865 is a continuation-in-part of application No. 14/961,654, filed on Dec. 7, 2015, now Pat. No. 9,695,644, which is a continuation-in-part of application No. 14/618,411, filed on Feb. 10, 2015, now Pat. No. 9,206,654, which is a continuation-in-part of application No. 13/892,823, filed on May 13, 2013, now Pat. No. 8,978,770, said application No. 14/961,654 is a continuation-in-part of application No. 14/618,453, filed on Feb. 10, 2015, now Pat. No. 9,222,318, which is a continuation-in-part of application No. 13/892,823, filed on May 13, 2013, now Pat. No. 8,978,770, said application No. 14/961,654 is a continuation-in-part of application No. 14/618,497, filed on Feb. 10, 2015, now Pat. No. 9,228,397, which is a continuation-in-part of application No. 13/892,823, filed on May 13, 2013, now Pat. No. 8,978,770.

(60) Provisional application No. 61/646,847, filed on May 14, 2012.

(56) References Cited

U.S. PATENT DOCUMENTS

| | | | | |
|---|---|---|---|---|
| 4,491,346 | A | 1/1985 | Walker | |
| 4,496,172 | A | 1/1985 | Walker | |
| 4,557,508 | A | 12/1985 | Walker | |
| 5,441,311 | A | 4/1995 | Watkins | |
| 5,421,623 | A | 6/1995 | Cassin | |
| 5,634,671 | A | 6/1997 | Watkins | |
| 5,899,507 | A | 5/1999 | Schroeder et al. | |
| 6,359,569 | B2 * | 3/2002 | Beck | E21B 31/18 340/856.3 |
| 6,478,087 | B2 | 11/2002 | Allen | |
| 6,824,171 | B2 | 11/2004 | Milberger et al. | |
| 7,274,989 | B2 | 9/2007 | Hopper | |
| 7,331,395 | B2 | 2/2008 | Fraser et al. | |
| 7,337,848 | B2 | 3/2008 | Fraser et al. | |
| 7,503,391 | B2 | 3/2009 | McCanna et al. | |
| 7,513,308 | B2 * | 4/2009 | Hosie | E21B 33/035 166/255.2 |
| 7,686,087 | B2 | 3/2010 | Pallini et al. | |
| 7,686,342 | B2 | 3/2010 | Jennings et al. | |
| 7,762,338 | B2 * | 7/2010 | Fenton | E21B 33/043 166/348 |
| 7,913,767 | B2 | 3/2011 | Larson et al. | |
| 7,963,336 | B2 | 6/2011 | Fraser et al. | |
| 7,975,768 | B2 | 7/2011 | Fraser et al. | |
| 8,074,720 | B2 | 12/2011 | Radi | |
| 8,312,933 | B2 | 11/2012 | Larson et al. | |
| 8,317,234 | B2 | 11/2012 | McKay et al. | |
| 8,356,672 | B2 | 1/2013 | Fraser et al. | |
| 8,540,030 | B2 | 9/2013 | Radi | |
| 8,978,770 | B2 | 3/2015 | DeBerry et al. | |
| 9,091,604 | B2 | 7/2015 | Kobata et al. | |
| 9,103,204 | B2 * | 8/2015 | Yates | E21B 47/18 |
| 9,109,404 | B2 | 8/2015 | Gilmore et al. | |
| 9,165,272 | B1 | 10/2015 | Brown et al. | |
| 9,262,048 | B1 | 2/2016 | Brown et al. | |
| 9,262,740 | B1 | 2/2016 | Brown et al. | |
| 9,657,563 | B2 * | 5/2017 | Schuhrke | E21B 47/14 |
| 10,648,325 | B2 * | 5/2020 | Mulholland | E21B 47/13 |
| 10,890,043 | B2 * | 1/2021 | Carlsen | E21B 47/12 |
| 2002/0158120 | A1 | 10/2002 | Zierolf | |
| 2005/0100414 | A1 | 5/2005 | Salama | |
| 2008/0128138 | A1 | 6/2008 | Radi | |
| 2009/0188675 | A1 | 7/2009 | Bloom et al. | |
| 2009/0205820 | A1 | 8/2009 | Koederitz et al. | |
| 2009/0208295 | A1 | 8/2009 | Kinert et al. | |
| 2011/0204143 | A1 | 8/2011 | Mackenzie et al. | |
| 2012/0031620 | A1 | 2/2012 | Phadke | |
| 2012/0172072 | A1 | 7/2012 | Baxter et al. | |
| 2013/0076028 | A1 | 3/2013 | Pallini et al. | |
| 2013/0088362 | A1 * | 4/2013 | Yates | E21B 47/13 340/854.3 |
| 2013/0327533 | A1 | 12/2013 | Veeningen | |
| 2013/0335232 | A1 * | 12/2013 | Conway | E21B 47/13 340/850 |
| 2014/0060851 | A1 | 3/2014 | Mackenzie et al. | |
| 2014/0174752 | A1 | 6/2014 | Sipila et al. | |
| 2015/0226054 | A1 | 8/2015 | Schuhrke et al. | |
| 2016/0237804 | A1 | 8/2016 | Papadimitriou et al. | |
| 2016/0340988 | A1 | 11/2016 | Abou-Assaad et al. | |
| 2017/0321541 | A1 | 11/2017 | Francis et al. | |
| 2018/0156005 | A1 | 6/2018 | Carlsen et al. | |

FOREIGN PATENT DOCUMENTS

| | | | |
|---|---|---|---|
| GB | 2537712 | A | 10/2016 |
| WO | 2014078094 | A2 | 5/2014 |

OTHER PUBLICATIONS

Roy LONG: "Riser Life Cycle Monitoring System Undergoes Initial Research Phase", SPE, National Energy Technology Laboratory, US Department of Energy, Jul. 1, 2015 (5 pages).

Search Report issued in related Great Britain Patent Application No. GB2104448.2 dated Aug. 5, 2021, 2 pages.

* cited by examiner

CONTROL/MONITORING OF INTERNAL EQUIPMENT IN A RISER ASSEMBLY

CROSS-REFERENCE TO RELATED APPLICATIONS

The present application is a continuation in part claiming the benefit of U.S. patent application Ser. No. 16/378,004, entitled "Riser Monitoring and Lifecycle Management System and Method," filed on Apr. 8, 2019. This application is a continuation that claimed the benefit of U.S. patent application Ser. No. 15/639,865, entitled "Riser Monitoring and Lifecycle Management System and Method," filed on Jun. 30, 2017. This application is a continuation in part application that claimed the benefit of U.S. patent application Ser. No. 14/961,654, entitled "Smart Riser Handling Tool", filed on Dec. 7, 2015 and U.S. patent application Ser. No. 14/961,673, entitled "Riser Monitoring System and Method", filed on Dec. 7, 2015. These applications are continuations in part that claimed the benefit of U.S. patent application Ser. No. 14/618,411, entitled "Systems and Methods for Riser Coupling", filed on Feb. 10, 2015; U.S. patent application Ser. No. 14/618,453, entitled "Systems and Methods for Riser Coupling", filed on Feb. 10, 2015; and U.S. patent application Ser. No. 14/618,497, entitled "Systems and Methods for Riser Coupling", filed on Feb. 10, 2015. All three of these applications are continuations in part and claimed the benefit of U.S. patent application Ser. No. 13/892,823, entitled "Systems and Methods for Riser Coupling", filed on May 13, 2013, which claimed the benefit of provisional application Ser. No. 61/646,847, entitled "Systems and Methods for Riser Coupling", filed on May 14, 2012. All of these applications are herein incorporated by reference.

BACKGROUND

The present disclosure relates generally to well risers and, more particularly, to systems and methods for monitoring and lifecycle management of riser components or tools and components inside the riser.

In drilling or production of an offshore well, a riser may extend between a vessel or platform and the wellhead. The riser may be as long as several thousand feet, and may be made up of successive riser sections. Riser sections with adjacent ends may be connected on board the vessel or platform, as the riser is lowered into position. Auxiliary lines, such as choke, kill, and/or boost lines, may extend along the side of the riser to connect with the BOP, so that fluids may be circulated downwardly into the wellhead for various purposes. Connecting riser sections in end-to-end relation includes aligning axially and angularly two riser sections, including auxiliary lines, lowering a tubular member of an upper riser section onto a tubular member of a lower riser section, and locking the two tubular members to one another to hold them in end-to-end relation.

The riser section connecting process may require significant operator involvement. The repetitive nature of the process over time may create a risk of repetitive motion injuries and increasing potential for human error. Moreover, the riser section connecting process may involve heavy components and may be time-intensive. Therefore, there is a need in the art to improve the riser section connecting process and address these issues.

BRIEF DESCRIPTION OF THE DRAWINGS

Some specific exemplary embodiments of the disclosure may be understood by referring, in part, to the following description and the accompanying drawings.

Figure 1:
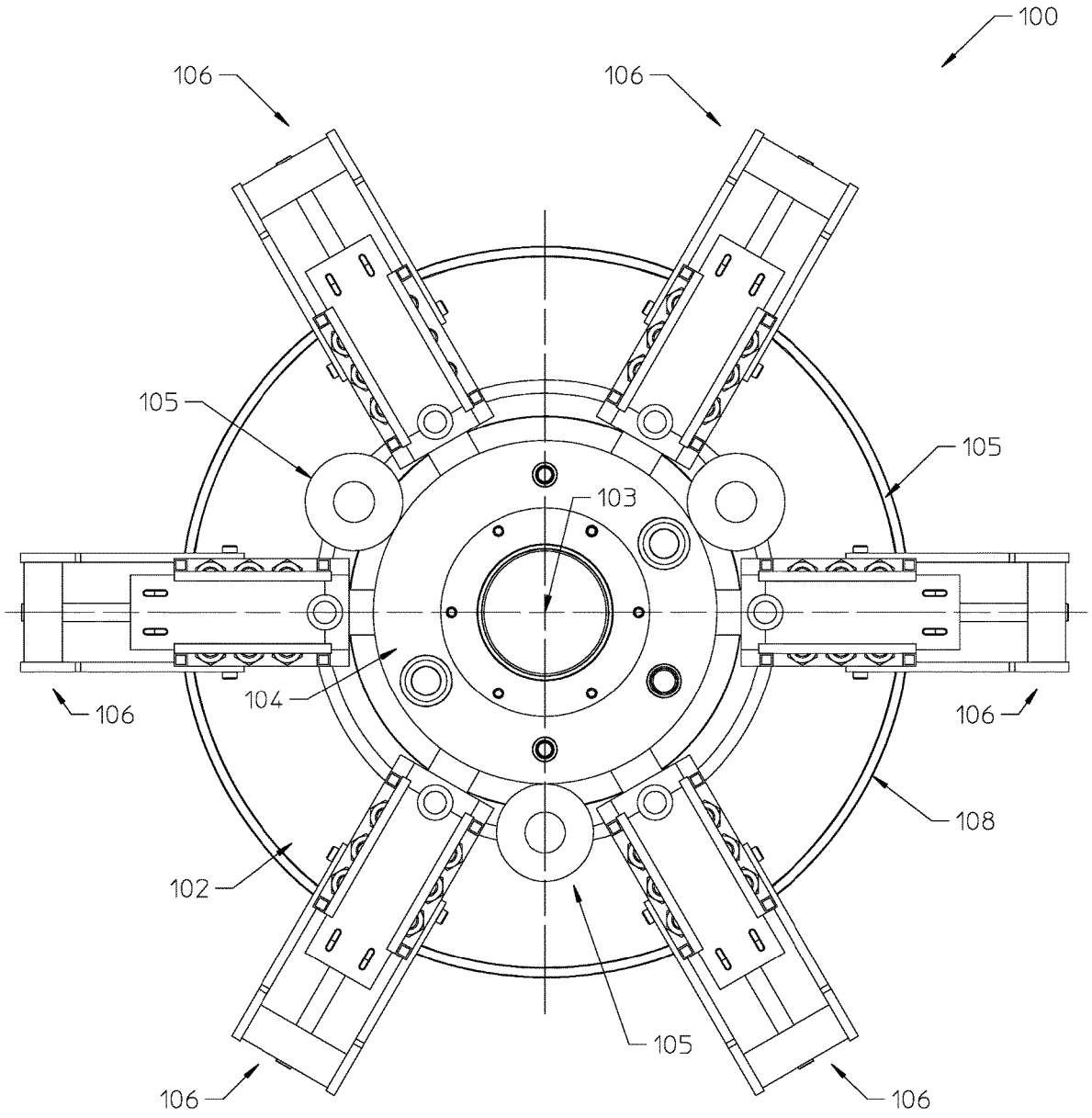
FIG. 1 shows a top view of one exemplary riser coupling system, in accordance with certain embodiments of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well risers and, more particularly, to systems and methods for riser monitoring.

Illustrative embodiments of the present disclosure are described in detail herein. In the interest of clarity, not all features of an actual implementation may be described in this specification. It will of course be appreciated that in the development of any such actual embodiment, numerous implementation specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure. To facilitate a better understanding of the present disclosure, the following examples of certain embodiments are given. In no way should the following examples be read to limit, or define, the scope of the disclosure.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves; and/or any combination of the foregoing.

For the purposes of this disclosure, a sensor may include any suitable type of sensor, including but not limited to optical, radio frequency, acoustical, pressure, torque, or proximity sensors.

FIG. 1 shows a top view of one exemplary riser coupling system 100, in accordance with certain embodiments of the present disclosure. The riser coupling system 100 may include a spider assembly 102 adapted to one or more of receive, at least partially orient, engage, hold, and actuate a riser joint connector 104. The spider assembly 102 may include one or more connector actuation tools 106. In certain embodiments, a plurality of connector actuation tools 106 may be spaced radially about an axis 103 of the spider assembly 102. By way of nonlimiting example, two connector actuation tools 106 may be disposed around a circumference of the spider assembly 102 in an opposing placement. The nonlimiting example of FIG. 1 show three pairs of opposing connector actuation tools 106. It should be understood that various embodiments may include any suitable number of connector actuation tools 106.

As depicted in FIG. 1, certain embodiments may include one or more orienting members 105 disposed radially about the axis 103 to facilitate orientation of the riser joint connector 104. By way of example without limitation, three orienting members 105 may include a cylindrical or generally cylindrical form extending upwards from a surface of the spider assembly 102. The orienting members 105 may act as guides to interface the riser joint connector 104 as the riser joint connector 104 is lowered toward the spider assembly 102, thereby facilitating orientation and/or alignment. In certain embodiments, the orienting members 105 may be fitted with one or more sensors (not shown) to detect position and/or orientation of the riser joint connector 104, and corresponding signals may be transferred to an information handling system at any suitable location on a vessel or platform by any suitable means, including wired or wireless means.

The spider assembly 102 may include a base 108. The base 108, and the spider assembly 102 generally, may be mounted directly or indirectly on a surface of a vessel or platform. For example, the base 108 may be disposed on or proximate to a rig floor. In certain embodiments, the base 108 may include or be coupled to a gimbal mount to facilitate balancing in spite of sea sway. The nonlimiting example of the spider assembly 102 with the base 108 includes a generally circular geometry about a central opening 110 configured for running riser sections therethrough. Various alternative embodiments may include any suitable geometry.

Figure 2:
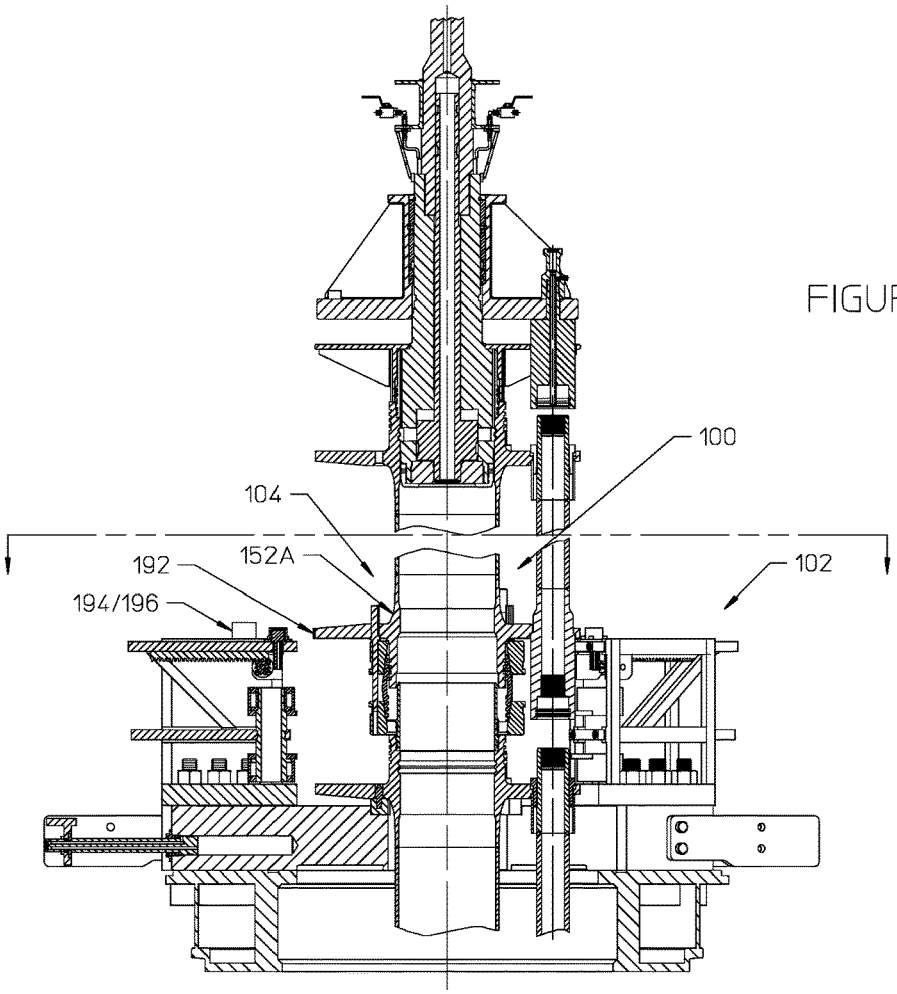
FIG. 2 shows a schematic view of an orientation system for aligning a riser joint within a riser coupling system, in accordance with certain embodiments of the present disclosure.

As mentioned above, certain embodiments of the spider assembly 102 and the riser connector assembly 104 may be fitted with sensors to enable determination of an orientation of the riser connector assembly 104 being positioned within the spider 102 (e.g., via a running tool). As illustrated in FIG. 2, for example, the riser coupling system 100 may include a radio frequency identification (RFID) based orientation system 190 for aligning a riser joint connector 104 within the riser coupling system 100. This RFID orientation system 190 may include one or more RFID tags 192 disposed on the riser joint connector 104 and an RFID reader 194 disposed on a section of the spider assembly 102, with one or more RFID antennae.

Each RFID tag 192 may be an electronic device that absorbs electrical energy from a radio frequency (RF) field. The RFID tag 192 may then use this absorbed energy to broadcast an RF signal containing a unique serial number to the RFID reader 194. In some embodiments, the RFID tags 192 may include on-board power sources (e.g., batteries) for powering the RFID tags 192 to output their unique RF signals to the reader 194. The signal output from the RFID tags 192 may be within the 900 MHz frequency band.

The RFID reader 194 may be a device specifically designed to emit RF signals and having an antenna to capture information (i.e., RF signals with serial numbers) from the RFID tags 192. The RFID reader 194 may respond differently depending on the relative position of the reader 194 to the one or more tags 192. For example, the RFID reader 194 may slowly capture the RF signal from the RFID tag 192 when the RFID tag 192 and the antenna of the RFID reader 194 are far apart. This may be the case when the riser joint connector 104 is out of alignment with the spider assembly 102. The RFID reader 194 may quickly capture the signal from the RFID tag 192 when the optimum alignment between the antenna of the reader 194 and the RFID tag 192 is achieved. In the illustrated embodiment, the riser joint connector 104 is oriented about the axis 103 such that one of the RFID tags 192 is as close as possible to the RFID reader 194, indicating that the riser joint connector 104 is in a desired rotational alignment within the riser coupling system 100.

The change in speed of response of the RFID reader 194 may be related to the field strength of the signal from the RFID tag 192 and may be directly related to the distance between the RFID tag 192 (transmitter) and the RFID reader 194 (receiver). The RFID reader 194 may take a signal strength measurement, also known as "receiver signal strength indicator" (RSSI), and provide this measurement to a controller 196 (e.g., information handling system) to determine whether the riser joint connector 104 is aligned with the spider assembly 102. The RS SI may be an electrical signal or computed value of the strength of the RF signal received via the RFID reader 194. An internally generated signal of the RFID reader 194 may be used to tune the receiver for optimal signal reception. The controller 196 may be communicatively coupled to the RFID reader 194 via a wired or wireless connection, and the controller 196 may also be communicatively coupled to actuators, running tools, or various operable components of the spider assembly 102.

In some embodiments, the RFID reader 194 may emit a constant power level RF signal, in order to activate any RFID tags 192 that are within range of the RF signal (or RF field). It may be desirable for the RFID reader 192 to emit a constant power signal, since the RF signal strength output from the RFID tags 192 is proportional to both distance and frequency of the signal. In the application described herein, the distance from the antenna of the RFID reader 194 to the RFID tag 192 may be used to locate the angular position of the riser joint connector 104 relative to the RFID reader 194.

Figure 3:
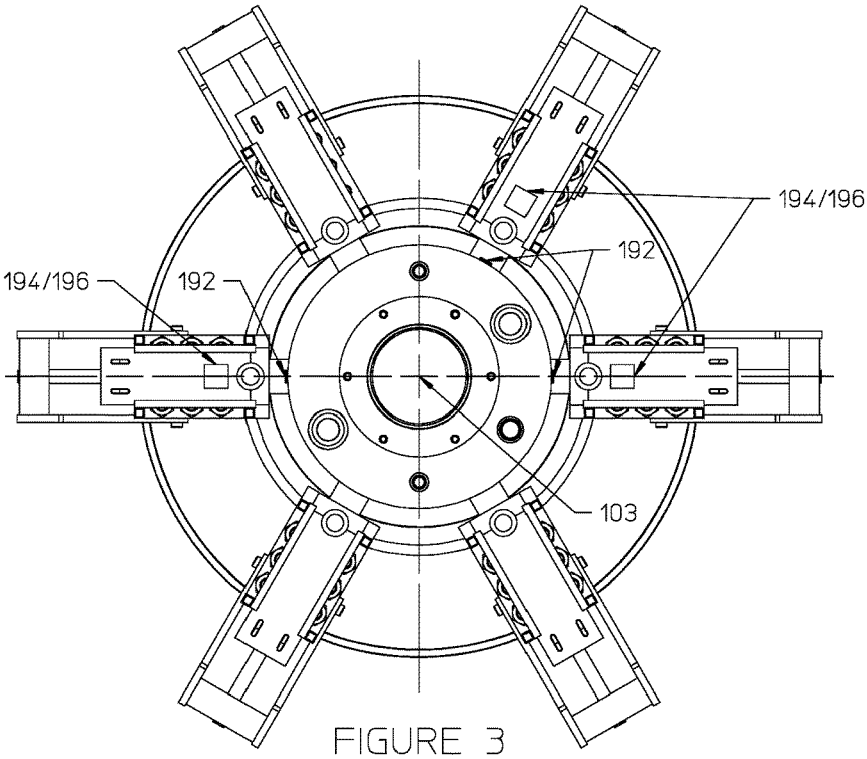
FIG. 3 shows a schematic view of a section of a riser joint with multiple RFID tags positioned thereon, in accordance with certain embodiments of the present disclosure.

In certain embodiments, the one or more RFID tags 192 may be disposed on a flange of a riser tubular that forms part of the riser joint connector 104. For example, the RFID tags 192 may be embedded onto a lower riser flange 152A of a tubular assembly 152 being connected with other tubular assemblies via the riser coupling system 100. From this position, the RFID tags 192 may react to the RF field from the RFID reader 194. It may be desirable to embed the RFID tags 192 into only one of two available riser flanges 152A along the tubular assembly 152, since RFID tags disposed on two adjacent riser flanges being connected could cause undesirable interference in the signal readings taken by the reader 194. As illustrated in FIG. 3, the flange 152A of the riser joint connector 104 may include three RFID tags 192 disposed thereabout. It should be noted that other numbers (e.g., 1, 2, 4, 5, or 6) of the RFID tags 192 may be disposed about the flange 152A in other embodiments. In some embodiments, the multiple RFID tags 192 may be generally disposed at equal rotational intervals around the flange 152A. In other embodiments, such as the illustrated embodiment of FIG. 3, the RFID tags 192 may be positioned in other arrangements. In still other embodiments, the RFID tags 192 may be disposed along other parts of the riser joint connector 104.

In some embodiments, a single RFID reader 194 may be used to detect RF signals indicative of proximity of the RFID tags 192 to the reader 194. The use of one RFID reader 194 may help to maintain a constant power signal emitted in the vicinity of the RFID tags 192 for initiating RF readings. In other embodiments, however, the RFID based orientation system 190 may utilize more than one reader 194. In the illustrated embodiment, the RFID reader 194 may be disposed on the spider assembly 102, near where the spider assembly 102 meets the riser joint connector 104. It should be noted that, in other embodiments, the RFID reader 194 may be positioned or embedded along other portions of the riser coupling system 100 that are rotationally stationary with respect to the spider assembly 102.

As the riser joint connector 104 is lowered to the spider assembly 102 for makeup, the RFID tags 192 embedded into the edge of the riser flange may begin to respond to the RF field output via the reader 194. Based on the Received Signal Strength Indication (RSSI) received at the RFID reader 194 in response to the RFID tags 192, the controller 196 may output a signal to a running tool and/or an orienting device to rotate the riser joint connector 104 about the axis 103. The tools may rotate the riser joint connector 104 until the riser joint connector 104 is brought into a desirable alignment with the spider assembly 102 based on the signal received at the reader 194. Upon aligning the riser joint connector 104, the running tool may then lower the riser joint connector 104 into the spider assembly 102, and the spider assembly 102 may actuate the riser joint connector 104 to lock the tubular assembly 152 to a lower tubular assembly (not shown).

Once the riser joint connector 104 is locked and lowered into the sea, the RFID tags 192 may shut off in response to the tags 192 being out of range of the RFID transmitter/reader 194. In embodiments where the electrical power is transferred to the RFID tags 192 via RF signals from the reader 194, there are no batteries to change out or any concerns over electrical connections to the RFID tags 192 that are then submersed in water. The RFID orientation system 190 may provide accurate detection of the rotational positions of the riser joint connector 104 with respect to the spider assembly 102 before setting the riser joint connector 104 in place and making the riser connection. By sensing the signal strength of embedded RFID tags 192, the RFID orientation system 190 is able to provide this detection without the use of complicated mechanical means (e.g., gears, pulleys) or electronic encoders for detecting angular rotation and alignment. Once the alignment of the riser joint connector 104 is achieved, the RFID reader 190 may shutoff the RF power transmitter 194, thereby silencing the RFID tags 192.

Figure 4A:
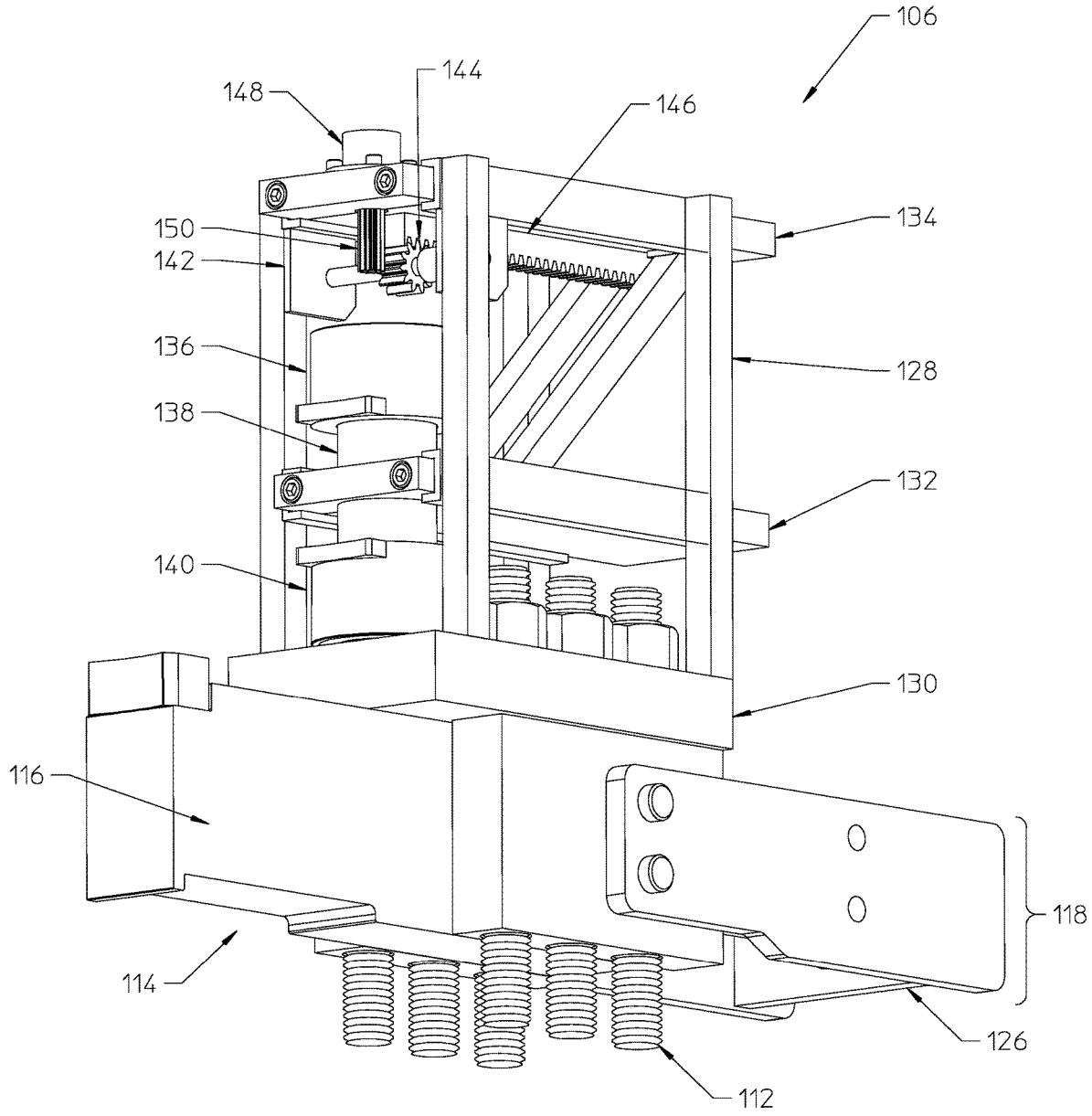
FIG. 4A shows a side elevational view of one exemplary connector actuation tool, in accordance with certain embodiments of the present disclosure.
Figure 4B:
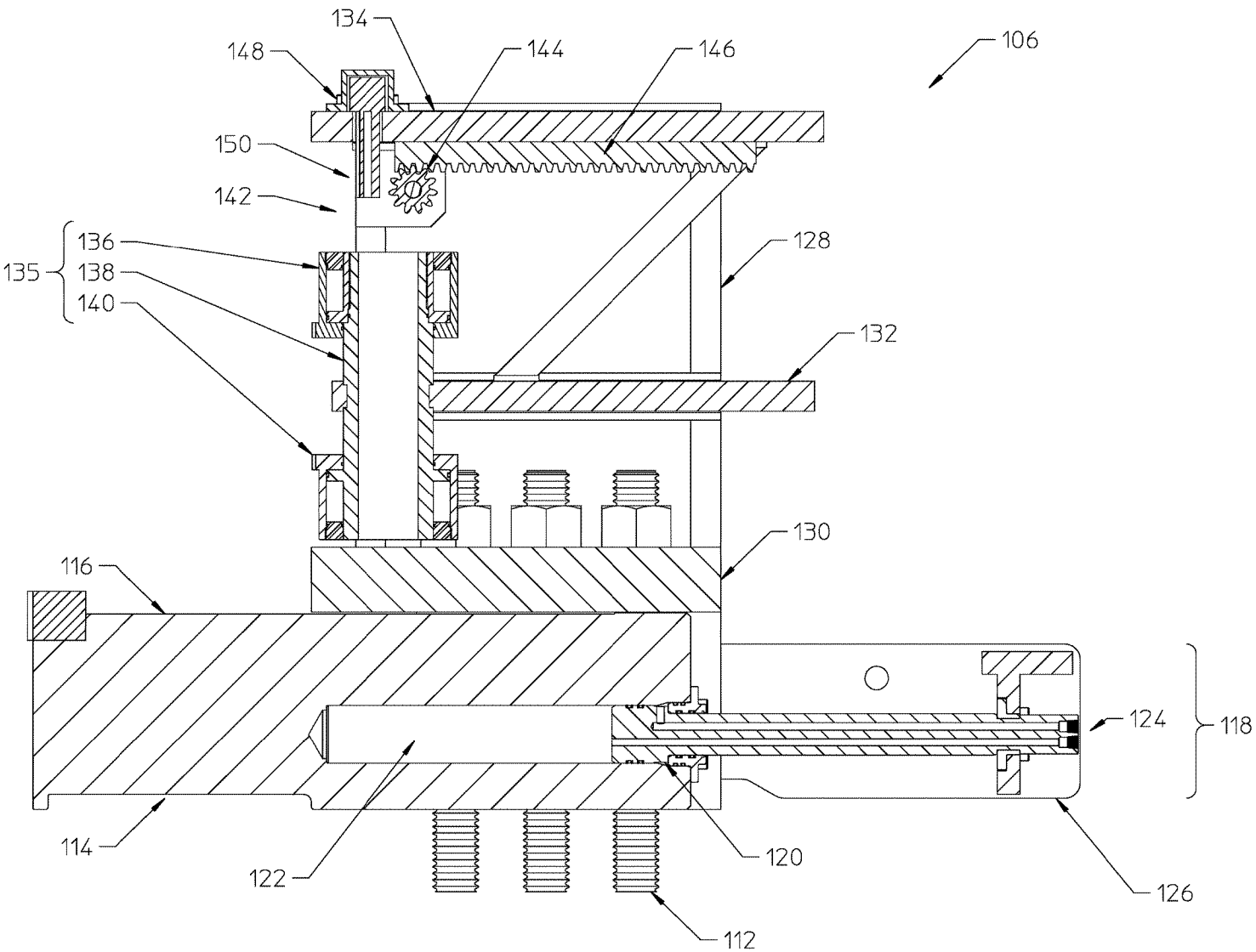
FIG. 4B shows a cross-sectional view of a connector actuation tool, in accordance with certain embodiments of the present disclosure.

FIG. 4A shows an angular view of one exemplary connector actuation tool 106, in accordance with certain embodiments of the present disclosure. FIG. 4B shows a cross-sectional view of the connector actuation tool 106. The connector actuation tool 106 may include a connection means 112 to allow connection to the base 108 (omitted in FIGS. 4A, 4B). As depicted, the connection means 112 may include a number of threaded bolts. However, it should be appreciated that any suitable means of coupling, directly or indirectly, the connector actuation tool 106 to the rest of the spider assembly 102 (omitted in FIGS. 4A, 4B) may be employed.

The connector actuation tool 106 may include a dog assembly 114. The dog assembly 114 may include a dog 116 and a piston assembly 118 configured to move the dog 116. The piston assembly 118 may include a piston 120, a piston cavity 122, one or more hydraulic lines 124 to be fluidly coupled to a hydraulic power supply (not shown), and a bracket 126. The bracket 126 may be coupled to a support frame 128 and the piston 120 so that the piston 120 remains stationary relative to the support frame 128. The support frame 128 may include or be coupled to one or more support plates. By way of example without limitation, the support frame 128 may include or be coupled to support plates 130, 132, and 134. The support plate 130 may provide support to the dog 116.

With suitable hydraulic pressure applied to the piston assembly 118 from the hydraulic power supply (not shown), the piston cavity 122 may be pressurized to move the dog 116 with respect to one or more of the piston 120, the bracket 126, the support frame 128, and the support plate 130. In the non-limiting example depicted, each of the piston 120, the bracket 126, the support frame 128, and the support plate 130 is adapted to remain stationary though the dog 116 moves. FIGS. 4A and 4B depict the dog 116 in an extended state relative to the rest of the connector actuation tool 106.

The connector actuation tool 106 may include a clamping tool 135. By way of example without limitation, the clamping tool 135 may include one or more of an upper actuation piston 136, an actuation piston mandrel 138, and a lower actuation piston 140. Each of the upper actuation piston 136 and the lower actuation piston 140 may be fluidically coupled to a hydraulic power supply (not shown) and may be moveably coupled to the actuation piston mandrel 138. With suitable hydraulic pressure applied to the upper and lower actuation pistons 136, 140, the upper and lower actuation pistons 136, 140 may move longitudinally along the actuation piston mandrel 138 toward a middle portion of the actuation piston mandrel 138. FIGS. 4A and 4B depict the upper and lower actuation pistons 136, 140 in a non-actuated state.

The actuation piston mandrel 138 may be extendable and retractable with respect to the support frame 128. A motor 142 may be drivingly coupled to the actuation piston mandrel 138 to selectively extend and retract the actuation piston mandrel 138. By way of example without limitation, the motor 142 may be drivingly coupled to a slide gear 144 and a slide gear rack 146, which may in turn be coupled to the support plate 134, the support plate 132, and the actuation piston mandrel 138. The support plates 132, 134 may be moveably coupled to the support frame 128 to extend or retract together with the actuation piston mandrel 138, while the support frame 128 remains stationary. FIGS. 4A and 4B depict the slide gear rack 146, the support plates 132, 134, and the actuation piston mandrel 138 in a retracted state relative to the rest of the connector actuation tool 106.

The connector actuation tool 106 may include a motor 148, which may be a torque motor, mounted with the support plate 134 and driving coupled to a splined member 150. The splined member 150 may also be mounted to extend and retract with the support plate 134. It should be understood that while one non-limiting example of the connector actuation tool 106 is depicted, alternative embodiments may include suitable variations, including but not limited to, a dog assembly at an upper portion of the connector actuation tool, any suitable number of actuation pistons at any suitable position of the connector actuation tool, any suitable motor arrangements, and the use of electric actuators instead of or in combination with hydraulic actuators.

In certain embodiments, the connector actuation tool 106 may be fitted with one or more sensors (not shown) to detect position, orientation, pressure, and/or other parameters of the connector actuation tool 106. For nonlimiting example, one or more sensors may detect the positions of the dog 116, the clamping tool 135, and/or splined member 150. Corresponding signals may be transferred to an information handling system at any suitable location on the vessel or platform by any suitable means, including wired or wireless means. In certain embodiments, control lines (not shown) for one or more of the motor 148, clamping tool 135, and dog assembly 114 may be feed back to the information handling system by any suitable means.

Figure 5:
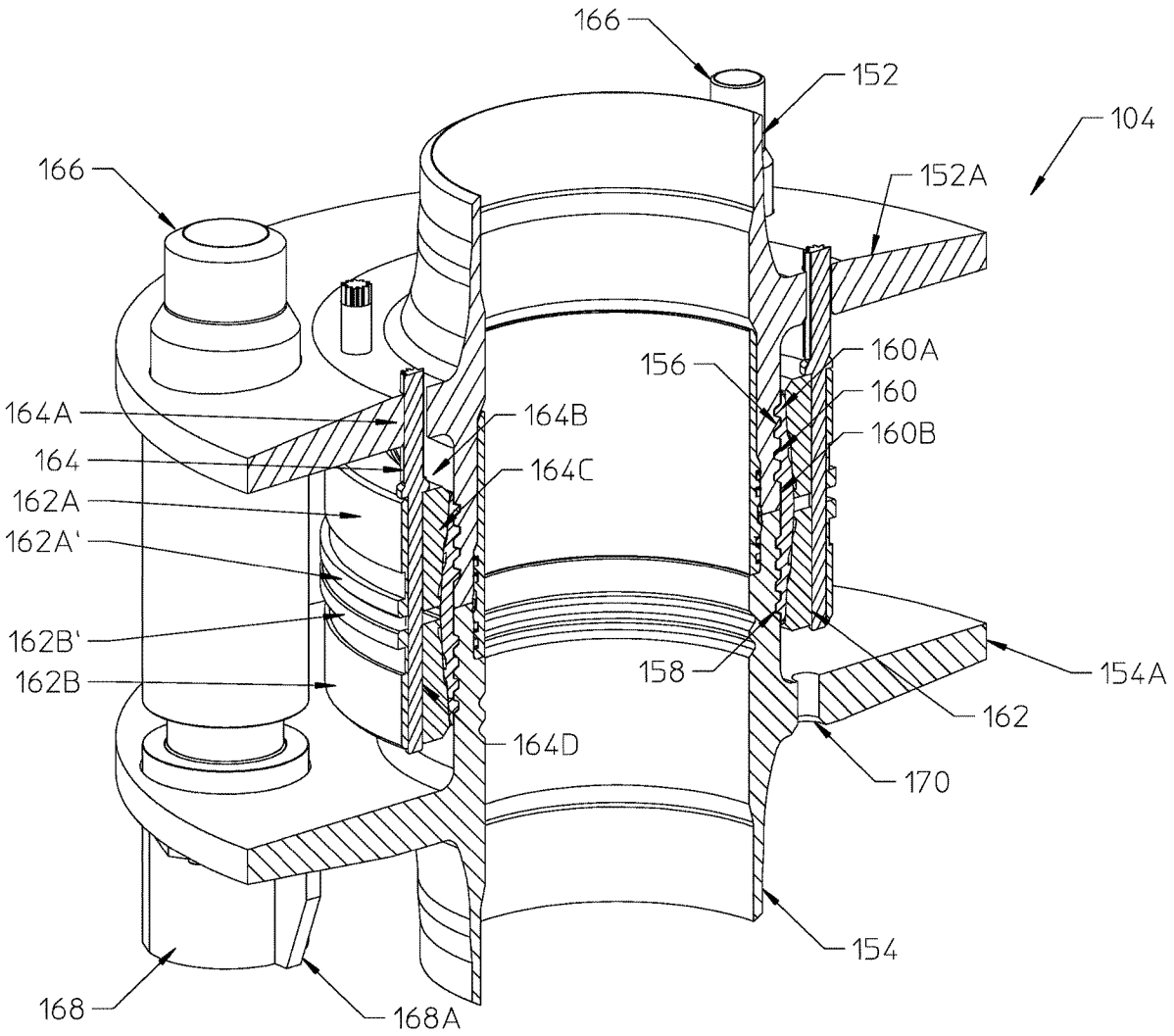
FIG. 5 shows a partially cut-away side elevational view of a connector assembly, in accordance with certain embodiments of the present disclosure.

FIG. 5 shows a cross-sectional view of a riser joint connector 104, in accordance with certain embodiments of the present disclosure. The riser joint connector 104 may include an upper tubular assembly 152 and a lower tubular assembly 154, each arranged in end-to-end relation. The upper tubular assembly 152 sometimes may be referenced as a box; the lower tubular assembly 154 may be referenced as a pin.

Certain embodiments may include a seal ring (not shown) between the tubular members 152, 154. The upper tubular assembly 152 may include grooves 156 about its lower end. The lower member 154 may include grooves 158 about its upper end. A lock ring 160 may be disposed about the grooves 156, 158 and may include teeth 160A, 160B. The teeth 160A, 160B may correspond to the grooves 156, 158. The lock ring 160 may be radially expandable and contractible between an unlocked position in which the teeth 160A, 160B are spaced from the grooves 156, 158, and a locking position in which the lock ring 160 has been forced inwardly so that teeth 160A, 160B engage with the grooves 156, 158 and thereby lock the connection. Thus, the lock ring 160 may be radially moveable between a normally expanded, unlocking position and a radially contracted locking position, which may have an interference fit. In certain embodiments, the lock ring 160 may be split about its circumference so as to normally expand outwardly to its unlocking position. In certain embodiments, the lock ring 160 may include segments joined to one another to cause it to normally assume a radially outward position, but be collapsible to contractible position.

A cam ring 162 may be disposed about the lock ring 160 and may include inner cam surfaces that can slide over surfaces of the lock ring 160. The cam surfaces of the cam ring 162 may provide a means of forcing the lock ring 160 inward to a locked position. The cam ring 162 may include an upper member 162A and a lower member 162B with corresponding lugs 162A' and 162B'. The upper member 162A and the lower member 162B may be configured as opposing members. The cam ring 162 may be configured so that movement of the upper member 162A and the lower member 162B toward each other forces the lock ring 160 inward to a locked position via the inner cam surfaces of the cam ring 162.

The riser joint connector 104 may include one or more locking members 164. A given locking member 164 may be adapted to extend through a portion of the cam ring 162 to maintain the upper member 162A and the lower member 162B in a locking position where each has been moved toward the other to force the lock ring 160 inward to a locked position. The locking member 164 may include a splined portion 164A and may extend through a flange 152A of the upper tubular assembly 152. The locking member 164 may include a retaining portion 164B, which may include but not be limited to a lip, to abut the upper member 162A. The locking member 164 may include a tapered portion 164C to fit a portion of the upper member 162A. The locking member 164 may include a threaded portion 164D to engage the lower member 162B via threads. Some embodiments of the riser joint connector 104 may include a secondary locking mechanism, in addition to the cam ring 162 and the lock ring 160.

The riser joint connector 104 may include one or more auxiliary lines 166. For example, the auxiliary lines 166 may include one or more of hydraulic lines, choke lines, kill lines, and boost lines. The auxiliary lines 166 may extend through the flange 152A and a flange 154A of the lower tubular assembly 154. The auxiliary lines 166 may be adapted to mate between the flanges 152A, 154A, for example, by way of a stab fit.

The riser joint connector 104 may include one or more connector orientation guides 168. A given connector orientation guide 168 may be disposed about a lower portion of the riser joint connector 104. By way of example without limitation, the connector orientation guide 168 may be coupled to the flange 154A. The connector orientation guide 168 may include one or more tapered surfaces 168A formed to, at least in part, orient at least a portion of the riser joint connector 104 when interfacing one of the dog assemblies (e.g., 114 of FIGS. 4A and 4B). When the dog assembly 114 described above contacts one or more of the tapered surfaces 168A of the connector orientation guide 168, the one or more tapered surfaces 168A may facilitate axial alignment and/or rotational orientation of the riser joint connector 104 by biasing the riser joint connector 104 toward a predetermined position with respect to the dog assembly. In certain embodiments, the connector orientation guide 168 may provide a first stage of an orientation process to orient the lower tubular assembly 154.

The riser joint connector 104 may include one or more orientation guides 170. In certain embodiments, the one or more orientation guides 170 may provide a second stage of an orientation process. A given orientation guide 170 may be disposed about a lower portion of the riser joint connector 104. By way of example without limitation, the orientation guide 170 may be formed in the flange 154A. The orientation guide 170 may include a recess, cavity or other surfaces adapted to mate with a corresponding guide pin 172 (depicted in FIG. 6).

Figure 6:
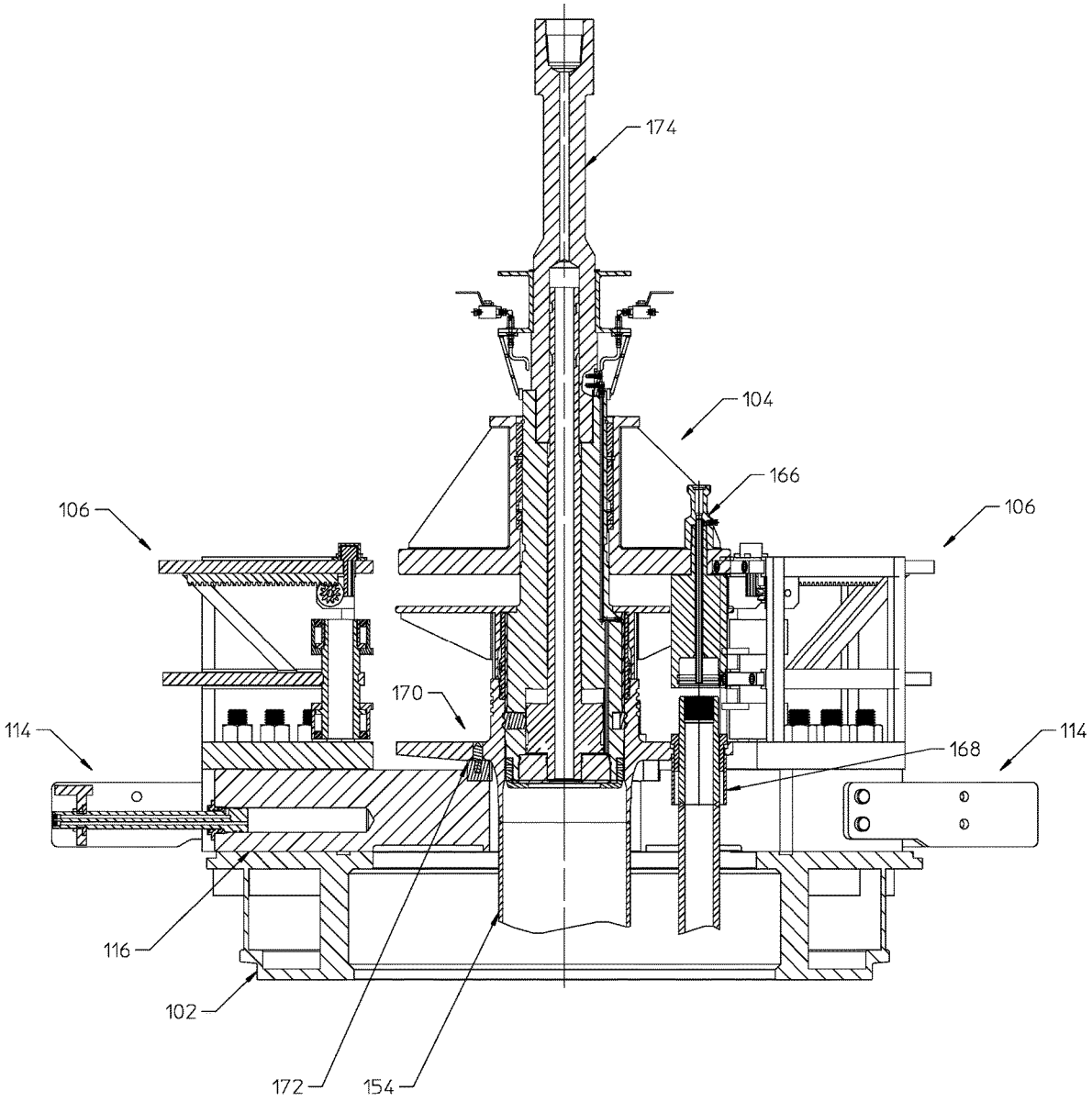
FIG. 6 shows a cross-sectional view of landing a riser section, which may include the lower tubular assembly, in the spider assembly, in accordance with certain embodiments of the present disclosure.

FIG. 6 shows a cross-sectional view of landing a riser section, which may include the lower tubular assembly 154, in the spider assembly 102, in accordance with certain embodiments of the present disclosure. In the example landed state shown, the dogs 116 have been extended to retain the tubular assembly 154, and the two-stage orientation features have oriented the lower tubular assembly 154. Specifically, the connector orientation guide 168 has already facilitated axial alignment and/or rotational orientation of the lower tubular assembly 154, and one or more of the dog assemblies 114 may include a guide pin 172 extending to mate with the orientation guide 170 to ensure a final desired orientation.

A running tool 174 may be adapted to engage, lift, and lower the lower tubular assembly 154 into the spider assembly 102. In certain embodiments, the running tool 174 may be adapted to also test the auxiliary lines 166. For example, the running tool 174 may pressure test choke and kill lines coupled below the lower tubular assembly 154.

In certain embodiments, one or more of the running tool 174, the tubular assembly 154, and auxiliary lines 166 may be fitted with one or more sensors (not shown) to detect position, orientation, pressure, and/or other parameters associated with said components. Corresponding signals may be transferred to an information handling system at any suitable location on the vessel or platform by any suitable means, including wired or wireless means.

Figure 7:
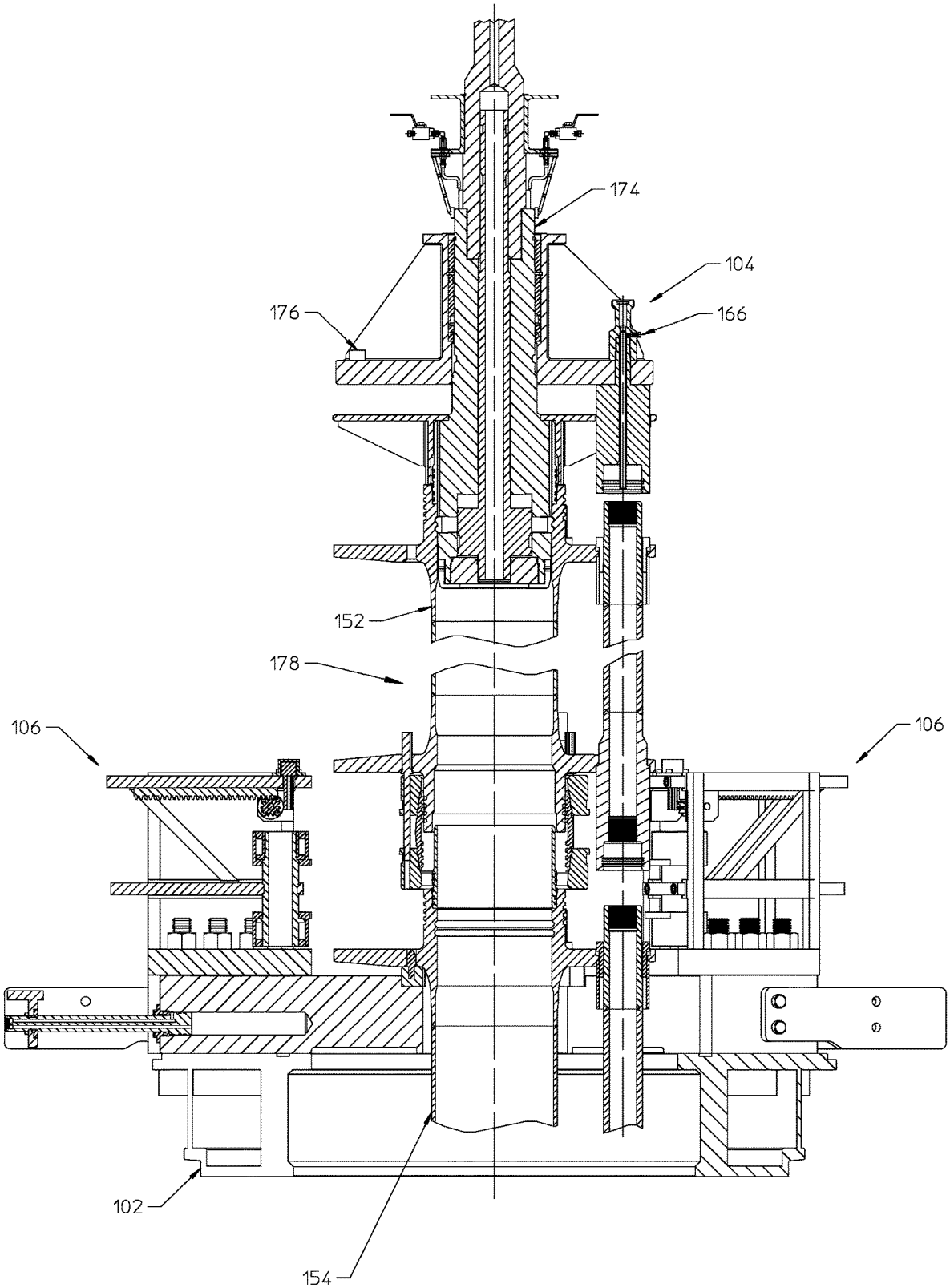
FIG. 7 shows a cross-sectional view of running the upper tubular assembly to the landed lower tubular assembly, in accordance with certain embodiments of the present disclosure.

FIG. 7 shows a cross-sectional view of running the upper tubular assembly 152 to the landed lower tubular assembly 154, in accordance with certain embodiments of the present disclosure. The running tool 174 may be used to engage, lift, and lower the upper tubular assembly 152. The upper tubular assembly 152 may be lowered onto a stab nose 178 of the lower tubular assembly 154.

In certain embodiments, as described in further detail below, the running tool 174 may include one or more sensors 176 to facilitate proper alignment and/or orientation of the upper tubular assembly 152. The one or more sensors 176 may be located at any suitable positions on the running tool 174. In certain embodiments, the tubular member 152 may be fitted with one or more sensors (not shown) to detect position, orientation, pressure, weight, and/or other parameters of the tubular member 152. Corresponding signals may be transferred to an information handling system at any suitable location on the vessel or platform by any suitable means, including wired or wireless means.

It should be understood that orienting the upper tubular assembly 152 may be performed at any suitable stage of the lowering process, or throughout the lower process.

Figure 8:
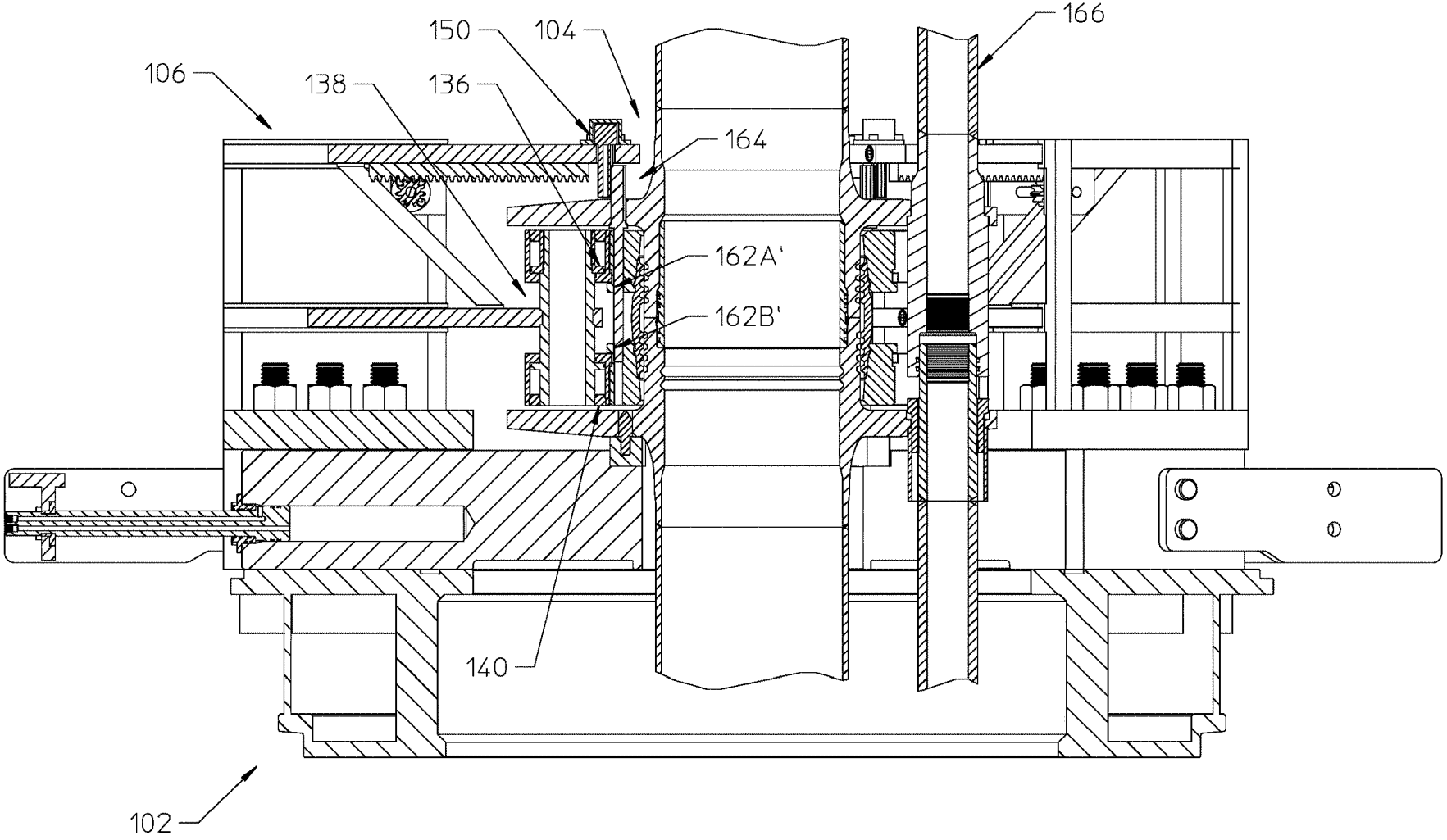
FIG. 8 shows a cross-sectional view of the connector actuation tool engaging a riser joint prior to locking a riser joint, in accordance with certain embodiments of the present disclosure.

FIG. 8 shows a cross-sectional view of the connector actuation tool 106 engaging the riser joint connector 104 prior to locking the riser joint connector 104, in accordance with certain embodiments of the present disclosure. As depicted, the actuation piston mandrel 138 may be extended toward the riser joint connector 104. The upper actuation piston 136 may engage the lug 162A' and/or an adjacent groove of the cam ring 162. Likewise, the lower actuation piston 140 may engage the lug 162B' and/or an adjacent groove of the cam ring 162. The splined member 150 may also be extended toward the riser joint connector 104. As depicted, the splined member 150 may engage the locking member 164. In various embodiments, the actuation piston mandrel 138 and the splined member 150 may be extended simultaneously or at different times.

Figure 9:
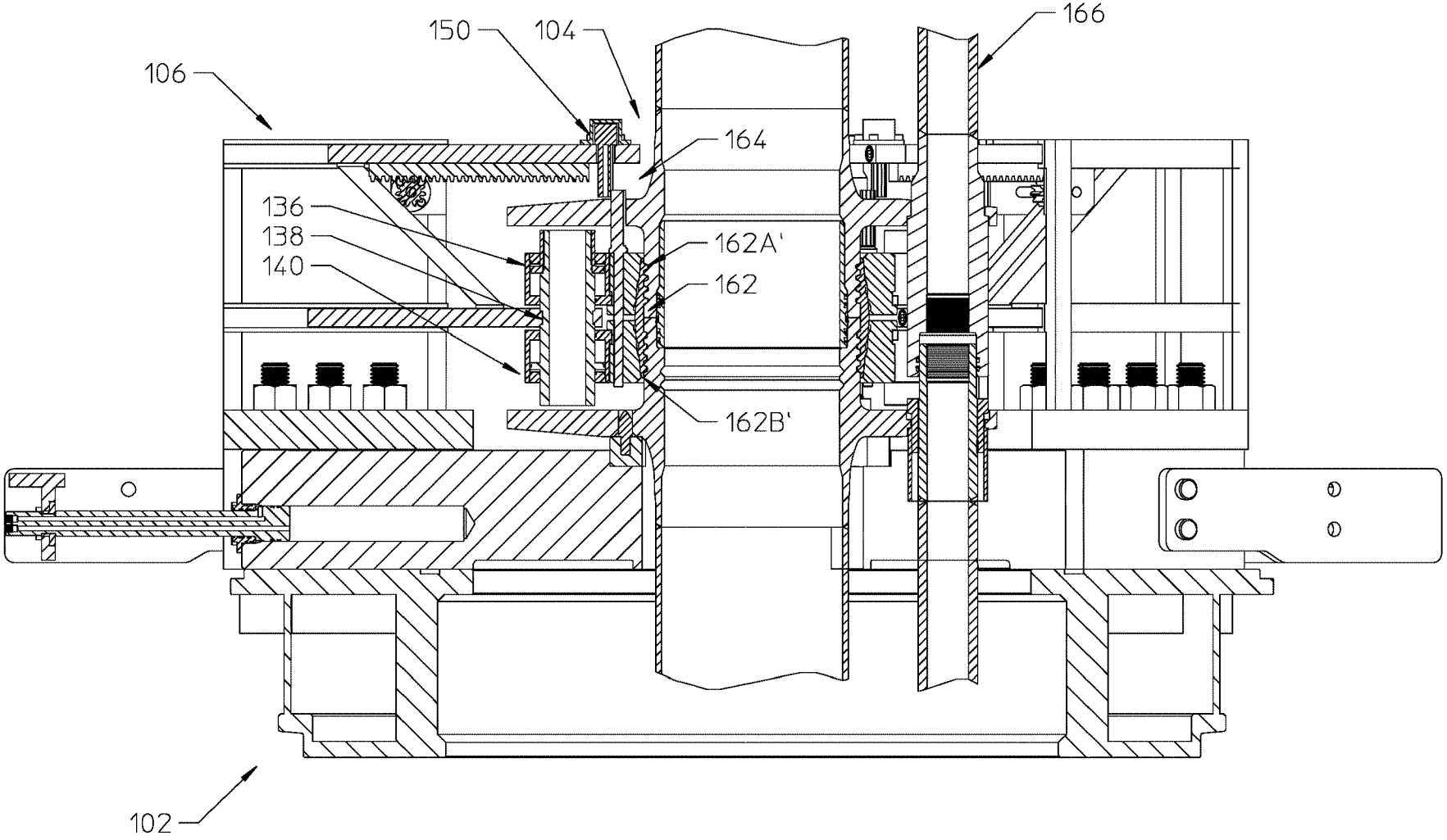
FIG. 9 shows a cross-sectional view of a connector actuation tool locking a riser joint, in accordance with certain embodiments of the present disclosure.

FIG. 9 shows a cross-sectional view of the connector actuation tool 106 locking the riser joint connector 104, in accordance with certain embodiments of the present disclosure. As depicted, with suitable hydraulic pressure having been applied to the upper and lower actuation pistons 136, 140, the upper and lower actuation pistons 136, 140 moved longitudinally along the actuation piston mandrel 138 toward a middle portion of the actuation piston mandrel 138. The upper member 162A and the lower member 162B of the cam ring 162 are thereby forced toward one another, which may act as a clamp that in turn forces the lock ring 160 inward to a locked position via the inner cam surfaces of the cam ring 162. As depicted, the locking member 164 may be in a locked position after the motor 148 has driven the splined member 150, which in turn has driven the locking member 164 into the locked position to lock the cam ring 162 in a clamped position. In various embodiments, the locking member 164 may be actuated into the locked position as the cam ring 162 transitions to a locked position or at a different time.

The connector actuation tool 106 may then be retracted, in accordance with certain embodiments of the present disclosure. From that position, the running tool 174 (depicted in previous figures) may engage the riser joint connector 104 and lift the riser joint connector 104 away from the guide pin 172. The dogs 114 may be retracted, the riser joint connector 104 may be lowered passed the spider assembly 102, and the process of landing a next lower tubular may be repeated. It should be understood that a dismantling process may entail reverses the process described herein.

Some embodiments of the riser joint connector 104 may feature a modular design that enables a coupling used to lock the tubular assemblies 152/154 together to be selectively removable from the tubular assemblies.

Figure 10:
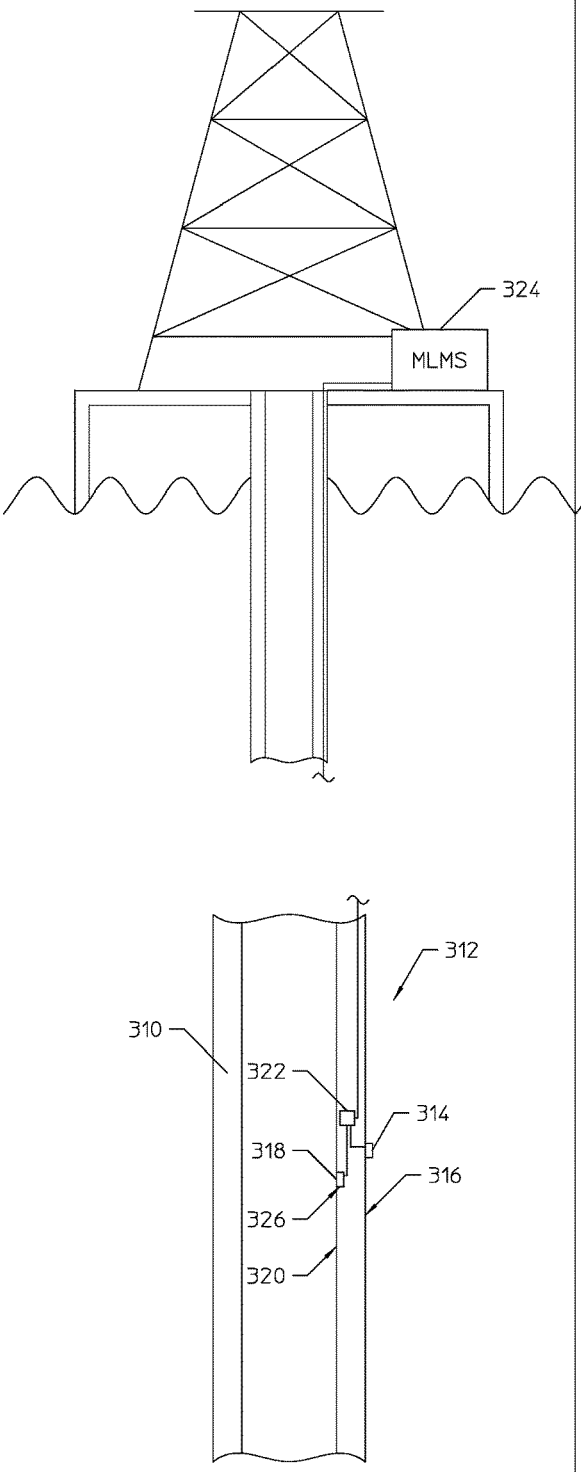
FIG. 10 shows a schematic view of a riser assembly equipped with an external and internal monitoring system, in accordance with certain embodiments of the present disclosure.

As mentioned above, the tubular assemblies 152/154 and the running tool 174 may include sensors to facilitate orientation and placement of the tubular assemblies 152 and 154 relative to one another. Other sensors may be used throughout the riser system to enable monitoring of various properties of the riser components. For example, FIG. 10 shows a schematic view of a riser assembly 310 that may be equipped with an improved riser monitoring system 312. The riser monitoring system 312 may provide two types of monitoring of the riser assembly 310: external monitoring and/or internal monitoring.

The external monitoring of the riser assembly 310 may be carried out by external sensors 314 disposed on an outer surface 316 of one or more components of the riser assembly 310. The internal monitoring of the riser assembly 310 may be carried out by internal sensors 318 disposed along an internal bore 320 through one or more components of the riser assembly 310. Although FIG. 10 illustrates a riser assembly 310 having an external sensor 314 and an internal sensor 318, it should be noted that other embodiments of the riser assembly 310 may include just external sensors 314 (one or more), or just internal sensors 318 (one or more), depending on the monitoring needs of the system. A riser communication system 322 may communicate signals indicative of the properties sensed by the riser monitoring system 312 to an information handling system 324 at a suitable location on the vessel or platform. The information handling system 324 may be an operator monitoring system. In some embodiments, the operator monitoring system 324 may include a monitoring/lifecycle management system (MLMS) that helps to track loads on various components of the riser assembly 310, among other things.

Figure 11:
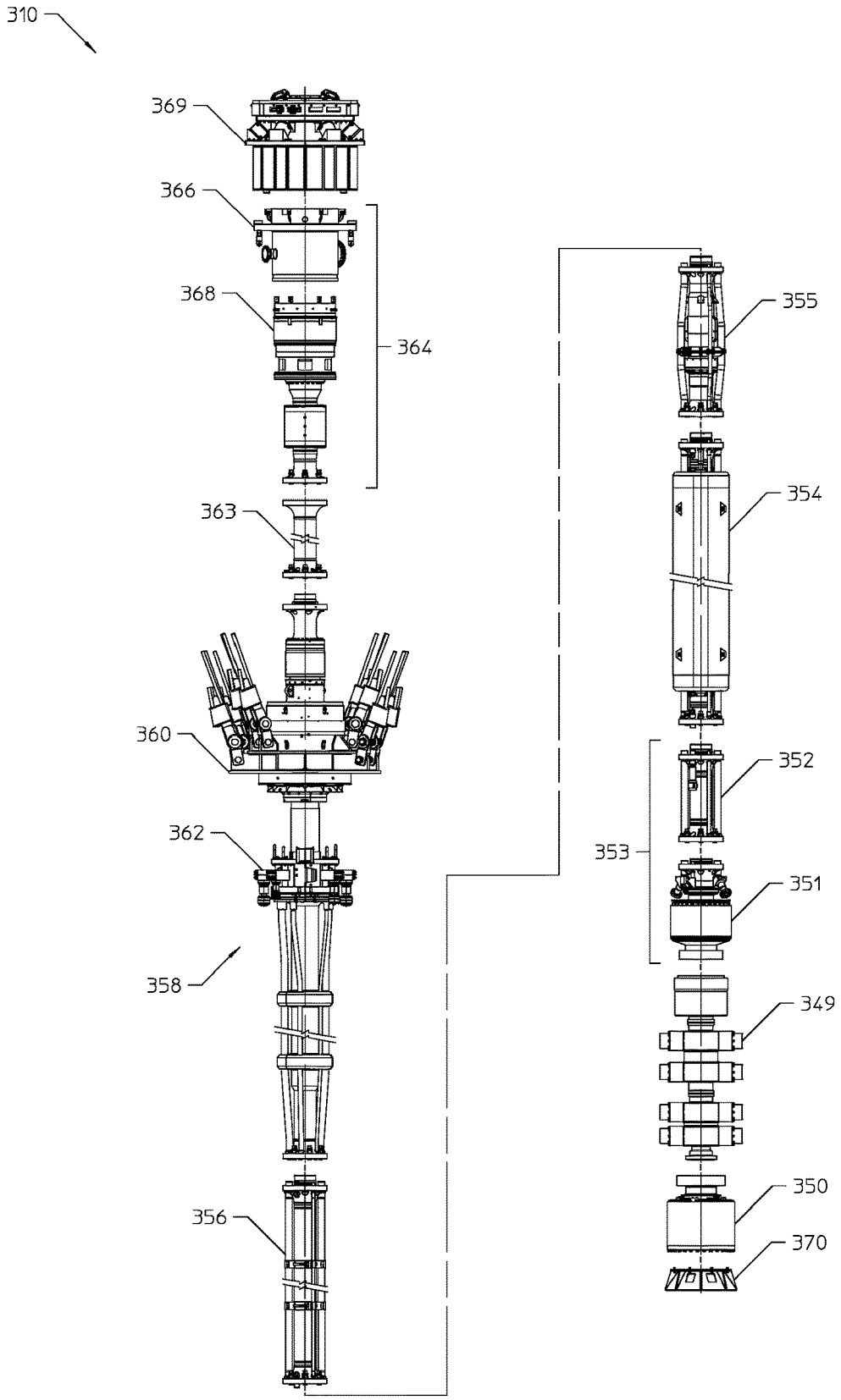
FIG. 11 shows a schematic exploded view of components that make up a riser assembly, in accordance with certain embodiments of the present disclosure.

FIG. 11 illustrates an embodiment of the riser assembly 310, which may include the following equipment: a BOP connector (or wellhead connector) 350, a lower BOP stack 349, a riser extension joint 353 that may include a lower marine riser package (LMRP) 351 and a boost line termination joint 352, one or more buoyant riser joints 354, an auto fill valve 355, one or more bare riser joints 356, a telescopic joint 358 having a tension ring 360 and a termination ring 362, a riser landing joint (or spacer joint) 363, a diverter assembly 364 having a diverter housing 366 and a diverter flex joint 368, and a gimbal mount 369 for the base of the spider assembly 102. As shown, several components of the riser assembly 310 may generally be coupled end to end, or in series, between an upper component (e.g., rig platform) and a lower component (e.g., subsea wellhead 370).

Any of the riser components disclosed herein may be equipped with one or more of the external sensors 314, internal sensors 318, or both. All of the sensors 314 and 318 used throughout the riser assembly 310 may be communicatively coupled to the MLMS 324, which determines and monitors an operating status of the riser assembly 310 based on the sensor feedback.

In some embodiments, the riser assembly 310 may include only some of the components listed above with respect to FIG. 11. In some embodiments, different combinations of the illustrated components may be utilized in the riser assembly 310. In still other embodiments, the riser assembly 310 may include additional components not listed above that may be equipped with sensors for monitoring internal or external properties of the riser assembly 310.

External monitoring of the riser assembly 310 may be performed by the external sensors 314. These external sensors 314 may monitor any of the following aspects of the riser assembly 310: pressures, temperatures, flowrates, stress (e.g., tension, compression, torsion, or bending), strain, weight, orientation, proximity, or corrosion. Other properties may be measured by the external sensors 314 as well. The external sensors 314 may be mounted throughout the riser assembly 310. For example, the external sensors 314 may be mounted to the outer surfaces of various riser joints (e.g., bare riser joints 356 or buoyant riser joints 354), the riser extension joint 352, the telescopic joint 358, the diverter assembly 364, as well as various other components of the riser assembly 310.

Internal monitoring may be performed throughout the riser assembly 310 via the internal sensors 318. These internal sensors 318 may also monitor various properties of the riser assembly 310 such as, for example, pressure, temperatures, flowrates, stress, strain, weight, orientation, proximity, or corrosion. Other properties may be measured as well by the internal sensors 318. The internal sensors 318 may be disposed along the internal bore 320 of the riser assembly 310 (or other positions internal to the riser assembly 310). In some embodiments, the internal sensors 318 may reside inside the various riser joints (e.g., bare riser joints 356 or buoyant riser joints 358), the extension joint 352, the BOP connector 350, as well as various other components of the riser assembly 310.

As illustrated in FIG. 10, the riser assembly components may be constructed such that a cavity 326 is formed in the riser component along the internal bore 320, and the internal sensor 318 is positioned within the cavity such that the sensor 318 is exposed to the internal bore 320 without extending radially into the internal bore 320. That way, the internal sensors 318 lie flat against the wall of the inner bore 320 throughout the riser assembly 310. In some embodiments, the internal sensors may be mounted on the outside of the riser component and penetrate through the wall of the riser component so it can easily be connected to the communication system and still provide internal sensing. This keeps the sensors 318 from interrupting a flow of fluids through the internal bore 320 or interfering with equipment being lowered through the internal bore 320.

Figure 12:
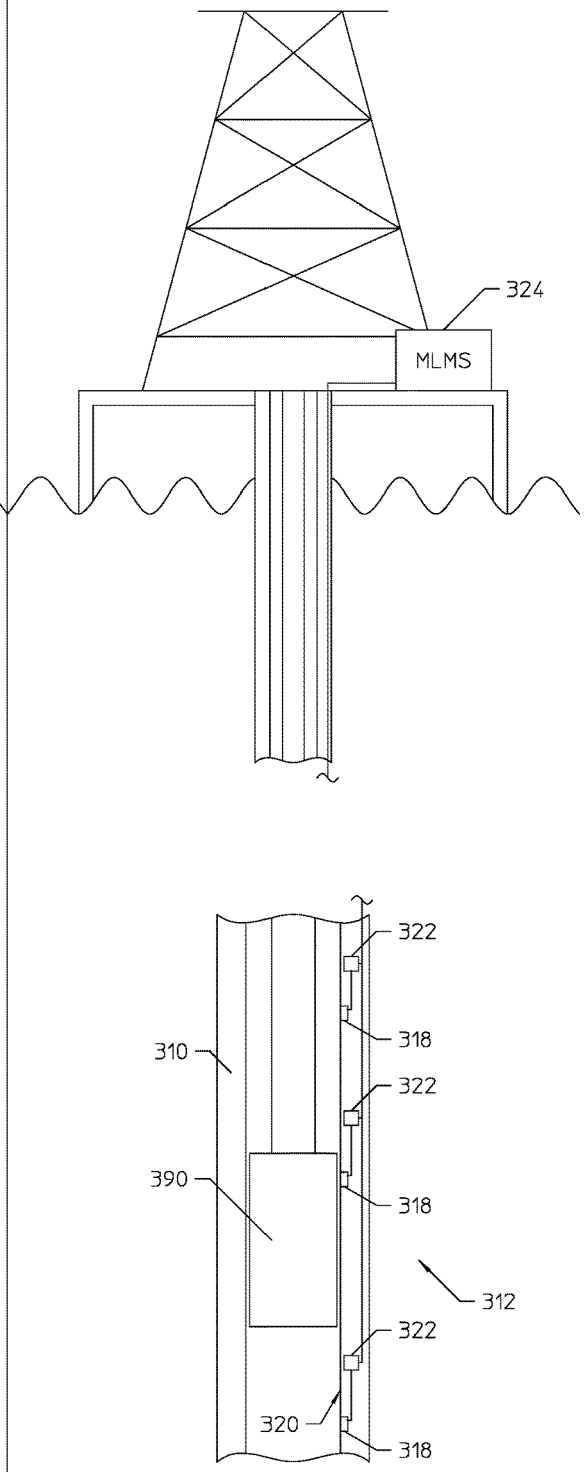
FIG. 12 shows a schematic view of a riser assembly equipped with internal monitoring sensors for detecting movement of a downhole tool through the riser assembly, in accordance with certain embodiments of the present disclosure.

As illustrated in FIG. 12, multiple internal sensors 318 disposed along the internal bore 320 of the riser assembly 310 may monitor trips of downhole tools 390 being lowered or lifted through the riser assembly 310. More specifically, the internal sensors 318 may be used to monitor the travel speed of the tool 390, flowrate of fluid around the tool 390, and the functions of the tool 390. The internal sensors 318 may provide real-time or near real-time feedback via the communication system 322 to the MLMS 324, or may record the data for later use. Using these internal sensors 318 disposed within the bore 320 of the riser assembly 310, the monitoring system 312 may monitor each function or step of downhole tools 390 that are lowered and/or lifted through the riser assembly 310.

As discussed in detail below, one or more of the illustrated internal sensors 318 may function as wireless communication interfaces configured to communicate with a corresponding wireless communication interface disposed on the internal tool 390. This allows the internal sensors 318 to receive data indicative of parameter(s) detected via one or more sensors located on the tool 390. The communication system 322 may then transmit the sensor data to a remote location.

The monitoring system 312 utilizes the communication system 322 to transmit data from tools and sensors (314 and/or 318), and any other information from the internal/external monitoring components up and down the riser assembly 310. All information from the internal and/or external sensors 314, 318 may be read into the same system (MLMS 324).

The communication system 322 may utilize any desirable transmission technique, or combination of transmission techniques. For example, the communication system 322 may include a wireless transmitter (wireless transmission), an electrical cable (wired transmission) held against a surface or built into the riser string, a fiber optic cable (optical transmission) held against a surface or built into the riser string, an acoustic transducer (acoustic transmission), and/or a near-field communication device (inductive transmission). The communication system 322 may be incorporated into a component of the riser assembly 310 and communicatively coupled (e.g., via wires) to the external and/or internal sensors associated with the riser assembly component.

Figure 13:
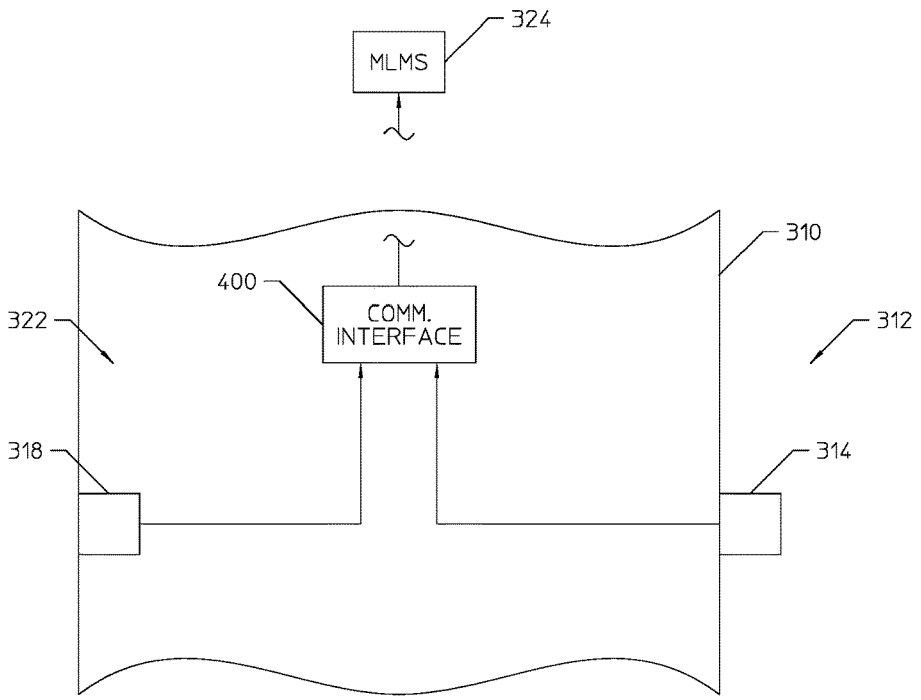
FIG. 13 shows a schematic view of a communication system that may be utilized in for external and internal monitoring of a riser assembly, in accordance with certain embodiments of the present disclosure.

FIG. 13 shows one embodiment of the communication system 322. As shown, the communication system 322 may be a simple communication interface 400 communicatively coupled to the external sensors 314 and the internal sensors 318. The communication interface 400 may transfer signals indicative of properties detected by the external sensors 314 and the internal sensors 318 to the operator monitoring system 324 as feedback regarding how the riser system is performing on a real-time or near real-time basis.

Figure 14:
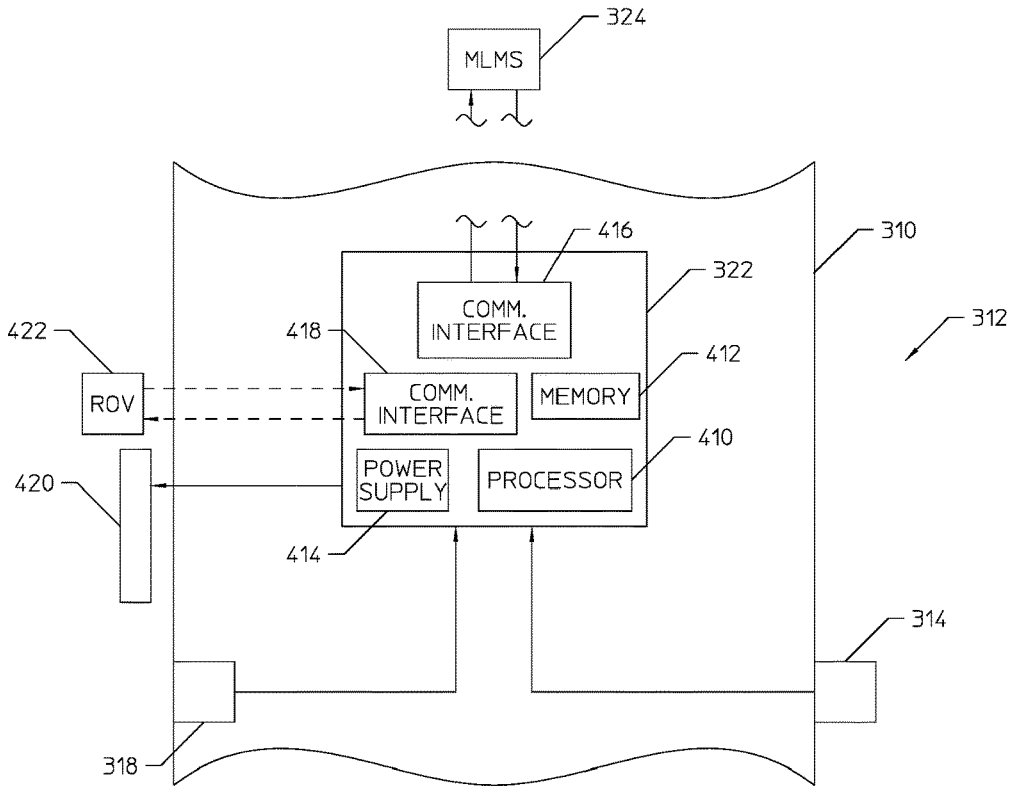
FIG. 14 shows a schematic view of a communication system that may be utilized for external and internal monitoring of a riser assembly, in accordance with certain embodiments of the present disclosure.

Other embodiments of the communication system 322 may be more complex. As shown in FIG. 14, the communication system 322 may include one or more processor components 410, one or more memory components 412, a power supply 414, and communication interfaces 416 and 418. The one or more processor components 410 may be designed to execute encoded instructions to perform various monitoring or control operations based on signals received at the communication system 322. For example, upon receiving signals indicative of sensed properties from the external or internal sensors 314, 318, the processor 410 may provide the signals to the communication interface 416 for communicating the signals to the operator monitoring system 324. The communication interface 416 may utilize wireless, wired, optical, acoustic, or inductive transmission techniques to communicate signals from the sensors 314, 318 on the riser components to the operator monitoring system 324 at the surface.

As illustrated, the communication interface 416 may be bi-directional. That way, the communication interface 416 may communicate signals from the operator monitoring system 324 to the processor 410. Upon receiving signals from the operator monitoring system 324, the processor 410 may execute instructions to output a control signal to an actuator 420. In some embodiments, the actuator 420 may be disposed on a nearby downhole tool (e.g., tool 390 of FIG. 12) positioned within the riser assembly 310. The actuator 420 may be configured to actuate a sleeve, a seal, or any other component on the downhole tool 390 disposed within the riser assembly 310. In other embodiments, the actuator 420 may be disposed within a component of the riser assembly 310 (e.g., a termination joint) to actuate a valve.

The power supply 414 may provide backup power in the event that the operator monitoring system 324 fails or loses connection with the communication system 322. The memory component 412 may provide storage for data that is sensed by the sensors 314, 318 in the event that the operator monitoring system 324 fails or loses connection. The backup memory 412 may store the sensor data, and the communication interface 418 may enable a remotely operated vehicle (ROV) 422 or other suitable interface equipment to retrieve the stored data. In some embodiments, the ROV 422 may be configured to charge the backup power supply 414 to extend the operation of the monitoring system 312. For purposes of maintaining historical operating data for the riser assembly 310, each data record stored in the memory 412 may contain a time and date of the collection of the data.

In other embodiments, the communication system 322 of FIG. 14 may not include a direct communication interface 416 with the operator monitoring system 324 at all. That is, the communication system 322 may be equipped with the memory 412, the power supply 414, and a remote communication interface 418. In such embodiments, the processor 410 may store the detected sensor data in the memory 412 while the riser component is in use. A ROV 422 or similar instrument may occasionally be used to charge the power supply 414 to maintain the communication system 322 in operation throughout the lifetime of the well. In some embodiments, the ROV 422 or similar instrument may be used primarily to obtain the sensor data from the memory 412 and provide the data to the operator monitoring system 324 at different points throughout the life of the well. In other embodiments, upon completion of a well process the riser assembly 310 may be pulled to the surface, and the communication interface 418 may be used to transfer stored sensor data directly to the operator monitoring system 324 once the riser component has been pulled to the surface.

Figure 32:
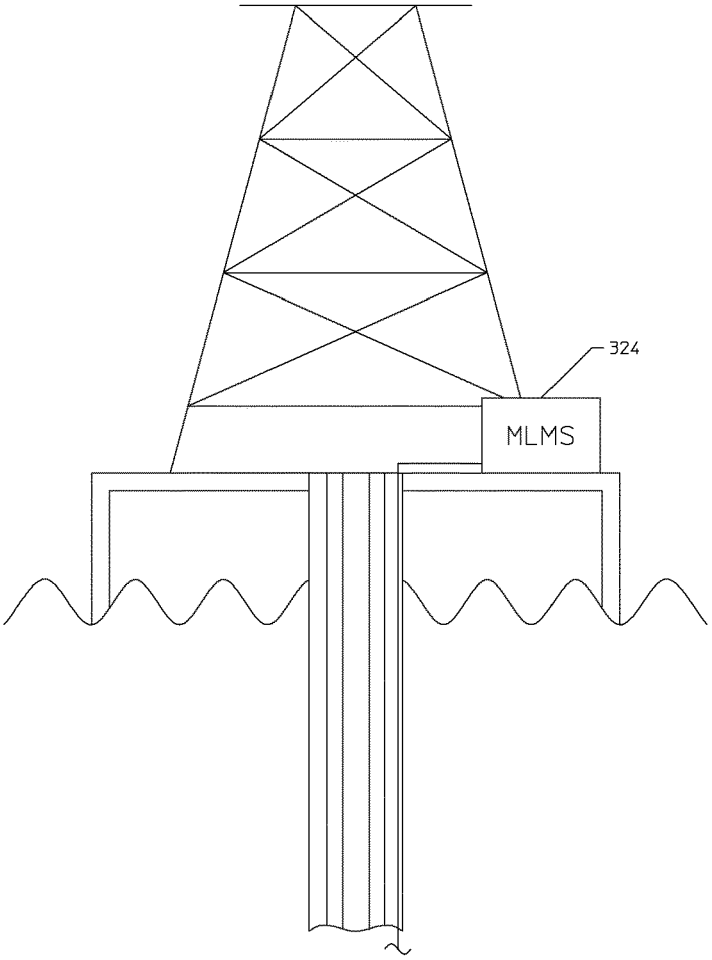
FIG. 32 shows a schematic view of a riser assembly equipped with an internal wireless communication interface for sending control signals to and/or receiving sensor signals from an internal tool located inside the riser assembly, in accordance with certain embodiments of the present disclosure.
Figure 32:
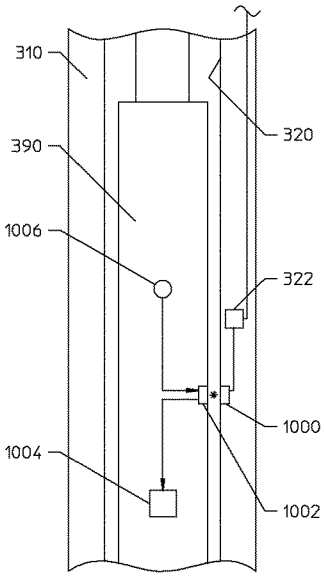

As mentioned above, the communication system 322 in the riser assembly 310 may transmit sensor signals detected from an internal tool 390 to a remote location. In addition, in some embodiments the disclosed communication system 322 may be utilized to provide power and/or control signals for actuating equipment within an internal tool 390 being moved through or positioned within the internal bore 320 of the riser assembly 310. FIG. 32 illustrates an example of a riser assembly 310 with the communication system 322 configured to provide such control and/or monitoring of an internal tool 390.

The tool 390 may include any desirable tool configured to be disposed and/or operated within the well or at the wellhead. The tool 390 may be an internal tool lowered through the internal bore 320 of the riser assembly 310 during construction and/or processing of the well. As such, the tool 390 may be a drilling tool, a completion tool, a workover tool, a wellhead assembly tool, or some other tool used to construct and/or process a subsea well. In some embodiments, the tool 390 in communication with the communication system 322 of the riser assembly 320 may include a running tool used to place and/or actuate a downhole equipment component. In other embodiments, the tool 390 may include a downhole equipment component being positioned and/or actuated either downhole or in the wellhead. The tool 390 may include one or more equipment components that are configured to be actuated in response to the tool 390 receiving a control signal from the communication system 322 of the riser assembly 310. These equipment components will be described in greater detail below.

The communication system 322 of the riser assembly 310 may be used to power and/or actuate one or more features of the tool 390. To that end, the riser assembly 310 may include a wireless communication interface 1000 disposed along the internal bore 320 of the riser assembly 310. The wireless communication interface 1000 may be of similar construction and placement as the disclosed internal sensor(s) 318. The wireless communication interface 1000 may also be communicatively coupled to the communication system 322 of the riser assembly 310 in the same manner as the disclosed internal sensor(s) 318. In some embodiments, the wireless communication interface 1000 essentially functions as one of the internal sensors 318 of the riser assembly 310 by generating and/or providing sensor signals to the communication system 322.

The tool 390 may also include a corresponding wireless communication interface 1002. The two wireless communication interfaces 1000 and 1002 may be communicatively coupled to communicate wireless signals therebetween. Communication between these wireless interfaces 1000 and 1002 may take the form of any available wireless signals including, for example, radio frequency (RF) signals, electromagnetic (EM) signal, optical signals, and other forms of wireless communication.

The wireless communication interfaces 1000 and 1002 may be inductively coupled to communicate wireless signals therebetween. The wireless signals may include, for example, control signals from the wireless communication interface 1000 of the riser assembly 310 to the interface 1002 of the tool 390. The tool 390 may include an equipment component 1004 configured to be actuated upon the communication interface 1002 of the tool 390 receiving a predetermined control signal from the interface 1000 of the riser assembly 310. As such, the communication system 322 of the riser assembly 310 may be able to power and/or actuate operation of the equipment component 1004 of the tool 390 via induction. The communication system 322 of the riser assembly 310 may similarly be able to charge the equipment component 1004 (e.g., by providing charge to a power source such as a battery in the tool 390, this battery used to power the equipment component 1004) via induction. The equipment component 1004 may include one or more of a sleeve, a port, a seal, a valve, a connector, a choke, a packer, an injection valve, or some other actuatable component.

In some embodiments, the communication interface 1002 may include a processor and memory configured to store instructions to output certain control/power signals to operate and/or charge various equipment components 1004 of the tool 390 in response to receiving a predetermined signal from the communication interface 1000 of the riser assembly 310. In some embodiments, the inductive coupling formed between the riser assembly 310 and the tool 390 may provide all power necessary for operating the communication interface 1002 on the tool 390. In other embodiments, the tool 390 may include a battery operated source for powering the communication interface 1002 and outputting the desired control signals.

In addition to powering, controlling, and/or charging one or more equipment components 1004 of the internal tool 390, the communication system 322 of the riser assembly 310 may be configured to take readings from one or more sensors 1006 disposed on the tool 390. In some embodiments, the communication system 322 may passively read sensor signals from the tool 390 via the inductive coupling of the communication interfaces 1000 and 1002. In other embodiments, the communication system 322 may actively read sensor signals from the tool 390 by outputting a power or control signal to the sensor 1006 via the inductive coupling of the communication interfaces 1000 and 1002 to take the sensor reading.

In some embodiments, the sensor 1006 may be continuously taking readings at regular intervals and sending data indicative of the sensor readings to the communication interface 1002 of the tool 390. In this case, the communication interface 1002 may include a processor and memory configured to store the sensor readings therein and to communicate the sensor readings to the communication system 322 of the riser only upon establishment of the inductive coupling and/or receiving a request from the communication system 322 through the inductive coupling. As mentioned above, in some embodiments the inductive coupling formed between the riser assembly 310 and the tool 390 may provide all power necessary for operating the communication interface 1002 on the tool 390. In other embodiments, the tool 390 may include a battery operated source for powering the communication interface 1002 to communicate sensor signals to the communication interface 1000 of the riser assembly 310.

As discussed herein, the communication system 322 of the riser assembly 310 may be communicatively coupled to the monitoring system (MLMS) 324. In some embodiments, the MLMS 324 may send one or more command/control signals which are communicated through the communication system 322, the communication interface 1000 of the riser assembly 310, and the interface 1002 of the tool 390 for controlling operations of one or more equipment components 1004 on the tool 390. In this manner, the MLMS 324 may remotely actuate one or more components 1004 on a tool 390 located inside the riser assembly 310 using the disclosed communication system 322. As discussed further below, control signals may also be communicated through the communication system 322 via a separate ROV to actuate components 1004 of the tool 390.

In addition, the MLMS 324 may monitor and record data indicative of parameters detected by one or more sensors 1006 on the tool 390. To that end, the MLMS 324 may monitor and record information regarding sensors, actuation devices, motors, solenoids, valves, and other components located on the tool 390. As such, all steps, readings from sensors, and tool actuations, among other things, may be monitored and controlled by the MLMS 324 through the communication system 322 and wireless communication interfaces 1000 and 1002. In some embodiments, the MLMS 324 may monitor and record data detected via the one or more sensors 1006 of the tool 390, determine based on the monitored sensor levels that an equipment component 1004 of the tool 390 should be actuated, and send a control signal to the tool 390 via the communication system 322 to initiate the desired tool actuation.

Figure 33:
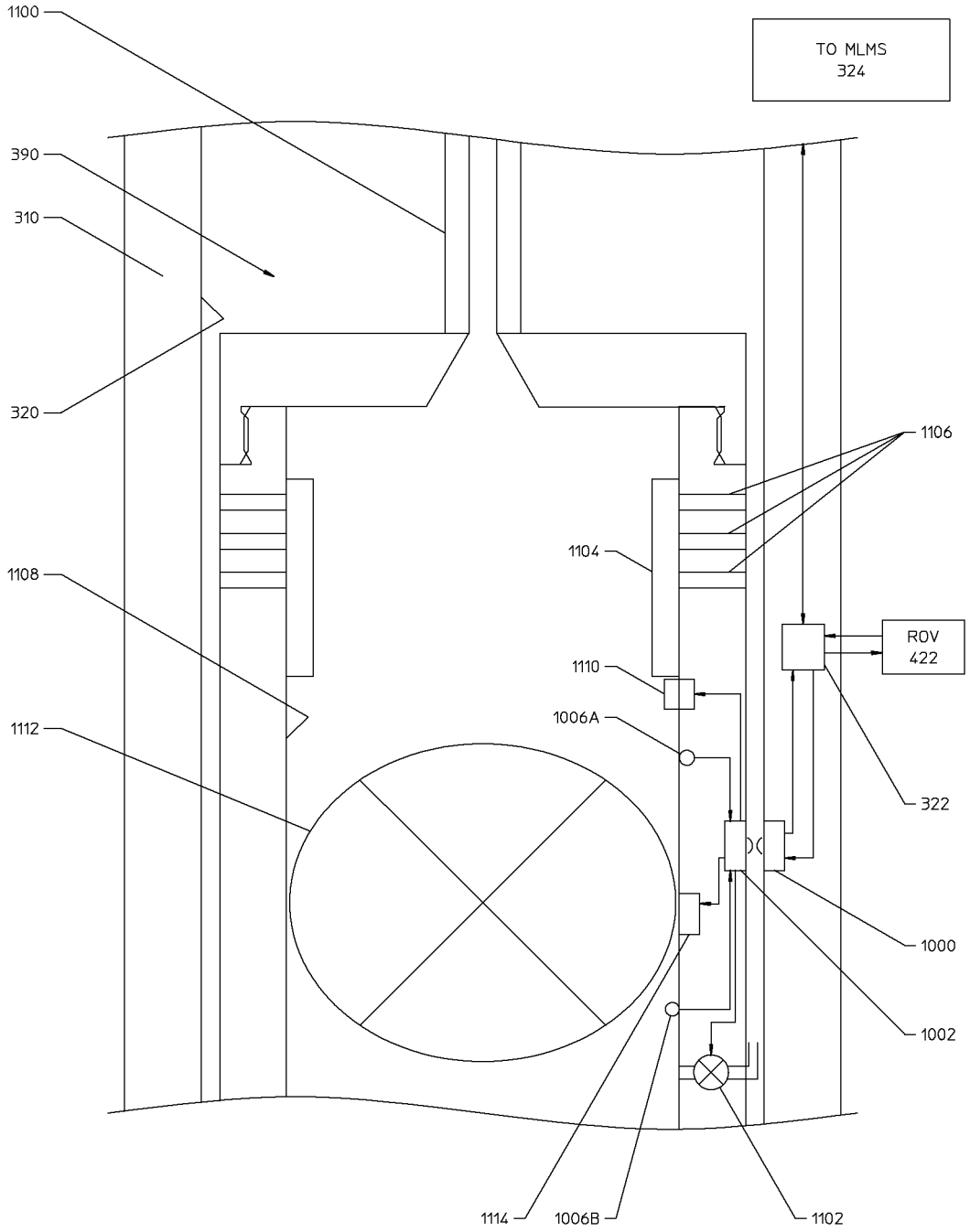
FIG. 33 shows a schematic cross-sectional view of an internal tool that may be used with the internal wireless communication interface in the riser assembly of FIG. 32, in accordance with certain embodiments of the present disclosure.

FIG. 33 illustrates a more detailed example embodiment of a tool 390 that may be controlled and/or monitored via the communication system 322 of the riser assembly 310. The tool 390 as illustrated includes a number of different types of equipment components (1004 of FIG. 32). However, it should be noted that a different number, type, or arrangement of equipment components may be utilized in other embodiments of the disclosed tool 390. In the illustrated embodiment, the tool 390 is run in on a tubular 1100. However, in other embodiments, the tool 390 may be run in on a wireline, slickline, coiled tubing, drillpipe, casing string, or a separate running tool. In some embodiments, the tool 390 itself may be a running tool used to place a separate piece of equipment within the well or wellhead.

In some embodiments, the tool 390 may be a piece of equipment secured within the well or wellhead, or being lowered into a position to be secured within the well or wellhead. For example, the tool 390 may include a tubing hanger, spool, or other wellhead equipment component designed to be run in, secured to, and left within a subsea wellhead. The sensors and/or equipment to be actuated within the tool 390 may, in such instances, communicate with the MLMS via the communication system 322 of the riser assembly 310 (e.g., from a BOP connector or tree connector of the riser assembly 310) once the tool 390 is set in the subsea wellhead. Before the tool 390 is set in the subsea wellhead, the sensors and/or equipment to be actuated within the tool 390 may communicate with the MLMS through a communication system within the running tool used to place the tool 390 in the wellhead. The tool 390, upon being left in the wellhead, may continue to monitor well parameters (e.g., pressure, temperature, etc.), loads on the tool 390, and other parameters via sensors. The MLMS may send control signals to the tool 390 (via a running tool communication system, riser communication system, and/or ROV) to actuate valves or sleeves, close ports, and perform other functions within the wellhead assembly. Live or stored sensor values may be reviewed in the MLMS after the tool 390 is left in the wellhead.

As discussed below, the tool 390 may be equipped with actuators for operating the different types of equipment. Such actuators may include, for example, electrically operated solenoids and electric motors, among other things. The actuators convert an electrical control signal received from the communication interface 1002 into a mechanical actuation that operates a corresponding equipment component on the tool 390.

In some embodiments, the equipment component (1004 of FIG. 32) on the tool 390 may include one or more injection valves 1102 configured to allow inhibitors or other chemicals to be injected into the well from the rig or an ROV 422. The injection valves 1102 may be remotely actuated via the communication system 322 communicating a control signal through the wireless communication interfaces 1000 and 1002. The control signal output from the communication interface 1002 to the injection valve 1102 may actuate the injection valve 1102 between an open position that allows chemical injection and a closed position that prevents injection.

In some embodiments, the equipment component on the tool 390 may include one or more sleeves 1104 or seals configured to be actuated in a longitudinal sliding motion with respect to another portion of the tool 390. As illustrated, for example, the sleeve 1104 may be used to selectively cover or uncover an adjacent portion of the tool 390 (such as a series of ports 1106 that allow fluid communication into an internal bore 1108 of the tool 390). Sleeves 1104 may similarly be used to cover or uncover other tool components, or to actuate other components of the tool 390. The tool 390 may also include a sleeve actuator in the form of a solenoid 1110, which can be selectively extended or retracted to actuate the sleeve 1104. The sleeve 1104 may be remotely actuated via the communication system 322 communicating a control signal through the wireless communication interfaces 1000 and 1002. The control signal output from the communication interface 1002 to the solenoid 1110 may extend or retract the solenoid 1110, thereby allowing the sleeve 1104 to move longitudinally. Solenoids 1110 may similarly be used to energize or release a seal on the tool 390.

In some embodiments, the equipment component on the tool 390 may include one or more valves 1112, sleeves, connectors, and/or actuators configured to be operated via an electric motor 1114. As illustrated, for example, the tool 390 may include a valve 1112 disposed within the internal bore 1108 of the tool 390 and configured to be selectively opened/closed to allow or prevent fluid flow through the bore 1108. As illustrated, the internal bore 1108 may be a main production flowbore of the tool 390. In other embodiments, the internal bore 1108 may be an annulus flowbore of the tool 390 or some other flowbore formed within the tool 390. The tool 390 may include a valve actuator in the form of the electric motor 1114, which can be rotated to actuate the valve 1112. The valve 1112 may be remotely actuated via the communication system 322 communicating a control signal through the wireless communication interfaces 1000 and 1002. The control signal output from the communication interface 1002 to the motor 1114 may rotate the motor 1114, thereby causing the valve 1112 to open or close. Electric motors 1114 may similarly be used to connect components of the tool 390 and/or to move or turn sleeves 1004, connectors, or other actuators of the tool 390.

In addition to communicating control signals to actuate components of the tool 390, the communication interface 1002 may also receive and communicate sensor signals to the MLMS 324 and/or an ROV 422. These sensor signals may be indicative of parameters detected by one or more sensors 1006 located within or about the tool 390. For example, FIG. 33 shows the tool 390 having two sensors 1006A and 1006B located therein. In some embodiments, one or more sensors 1006 on the tool 390 may be configured to detect a downhole parameter such as a pressure, flow rate, temperature, or fluid composition, among others. These measurements may help to monitor environmental conditions within or around the tool 390. For example, sensor 1006A of FIG. 33 may be a pressure transducer configured to track the downhole pressure as the tool 390 is moved through the riser assembly 310 and/or to a position below the wellhead.

In some embodiments, one or more sensors 1006 on the tool 390 may be configured to detect a parameter indicative of an operation being performed within the tool 390 via actuation of at least one equipment component (1004 of FIG. 32). Such sensors 1006 may include pressure transducers, visual detectors, and motion detectors such as accelerometers or gyroscopes, among others. For example, sensor 1006B of FIG. 33 may be a pressure transducer located below the valve 1112 and used to detect a change in pressure of the internal bore 1108 encountered upon actuation of the valve 1112.

In some embodiments, one or more sensors 1006 on the tool 390 may be configured to detect a parameter indicative of a location, orientation, or proximity of the tool 390 within the well, or contact of the tool 390 landing on other equipment in the well or wellhead, to ensure that the tool 390 is working properly and properly positioned within the well. In addition, one or more sensors 1006 on the tool 390 may be configured to detect a tension, compression, strain, torsion, or other measurements of forces acting on the tool 390. This information may be analyzed and monitored to ensure that the tool 390 is not overstressed, or that appropriate service has been scheduled and provided to the tool 390 based on a monitored load history of the tool 390.

In some embodiments, the communication system 322 of the riser assembly 310, along with the wireless communication interfaces 1000 and 1002, may be used to communicate power and/or control for operating various components of the tool 390 from the MLMS 324 at the surface of the riser assembly 310. The communication system 322 (and wireless communication interfaces 1000 and 1002) may also communicate sensor signals to the MLMS 324 (in real-time or near real-time) for monitoring the environment and/or operations of the tool 390.

In addition to, or in lieu of, communicating signals between the MLMS 324 and the tool 390, the communication system 322 along with the wireless communication interfaces 1000 and 1002 may be used to communicate power/control for operating components of the tool 390 from an ROV 422 coupled to the riser assembly 310. The communication system 322 (and wireless communication interfaces 1000 and 1002) may also communicate sensor signals to the ROV 422 for storage and later communication to the MLMS 324 for monitoring the environment and/or operations of the tool 390.

As such, the disclosed communication system 322 along with the communication interfaces 1000 and 1002 may facilitate remote control, actuation, and reading of environmental/operational parameters associated with a tool 390 being moved through the riser assembly 310. As discussed above, the tool 390 may be a running tool used to install well equipment, or the tool 390 may itself include well equipment that is being installed downhole.

Turning back to FIG. 11, the external sensors 314, internal sensors 318, and communication systems 322 may be disposed on any of the components of the riser assembly 310. More detailed descriptions of the sensor arrangements and monitoring capabilities for the components of the riser assembly 310 will now be provided.

Figure 15:
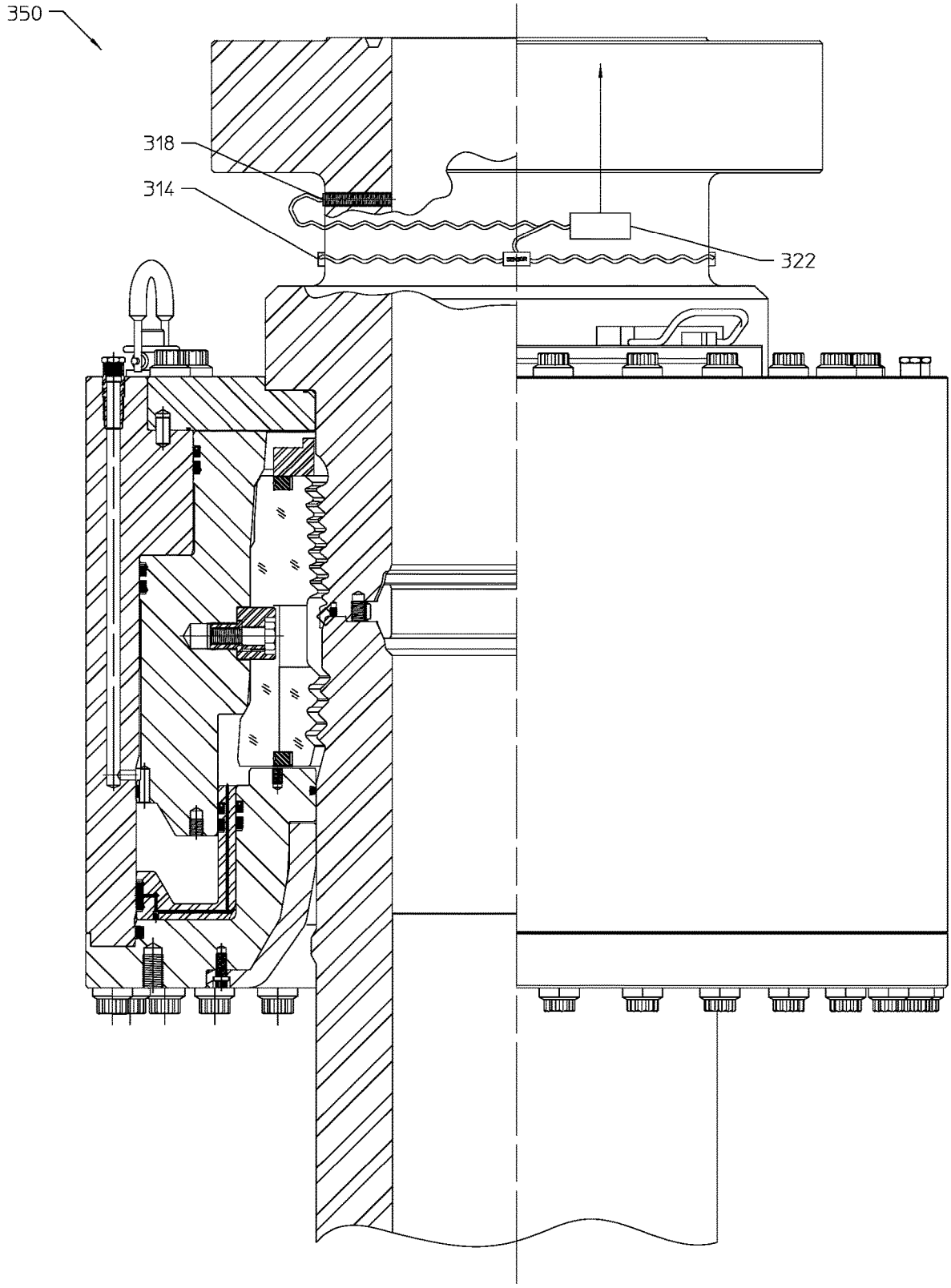
FIGS. 15-22 show schematic views of various riser assembly components equipped with an external and internal monitoring system, in accordance with certain embodiments of the present disclosure.

FIG. 15 illustrates an embodiment of the BOP connector (or wellhead connector) 350 used to connect the riser assembly 310 and the BOP 349 to the subsea wellhead 370. The BOP connector 350 may include one or more sensors 314, 318 and the communication system 322, as described above. The sensors 314, 318 may detect pressure, temperature, a locking/unlocking state of the connector, stresses (e.g., tension, compression, torsion, bending), and others properties associated with the BOP connector 350. The communication system 322 may be wired, wireless, or acoustic. As described above with reference to FIG. 14, the BOP connector 350 may further include a backup memory component (e.g., 412) to record the sensor data, so that the sensor data may be retrieved from the memory via a ROV or another communication interface.

In some embodiments, the BOP connector 350 may be able to detect and communicate signals indicative of the function of the BOP connector 350, as well as information regarding internal tools in the wellhead 370. The internal sensors 318 disposed in the BOP connector 350 may allow for the detection of internal running tools or test tools that are positioned below the BOP 349 when the rams of the BOP 349 are closed. The BOP connector 350 is in closer proximity to the wellhead 370 (and internal components being moved through the BOP 349 and the wellhead 370) than the lowest riser joint in the riser assembly 310. Therefore, it may be desirable to include the sensors 314, 318 and communication system 322 in the BOP connector 350.

Internal sensors 318 in the BOP connector 350 and/or elsewhere within the riser assembly 310 may be used to detect and monitor the landing and operation of internal tools and components being lowered through the internal bore of the riser assembly 310. In some instances, the drillpipe and an associated drillpipe communication/sensor sub being lowered through the riser assembly 310 may be equipped with one or more sensors designed to interface with the internal sensors 318 of the riser assembly 310 (e.g., BOP connector 350). The sensor(s) of the drillpipe and/or instrumentation sub may include an antenna designed to communicate with a corresponding internal sensor 318 within the riser assembly 310. The sensor(s) on the drillpipe and/or instrumentation sub may communicate with the internal sensor 318 via induction and may also be powered by induction. By using internal sensors 318 in the BOP connector 350 or nearby in the riser assembly 310, the system may enable reading of a more exact position of the drillpipe and hanger being lowered therethrough than would be possible using acoustic signals sent down the drillpipe. This allows the system to provide better control of the drillpipe for landing/hanging the drillpipe within the wellhead.

Internal sensors 318 in the BOP connector 350 and/or elsewhere within the riser assembly 310 may be used to enable communication between internal equipment being run through the riser assembly 310 at a position below the BOP/wellhead and the surface equipment. The equipment (e.g., drillpipe, running tools, etc.) being run through the riser assembly 310 to positions below the BOP and wellhead may be fitted with various sensors and instrumentation to collect readings associated with the subterranean formation. Such sensors would typically communicate with the surface via acoustic communication, but this type of communication is limited with respect to how much information can be conveyed at a time. The equipment being run through the subterranean wellbore may be fitted with instrumentation subs disposed at one or more positions along the length of the equipment string. Such instrumentation subs may be communicatively coupled to the one or more sensors located on the equipment string, for example via wireless transmission, an electrical cable held against a surface or built into the equipment string, a fiber optic cable held against a surface or built into the equipment string, an acoustic transducer, and/or a near-field communication device. The instrumentation subs may be designed to communicate sensor signals received from the sensors on the internal equipment strings to an internal sensor 318 within the BOP connector 350 or other portion of the riser assembly 310. The instrumentation sub on the equipment string may communicate the sensor signals to the internal sensor 318 on the riser assembly 310 via induction. The instrumentation subs may be spaced out along the length of the equipment string such that one of the instrumentation subs is in inductive communication with the riser internal sensor 318 at all times as the equipment string is lowered through and then secured within the subsea wellhead.

The LMRP 351 may also feature external sensors 314 and/or internal sensors 318 for monitoring various riser properties, as well as the communication system 322 for communicating signals indicative of the sensed properties to the operator monitoring system 324. In some embodiments, the lower BOP stack 249 may also include such sensors 314/318 and a communication system 322.

Figure 16:
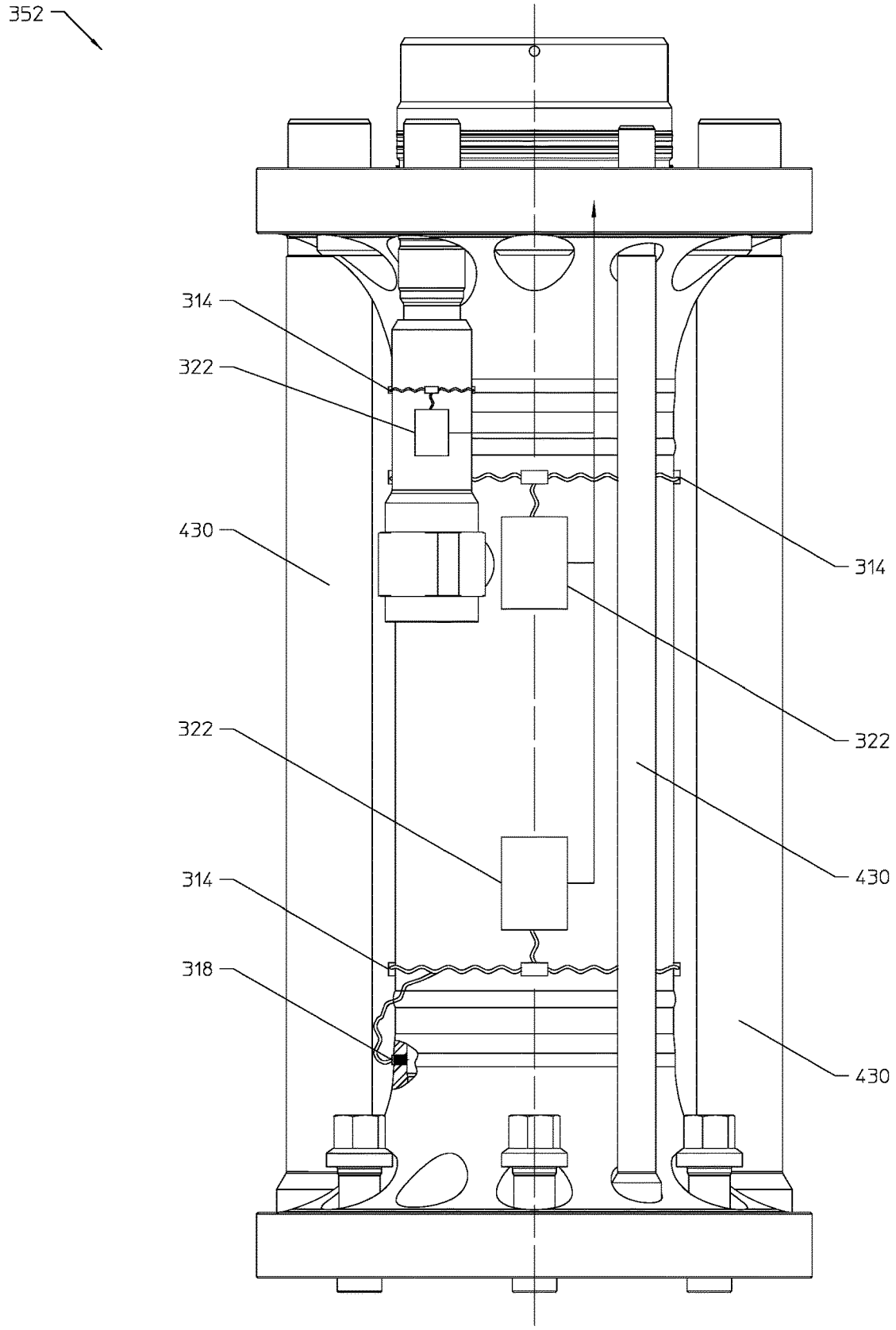

The riser extension joint 353 may include both the LMRP 351 and the boost line termination joint 352, as described above. The riser extension joint 353 generally is disposed at the top of the BOP to connect the string of riser joints to the BOP. FIG. 16 illustrates the boost line termination joint 352 of the riser assembly 310 that may be disposed at the top of the LMRP 351. The riser extension joint 353 is generally where auxiliary lines 430 terminate at a lower end of the riser assembly 310, and the terminating auxiliary lines 430 are connected to the BOP. As shown, sensors 314, 318 may be disposed on the boost line termination joint 352 to read, for example, pressures, temperatures, flow rates, stresses, and others properties associated with the boost line termination joint 352. The communication system 322, which may use wired, wireless, or acoustic transmission, may be disposed on the boost line termination joint 352 as well, to provide signals from the sensors 314, 318 to the operator monitoring system 324. In addition, the boost line termination joint 352 may include a backup memory component (e.g., 412) to record the sensor data, so that the sensor data may be retrieved from the memory via a ROV or another communication interface.

Figure 17:
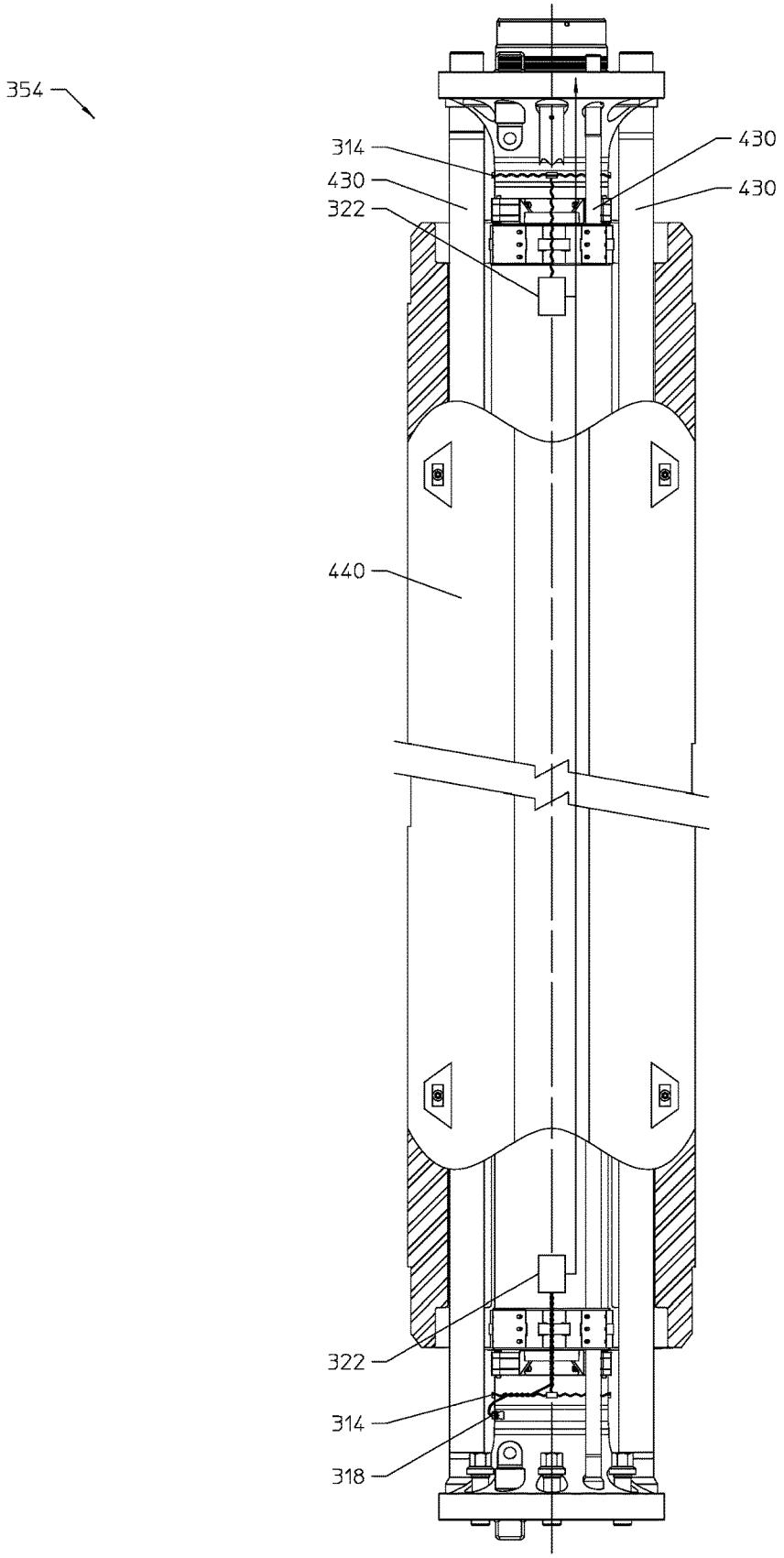

FIG. 17 illustrates a buoyant riser joint 354. The riser assembly 310 may include one or more buoyant riser joints 354 (e.g., syntactic foam buoyancy modules), which are riser joints that have a flotation device 440 attached thereto. The buoyant riser joints 354 provide weight reduction to the riser assembly 310 as desired. The buoyant riser joints 354 may be equipped with their own set of sensors 314, 318 that may read pressures, temperatures, flow rates, stresses, and others properties associated with the buoyant riser joint 354. Internal sensors 318 disposed along the bore of the buoyant riser joints 354 may be able to read flow rates and communicate with internal tools being run through the riser assembly 310.

The auto-fill valve 355 described above with reference to FIG. 11 may be utilized in certain embodiments of the riser assembly 310 to keep the riser from collapsing in the event of a sudden evacuation of the mud column therethrough. In such embodiments, the auto-fill valve 355 may include various external and/or internal sensors 314/318 for detecting various operating parameters of the auto-fill valve 355. These sensors 314/318 may interface with a communication system 322, as described above, to provide the detected operational information to the operator monitoring system 324. Other embodiments of the riser assembly 310 may not include the auto-fill valve 355.

Figure 18:
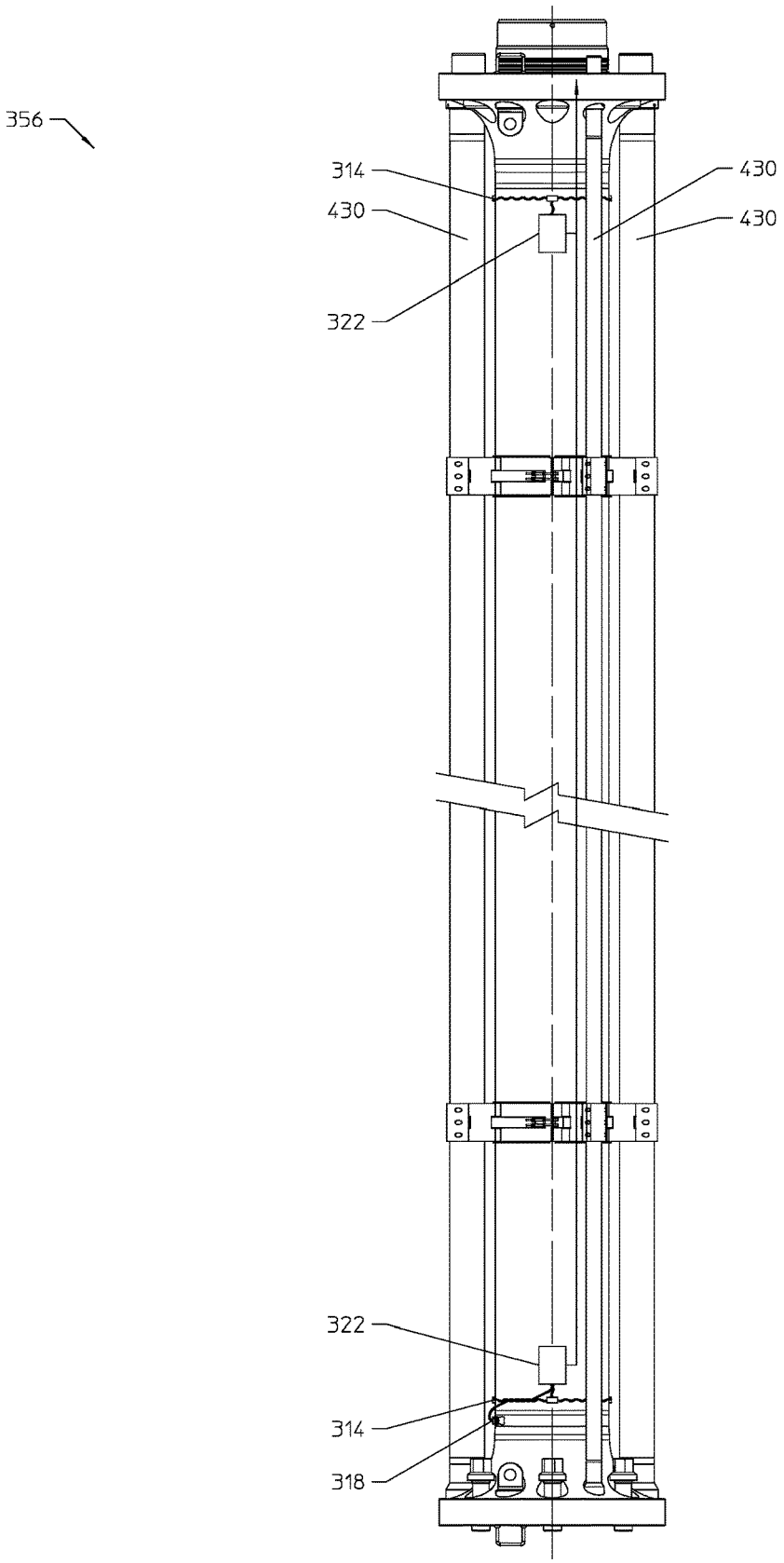

FIG. 18 illustrates a bare riser joint 356 in accordance with present embodiments. The riser assembly 310 may include one or more of these bare riser joints 356 in addition to or in lieu of the buoyant riser joints 354. Bare riser joints 356 are similar to the buoyant joints 354, but do not have flotation devices. The bare riser joints 356 may be equipped with their own set of sensors 314, 318 that may read pressures, temperatures, flow rates, stresses, and others properties associated with the bare riser joint 356. Internal sensors 318 disposed along the bore of the bare riser joints 356 may be able to read flow rates and communicate with internal tools being run through the riser assembly 310.

The riser joints (354 and 356) may be connected end to end to one another via riser joint connectors (e.g., 104 of FIG. 5), as described above. In some embodiments, the riser joint connectors 104 may be equipped with sensors 314, 318 and the associated communication system 322 to measure various properties associated with the riser joint connector 104. The sensors 314, 318 may detect, for example, pressures, temperatures, stresses, an unlocked/locked status, and other properties of the riser joint connector 104.

Figure 19:
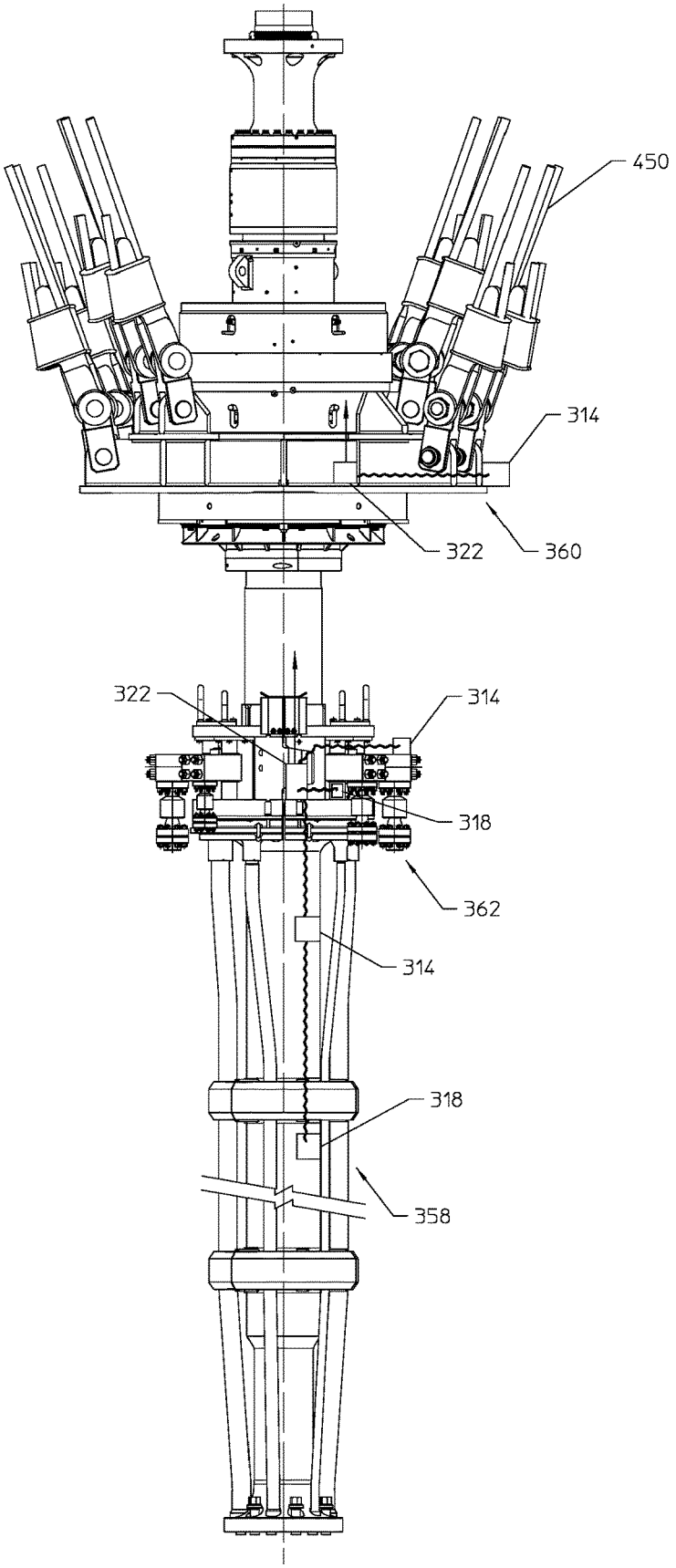

FIG. 19 illustrates the telescopic joint 358, which connects the riser string to the rig platform and to the diverter assembly 364. The telescopic joint 358 may include features that enable termination of the auxiliary lines (e.g., via termination ring 362) at the upper end (surface) of the riser assembly 310. The telescopic joint 358 may include the tension ring 360, and a rig tensioner 450 attached to the tension ring 360 provides tension to the riser string through this connection. The telescopic joint 358 is designed to telescope (i.e., expand and contract) to compensate for the movement of the rig platform, while the tension ring 360 maintains a desired tension on the riser string.

The telescopic joint 358 may include a number of sensors 314, 318 reading various aspects of the telescopic joint 358, such as length of stroke of the telescoping features, torsion, pressure, and other loads. The tension ring 360 disposed on the telescopic joint 358 may include sensors 314 (e.g., force sensors) to measure the amount of force each of the rig tensioners applies to the riser assembly 310. The termination ring 362 may also include sensors 314, 318 for measuring loads, pressures, and flow rates on the termination ring 362 itself and/or through the auxiliary lines. The sensors 314, 318 disposed throughout the telescopic joint 358, tension ring 360, and termination ring 362 may utilize one or multiple communication systems 322 to provide signals indicative of the sensed properties to the operator monitoring system 324.

Figure 20:
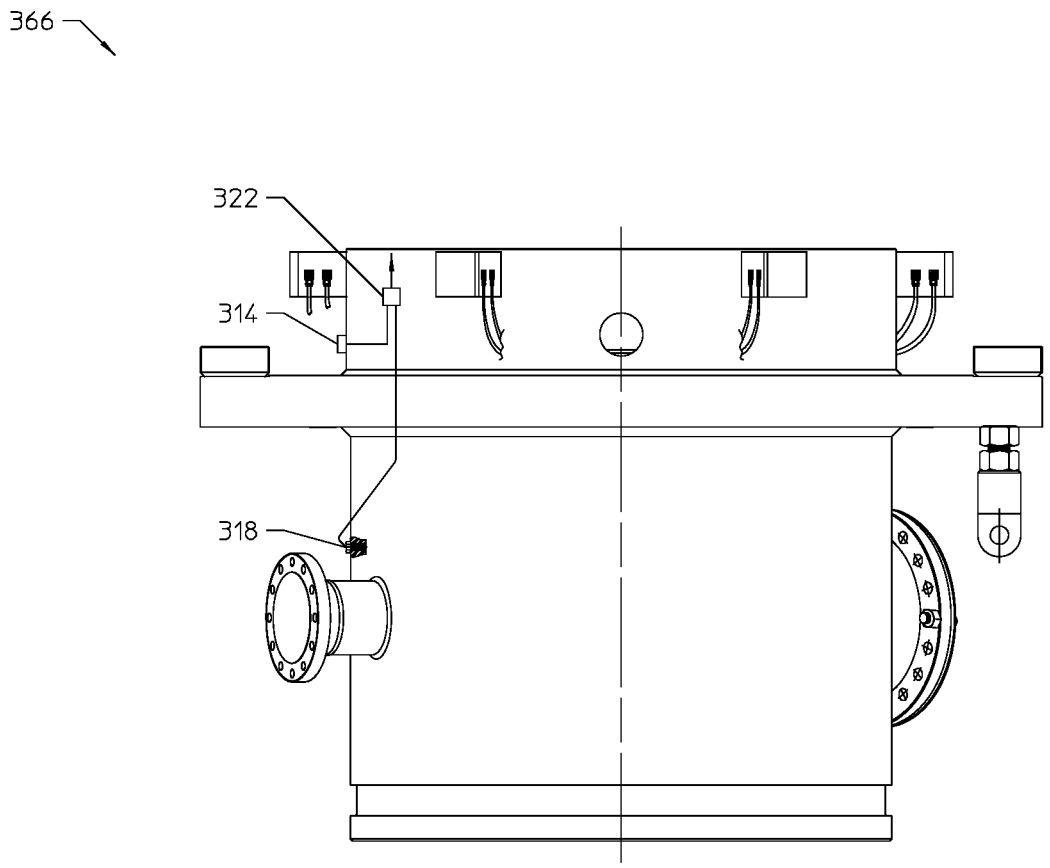
Figure 21:
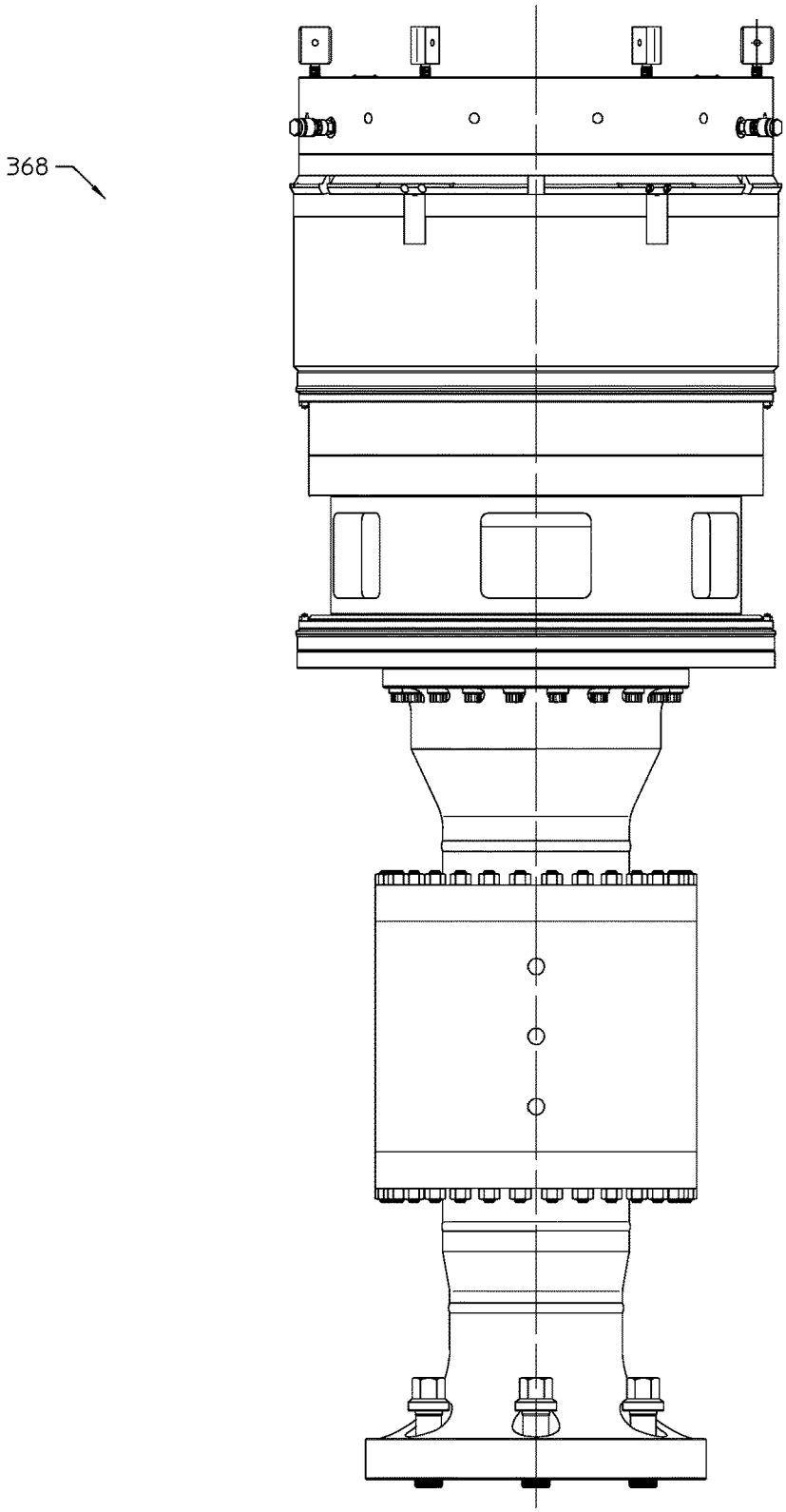

FIGS. 20 and 21 illustrate components of a diverter assembly 364 that resides below the floor of the rig platform. The diverter assembly 364 may include the diverter housing 366 (FIG. 20), as well as the diverter flex joint 368 (FIG. 21). The diverter flex joint 368 may be held at least partially within the housing 366. Most of the riser joints and other portions of the riser string run through the diverter assembly 364, and the telescopic joint 358 is connected to the diverter assembly 364 to complete the riser string. The diverter assembly 364 may be used during the drilling operations to divert fluid from an internal riser string via a flow line on the diverter assembly 364. Sensors 314/318 may be disposed within the flex joint 368 of the diverter assembly 364, as shown, to measure pressures, read valve positions, and detect various other operational properties of the diverter assembly 364. Sensors 314/318 may also be disposed within the housing 366, for example, to read an open/closed status of a packer element in the diverter assembly 364. The associated communication systems 322 may then transmit the information from the diverter assembly 364 back to the operator monitoring system 324.

Figure 22:
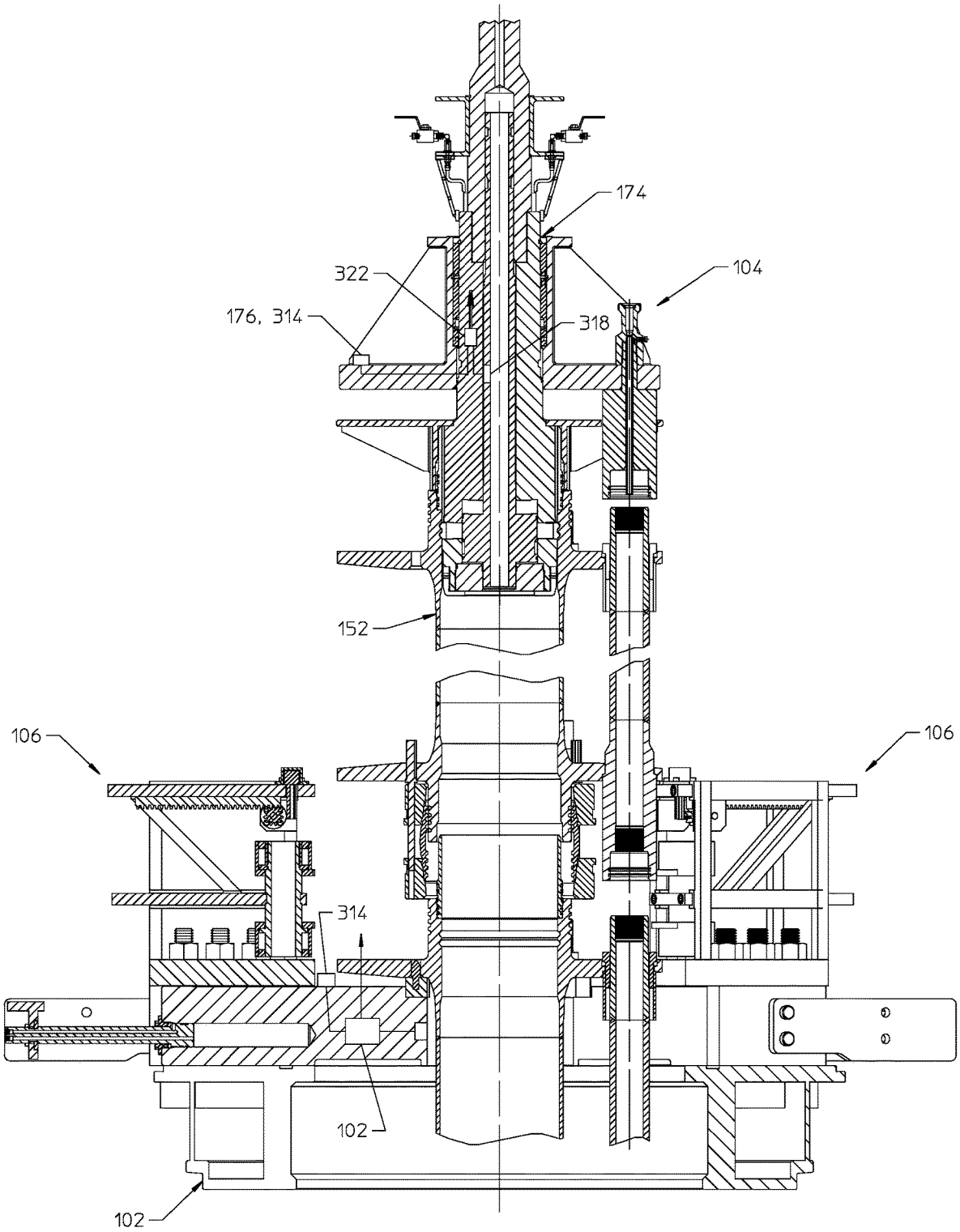

FIG. 22 illustrates the running/testing tool 174 (also referred to as a riser handling tool), which may include one or more sensors 314, 318 to measure the weight, pressure, temperature, loads, flow rates, orientation, and/or actuation of the riser handling tool 174. The riser handling tool 174 may be able to read and identify riser joints 354 (or 356) being run in to form the riser assembly 310. The riser handling tool 174 may also utilize the internal sensors 318 to ensure that the auxiliary lines (e.g., choke and kill lines) of the riser joints and fully assembled riser string are properly sealed. The riser handling tool 174 may include a communication system 322 to communicate information from the sensors 314, 318 to the operator monitoring system 324, as well as to communicatively interface with the hands free spider assembly 102.

FIG. 22 also illustrates the spider assembly 102, which allows for landing, orienting, locking, unlocking, and monitoring of the riser joints (354 and 356) as they are run into or retrieved from the riser assembly 310. The spider assembly 102 may communicate with the handling tool 174 to automate the riser running/retrieval so that the human interface is eliminated between these tools. The spider assembly 102 may include sensors 314, 318 disposed throughout to measure riser joint orientation and/or proximity, operational status of the spider assembly 102, and various other properties needed to effectively run and retrieve the riser joints. The spider assembly 102 may utilize the communication system 322 to communicate sensed properties directly to the operator monitoring system 324 and to communicate directly with the handling tool 174.

The sensors 314, 318 disposed throughout the riser assembly 310 may include, but are not limited to, a combination of the following types of sensors: pressure sensors, temperature sensors, strain gauges, load cells, flow meters, corrosion detection devices, weight measurement sensors, and fiber optic cables. The riser assembly 310 may include other types of sensors 314, 318 as well.

For example, the riser assembly 310 may include one or more RFID readers that are configured to sense and identify various equipment assets (e.g., new riser joints, downhole tools) being moved through the riser assembly 310. The equipment assets may each be equipped with an RFID tag that, when activated by the RFID readers, transmits a unique identification number for identifying the equipment asset. Upon reading the identification number associated with a certain equipment asset, the RFID readers may provide signals indicating the identity of the asset to the communication system 322, and consequently to the operator monitoring system 324.

The identification number may be stored in a database of the operator monitoring system 324, thereby allowing the equipment asset to be tracked via database operations. Additional sensor measurements relating to the equipment asset may be taken by sensors 314, 318 throughout the riser assembly 310, communicated to the operator monitoring system 324, and stored in the database with the associated asset identification number. The database may provide a historical record of the use of each equipment asset by storing the sensor measurements for each asset with the corresponding identification number.

In some embodiments, one or more of the sensors 314, 318 on the riser assembly 310 may include a fiber optic cable. The fiber optic cable may sense (and communicate) one or more measured properties of the riser assembly 310. Sensors designed to measure several different parameters (e.g., temperature, pressure, strain, vibration) may be integrated into a single fiber optic cable. The fiber optic cable may be particularly useful in riser measurement operations due to its inherent immunity to electrical noise.

The sensors 314, 318 disposed throughout the riser assembly 310 may include proximity sensors, also known as inductive sensors. Inductive sensors detect the presence or absence of a metal target, based on whether the target is within a range of the sensor. Such inductive sensors may be utilized for riser alignment and rotation during makeup of the riser string, so that the riser joints are connected end to end with their auxiliary lines in alignment.

The sensors 314, 318 disposed throughout the riser assembly 310 may include linear displacement sensors designed to detect a displacement of a component relative to the sensor. The linear displacement sensors may be disposed on the riser handling tool, for example, to detect a location of a sleeve or other riser component that actuates a sealing cap into place when connecting the riser joints together. Data collected from such linear displacement sensors may indicate how much the sleeve or other component moves linearly to set the seal (or to set a lock).

Figure 23:
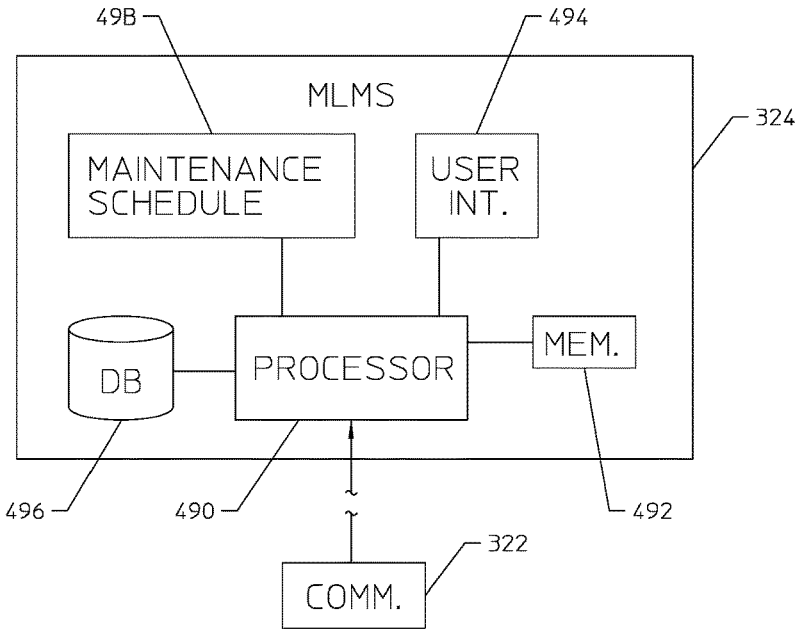
FIG. 23 shows a schematic view of an operator monitoring system, in accordance with certain embodiments of the present disclosure.

The operator monitoring system 324 may utilize various software capabilities to evaluate the received sensor signals to determine an operating status of the riser assembly 310. FIG. 23 schematically illustrates the operator monitoring system 324 (or MLMS). The operator monitoring system 324 generally includes one or more processor components 490, one or more memory components 492, a user interface 494, a database 496, and a maintenance scheduling component 498. The one or more processor components 410 may be designed to execute instructions encoded into the one or more memory components 492 to perform various monitoring or control operations based on signals received at the operator monitoring system 324. The operator monitoring system 324 may generally receive these signals from the communication system 322, or a ROV or other communication interface retrieved to the surface.

Upon receiving signals indicative of sensed properties, the processor 490 may interpret the data, display the data on the user interface 494, and/or provide a status based on the data at the user interface 494. The operator monitoring system 324 may store the measured sensor data with an associated identifier (serial number) in the database 496 to maintain historical records of the riser equipment. The operator monitoring system 324 may track a usage of various equipment assets via the historical records and develop a maintenance schedule for the riser assembly 310.

The MLMS software of the operator monitoring system 324 may manage the riser assembly 310 based on customer inputs and regulatory requirements. The system 324 may keep track of the usage of each piece (e.g., riser joint) of the riser assembly 310, and evaluate the usage data to determine how the customer might reduce costs on the maintenance and recertification of riser joints. This evaluation by the operator monitoring system 324 may enable an operator to manage the joint stresses/usage to provide the optimum use of available riser joints. In some embodiments, the operator monitoring system 324 may read (e.g., via RFID sensors) available riser joints to run while forming the riser assembly 310. The operator monitoring system 324 may build a running sequence for the riser joints to assemble a riser stack based on the remaining lifecycle of the riser assembly 310, placement within the riser string, and subsea environmental conditions.

As described above, the riser assembly 310 may include a handling tool for positioning riser components (e.g., joints)

within the assembly, and the handling tool may include sensors and a communication system for communicating sensor signals to the operator monitoring system 324.

Figure 24:
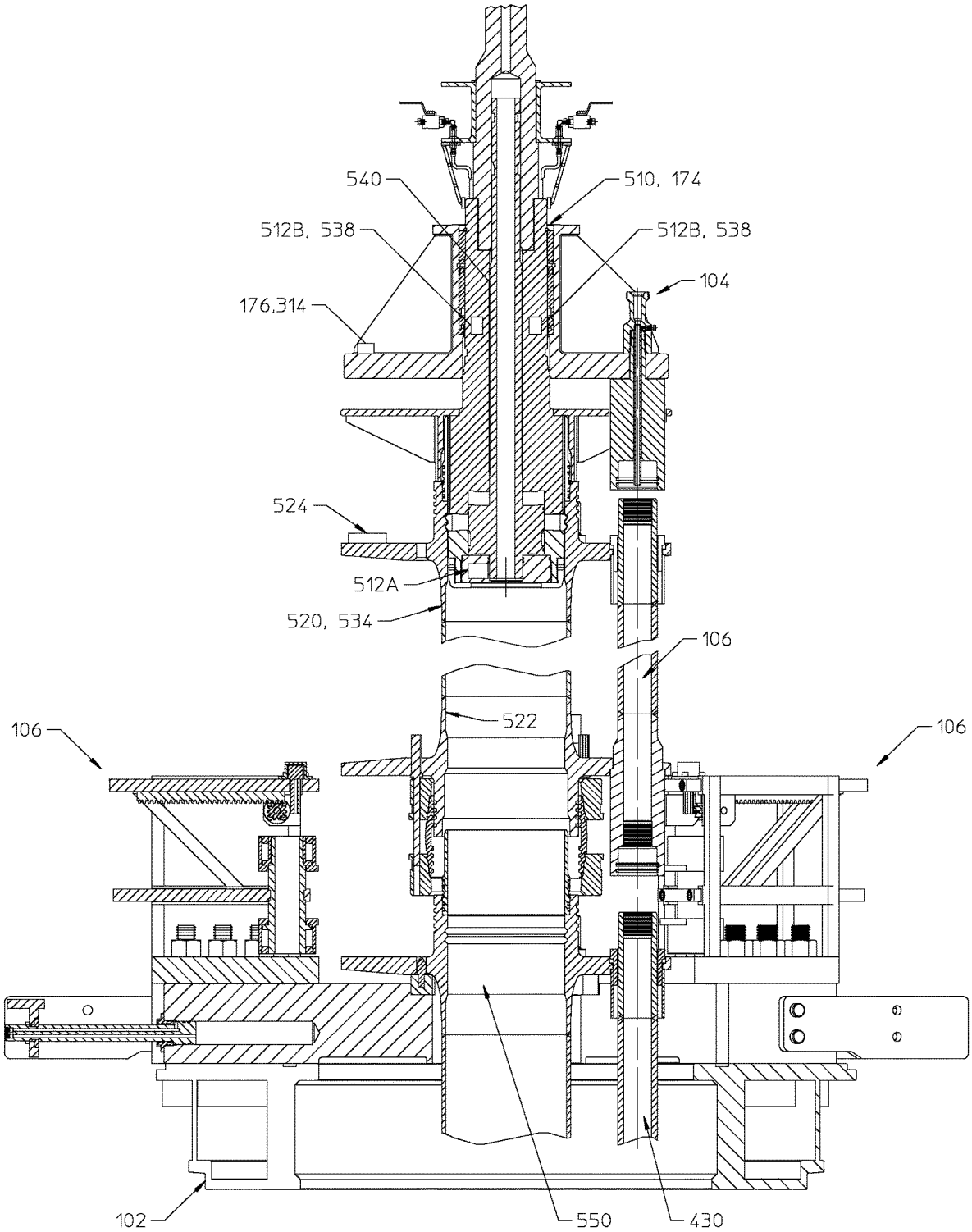
FIG. 24 shows a schematic view of a smart riser handling tool, in accordance with certain embodiments of the present disclosure.

FIG. 24 is an illustration of one such riser handling tool 510, which includes one or more sensors 512. The riser handling tool 510 also includes the communication system (322 of FIG. 22) for communicating data from the sensors 512 to the operator monitoring system 324. As described above, the communication system may include one or more processor components, one or more memory components, and a communication interface. At least one of the sensors 512A may include an electronic identification reader (e.g., RFID reader). One or more other sensors 512B may include sensors for detecting stress, strain, pressure, temperature, orientation, proximity, or any of the properties described above. The sensors 512 may be disposed internal or external to the riser handling tool 510. With the integration of these sensors 512 and computer technology, the smart riser handling tool 510 may provide increased performance and flexibility in the placement and testing of riser equipment. The smart riser handling tool 510 may provide riser joint identification, sensor measurements, and communications to the operator monitoring system 324 to provide real time or near real time feedback of riser equipment operations.

In general, the illustrated smart riser handling tool 510 is configured to engage, manipulate, and release an equipment asset 520. The equipment asset 520 may have an internal bore 522 formed therethrough. The equipment asset 520 may be a tubular component. More specifically, the equipment asset 520 may include a riser joint 534. To enable identification, the equipment asset 520 may include an electronic identification tag 524 (e.g. RFID tag) disposed on the equipment asset 520 to transmit an identification number for detection by the riser handling tool 510.

The riser handling tool 510 may be movable to manipulate the riser joint 520 into a position to be connected to a string 550 of other riser joints coupled end to end. In the illustrated embodiment, the smart handling tool 510 functions as the above described riser handling tool 174. That is, the smart riser handling tool 510 is movable to manipulate riser joints 354 to construct or deconstruct the riser string 550.

Similar "smart" handling tools may be utilized in various other contexts for manipulating equipment assets in a well environment. For example, smart handling tools may be utilized in casing running/pulling operations to manipulate casing hangers to construct or deconstruct the well. In addition, a similar smart handling tool may be used during testing of a BOP.

Smart handling tools (e.g., 510) used in these various contexts (e.g., riser construction, well construction, BOP testing, etc.) may be equipped with sensors 512 to read a landing, locking, unlocking, seal position, rotation of the smart tool, actuation of the smart tool, and/or testing of a seal or other components in the riser, casing hanger, well, or BOP. The smart handling tool may communicate (to the MLMS 324) data indicative of the steps and processes for installing or testing the riser, casing hanger, BOP, or other equipment. In some embodiments, data sensed by the smart handling tool may be stored in a memory (e.g., 412) of the smart tool and read at the surface when the smart tool is retrieved. The smart handling tool may include sensors 512 for determining pressures, temperatures, flowrates, stress (e.g., tension, compression, torsion, or bending), strain, weight, orientation, proximity, linear displacement, corrosion, and other parameters. The smart handling tool may be used to read and monitor each step of the installation, testing, and retrieval of the smart tool and its associated equipment asset (e.g., riser component, casing hanger, BOP, etc.).

The smart tool may include its own communication system 322 to communicate real-time or near real-time data to the MLMS 324. In some embodiments, the smart handling tool's communication system 322 may transmit data through the internal sensors 318 and associated communication systems 322 of the riser assembly 310 (described above) to transfer the data to the MLMS 324. For example, smart handling tools disposed below the BOP stack may transmit sensor data to the BOP connector's internal sensors and communication system (318 and 322 of FIG. 15), which then communicates the signals to the MLMS 324. This communication may be accomplished via a wired, wireless, induction, acoustic, or any other type of communication system.

Figure 25:
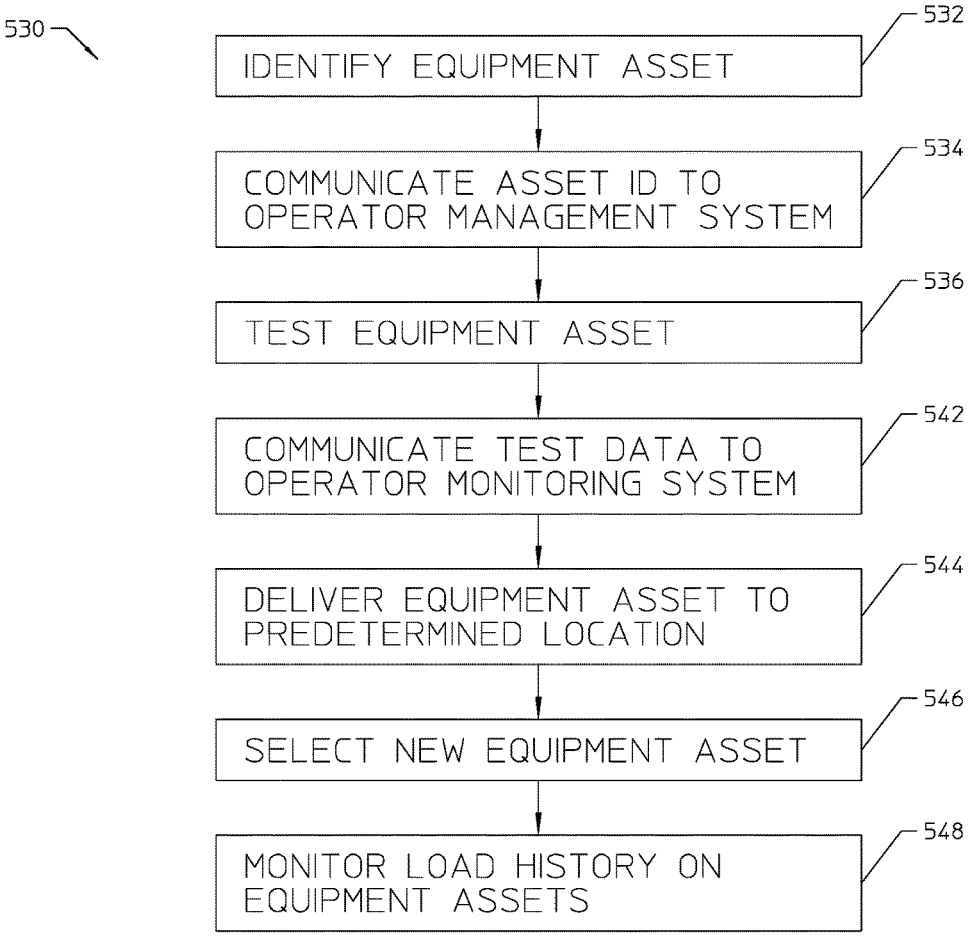
FIG. 25 shows a process flow diagram of a method for operating a smart riser handling tool, in accordance with certain embodiments of the present disclosure.

The illustrated smart riser handling tool 510 may perform various identification, selection, testing, and running functions while handling the equipment assets 520 (e.g., riser joints). FIG. 25 illustrates a method 530 for operating the smart handling tool 510. The method 530 includes identifying 532 an equipment asset 520 for manipulation at a well site. This identification may be accomplished through the use of RFID technology. That is, the smart handling tool 510 may include the electronic sensor 512A designed to read an identification number transmitted from the electronic identification tag 524 on the equipment asset 520. The method 530 generally includes communicating 534 the identification read by the electronic sensor 512A on the smart handling tool 510 to the operator monitoring system (or MLMS) 324. In some embodiments, the detected identification may be incorporated into a data block of information regarding the particular equipment asset 520 and sent to the MLMS 324.

The method 530 may further include testing 536 the equipment asset (e.g., riser joint) 520 while the asset 520 is being handled by the smart riser handling tool 510. The smart riser handling tool 510 may include a number of testing features in the form of additional sensor 512B. The sensors 512B may be configured to detect a pressure, temperature, weight, flow rate, or any other desirable property associated with the equipment asset 520.

In some embodiments, the testing involves measuring the weight of the equipment asset (e.g., riser joint) 520 while the asset 520 is suspended in the air during a running or pulling operation. As shown in FIG. 24, the smart handling tool 510 may be equipped with multiple sets of strain gauges 538 integrated into a stem 540 of the handling tool 510 to detect the weight on the equipment asset 520. The measured strain correlates to the actual weight of the equipment asset 520, and the handling tool 510 may provide a real time weight measurement for each equipment asset 520 being manipulated to assemble the subsea equipment package. These individual weight measurements of the equipment assets 520 may be collected into a database in the MLMS 324 to provide long term tracking of the weight on each equipment asset 520.

The method 530 of FIG. 25 also includes communicating 542 the test data retrieved via the sensors 512 to the MLMS 324. The test data is communicated to the MLMS 324 for storage in a database along with the identification data for the associated equipment asset 518. Each data record communicated to the MLMS 324 may contain the sensed parameter data as well as the date/time that the data was sensed and the asset identification number.

The method 530 further includes delivering 544 the equipment asset (e.g., riser joint) 520 to a predetermined location via the handling tool 510. The smart handling tool 510 may pick up and deliver the equipment asset 520 to the rig floor for incorporation and/or makeup into a subsea equipment package to be placed on the ocean bottom or a well. In other embodiments, the smart handling tool 510 may pick up an equipment asset 520 that has been separated from a subsea equipment package and return the equipment asset 520 to a surface location. Pertinent data relating to the delivery 544 of the equipment asset 520 may be collected via the sensors 512, stored, and then communicated to the MLMS 324 for inclusion in the database.

The method 530 may include selecting 546 a new equipment asset (e.g., riser joint) 520 for connection to the subsea equipment package (e.g., riser string) based on the identification of the equipment asset 518. The smart handling tool 510 may verify that the equipment assets being connected together are in a proper sequence within the equipment package, based on data from the MLMS 324. Since each equipment asset 520 has its own unique identifier in the form of an electronic identification tag or similar feature, the MLMS 324 may organize the pertinent sensor data for each individual equipment asset 520 in the database. This information may be accessed from the database in order to select 546 the next equipment asset 520 to be placed in the sequence of the subsea equipment package.

The MLMS 324 may monitor 548 a load history on the equipment assets 520 based on information that is sensed and stored within the database for each identified equipment asset 520. This information may be accessed and evaluated for the purpose of recertification of the equipment assets 520 being used throughout the system. This load history may be monitored 548 for each equipment asset 520 (e.g., joint) that has been connected in series to form the subsea equipment package (e.g., riser). The accurate log of historical load data stored in the database of the MLMS 324 may allow the operator to recertify the equipment assets 520 only when necessary based on the measured load data. The historical load data may also help with early identification of any potential equipment failure points.

In the context of the riser assembly 310 described at length above, the smart handling tool 510 of FIG. 24 may provide live data to the MLMS 324 during the installation and retrieval of the riser assembly 310. The smart handling tool 510 may provide identification of the riser joints 354 (or 356) through RFID technology. In some embodiments, the smart handling tool 510 may also provide test data relating to the operation of the auxiliary lines 430 through the riser joints 354. As described above, the smart handling tool 510 may provide weight data relating to both the riser string and the individual riser joints 354.

In some embodiments, the smart handling tool 510 may provide orientation data for landing and retrieving the riser joints 354. As mentioned above, the smart handling tool 510 may communicate with the spider assembly 102. Based on sensor feedback from the spider assembly 102, the handling tool 510 may orient the riser joint appropriately for auxiliary line connection to the previously set riser joint, and land the riser joint onto the flange of the previously set riser joint. The smart spider assembly 102 may perform the locking procedure if running the riser joint, or the unlocking procedure if pulling the riser joints.

FIG. 24 illustrates the smart handling tool 510 being used to run riser joints 354 to construct the riser string 550. It should be noted that a similar procedure may be followed to run other types of tubular components or equipment assets, including casing joints, BOP units, drill pipe, and others. First, the smart handling tool 510 may be connected to the riser joint 354 in a storage area at the well site and may read the electronic identification tag 524 to identify the joint 354. The smart handling tool 510 then communicates the riser joint ID to the database in the MLMS 324. The smart handling tool 510 may move the riser joint 354 to the rig floor for connection to the riser string 550. While moving the riser joint 354, the handling tool 510 may measure the weight of the joint via the strain gauges 538 and communicate the detected weight data to the MLMS database.

The smart handling tool 510 may then lower the riser joint 354 onto the landing ring of the spider assembly 102, and orient the riser joint 354 to match the receiving joint already in the spider assembly 102. The spider assembly 102 may connect the two joints 354 together, as described above. After connecting the joints, the spider assembly 102 may actuate the dogs 116 out of the way so that the spider assembly 102 is no longer supporting the riser connection 104. Instead, the smart handling tool 510 is fully supporting the riser string 550.

The smart handling tool 510 may then test the auxiliary lines 430 of the riser string 550, ensuring that the auxiliary lines 430 are properly sealing between adjacent riser joints 354. The smart handling tool 510 may communicate the measurement feedback of the auxiliary line test to the database records in the MLMS 324. The smart handling tool 510 may raise the riser string 550, measure the weight of the entire riser string 550 via the strain gauges 538, and communicate the measured weight to the MLMS 324. The smart handling tool 510 then lowers the riser string 550 to land the top flange onto the landing ring of the spider assembly 102. The steps of this running method may be repeated until the entire riser string 550 has been run and landed on the subsea wellhead.

The procedure for pulling the riser string 550 using the smart handling tool 510 is similar to the procedure for running the riser string 550, but in reverse. Again, this procedure may be applied to any desirable type of equipment assets (e.g., riser, casing, BOP, drill pipe, or other) that are being pulled via a smart handling tool 510. During the pulling procedure, the smart handling tool 510 starts by picking up the riser string 550. The spider assembly 102 may open to allow the smart handling tool 510 to raise the riser string 550, and the smart handling tool 510 may weigh the riser string 550 via the strain gauges 538 and communicate the data to the database of the MLMS 324.

The spider assembly 102 may close around the top flange of the second riser joint from the top of the riser string 550, and the smart handling tool 510 may land the riser string 550 onto the landing ring of the spider assembly 102. The spider assembly 102 then unlocks the upper riser joint 354 from the rest of the riser string 550. The spider assembly 102 may record the amount of force required to unlock the joint 354 via one or more sensors disposed on the spider assembly 102, and communicate the force measurement to the MLMS 324. The smart handling tool 510 raises the disconnected riser joint 354 away from the rest of the riser string 550, pauses to weigh the individual riser joint 354, then delivers the riser joint 354 to the storage area. The identification and weight measurement for the riser joint 354 is communicated to the database in the MLMS 324 for record keeping. The pulling process may be repeated until all the riser joints 354 of the riser string 550 have been disconnected and retrieved to the surface.

In the riser assembly examples given above, the smart handling tool 510 may utilize the sensors 512 to detect certain properties of the riser assembly 310 throughout the running and pulling operations. For example, the data detected from the sensors 512 may include the identification of each riser joint 354 read via an electronic identification reader on the smart handling tool 510. The data may also include strain gauge data indicative of the weight of the individual riser joint 354 being held by the smart handling tool 510. In addition, the data may include strain gauge data indicative of the weight of the riser string 550 as the riser string 550 is being assembled or disassembled.

Further, the data may include data indicative of auxiliary line testing performed by the smart handling tool 510 to ensure a leak free assembly of the auxiliary lines 430 connected through the riser assembly 310. For example, pressure sensors on the smart handling tool 510 may measure a test pressure of the auxiliary lines of the riser string and communicate the test results to the MLMS 324. The pressure test may be performed on an individual riser joint 354 before connecting the riser joint 354 to the riser string, or before moving the riser joint 354 to the rig for running the joint. A second pressure test may also be performed after the riser joint 354 has been connected to the riser string 550 to provide the pressure test results for the entire riser string 550. The riser string test may be performed multiple times throughout the running of the riser string 550, and a final test of the auxiliary lines 430 may be conducted to verify that the entire riser assembly 310 has been tested and the riser string is available for subsea drilling operations.

As mentioned above, identification data retrieved from the tags 524 on various equipment assets 520 (i.e., riser components) may be stored in the MLMS 324 along with other data detected by sensors 512 on the smart handling tool 510. In addition, the riser components 520 may themselves be equipped with one or more sensors 314/318 designed to monitor real-time parameters of the riser component 520 during use. The sensor data taken from these onboard sensors 314, 318 may be stored in the MLMS 324 along with the identity of the riser components 520. This stored data may be used to monitor the lifecycle of various riser components 520 and to develop sequences for stacking, cycling, reusing, and maintaining the riser components 520 at a time after the riser assembly 310 has been pulled to the surface. The lifecycle management enabled through the MLMS 324 may provide an optimal usage of the riser components 520 within the riser assembly 310. The monitoring of the riser components 520 based on measurements taken by sensors 314, 318 on the components 520 may be carried out in real time or at a later time when the components 520 are retrieved to the surface or when an ROV delivers sensor data to the surface.

The MLMS 324 may record a list of riser components 520 that are tagged (i.e., via an identification tag 524) in the riser assembly 310 and all the data that the sensors 314, 318 on those equipment assets provide. The MLMS 324 may display (e.g., via user interface 494 of FIG. 23) one or more tables to an operator that list each of the tagged riser components 520 and their associated data. The MLMS 324 may also determine and display to the operator a list of real-time parameters associated with the entire riser assembly 310. The MLMS 324 may provide such information to the operator using a software application such as, for example, DeltaV or Wonderware.

From the data history collected for each riser component 520, the MLMS 324 may build a matrix used to schedule maintenance for and review the history of the riser components 520 and their times of usage. The MLMS 324 may take all the collected data, as well as additional user inputs, and enter them into dated tables that allow the system to keep track of the wear and tear of individual riser components 520 and to predict timing for future maintenance or replacement of a particular riser component 520.

In some embodiments, the MLMS 324 may collect and provide similar information regarding the operations of internal equipment (e.g., tool 390) that is lowered through the riser assembly 310 and/or secured within the subterranean wellbore. As described above, the MLMS 324 may receive information regarding the internal equipment string (e.g., drillpipe, running tools, completion equipment, etc.) from internal sensors 318 disposed within the riser assembly 310 and in inductive communication with instrumentation subs located along the equipment string. The MLMS 324 may take all collected data retrieved from tools 390 lowered through the riser assembly 310 and enter them into dated tables to allow the system to keep track of the operations as well as wear and tear of individual tools 390 or their equipment components 1004. As discussed above, this sensor data may include data regarding environmental conditions to which the tools 390 are exposed, or data monitoring the actuation/operation of equipment components 1004 of the tools 390.

Figure 26A:
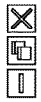
FIGS. 26A and 26B show a riser selection screen of a monitoring and lifecycle management system (MLMS), in accordance with certain embodiments of the present disclosure.
Figure 26A:
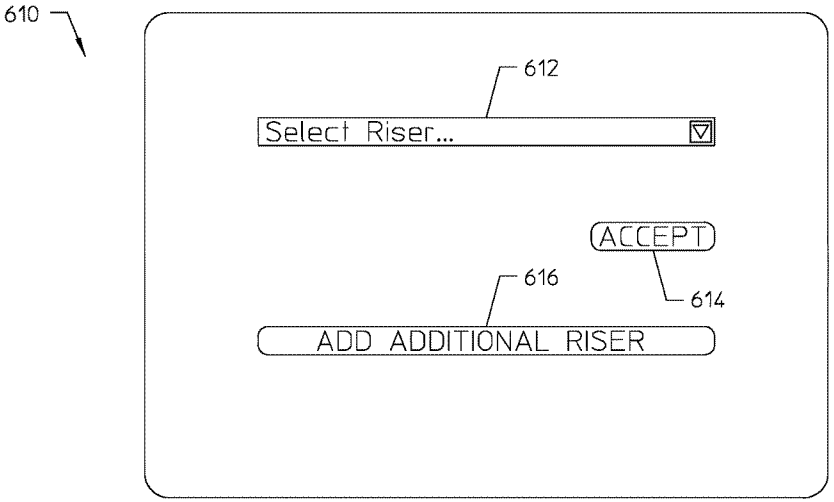

FIGS. 26A-31 illustrate various example screens that may be displayed on the user interface 494 of the MLMS 324 based on information received from the riser component identification tags 520 and the sensors 314, 318 throughout the riser assembly 310. FIGS. 26A and 26B show a riser selection screen 610. Upon initiation of the MLMS software, a user may be prompted to log in using, for example, a Windows login.

Figure 26B:
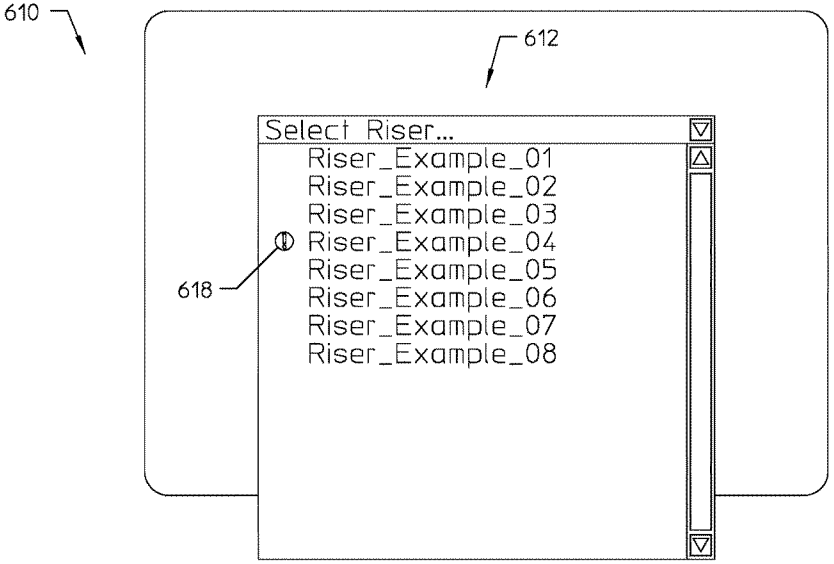

Once the user has logged in, the MLMS 324 may display the riser selection screen 610, which presents the user with an option to select a riser assembly. The MLMS 324 may be communicatively coupled to sensors 314, 318 on multiple riser assemblies 310 located in a particular field of subsea wells via their associated communication systems 322 as described above with reference to FIG. 10. The MLMS may be able to manage the data, maintenance schedules, and sequencing of multiple riser assemblies at a time. The information pertaining to each riser assembly is stored in the MLMS and linked with a riser identification number. As illustrated in FIG. 26A, the riser selection screen 610 may include a riser selection drop-down menu 612 that lists a riser identification number for each riser assembly, an Accept button 614 to confirm the selection of a given riser assembly from the drop-down menu 612, and an Add Riser button 616 to add a new riser assembly to the list in the drop-down menu 612. Selection of a riser assembly from the drop-down menu 612 is illustrated in FIG. 26B. As shown, the drop-down menu 612 may include one or more alerts 618 next to a given riser identification number in the drop-down menu. The alerts 618 may represent either a maintenance alert for one or more components on or internal to a particular riser assembly or an alert that one or more sensed properties in the riser assembly (or equipment positioned therein) are outside of expected ranges.

Figure 27:
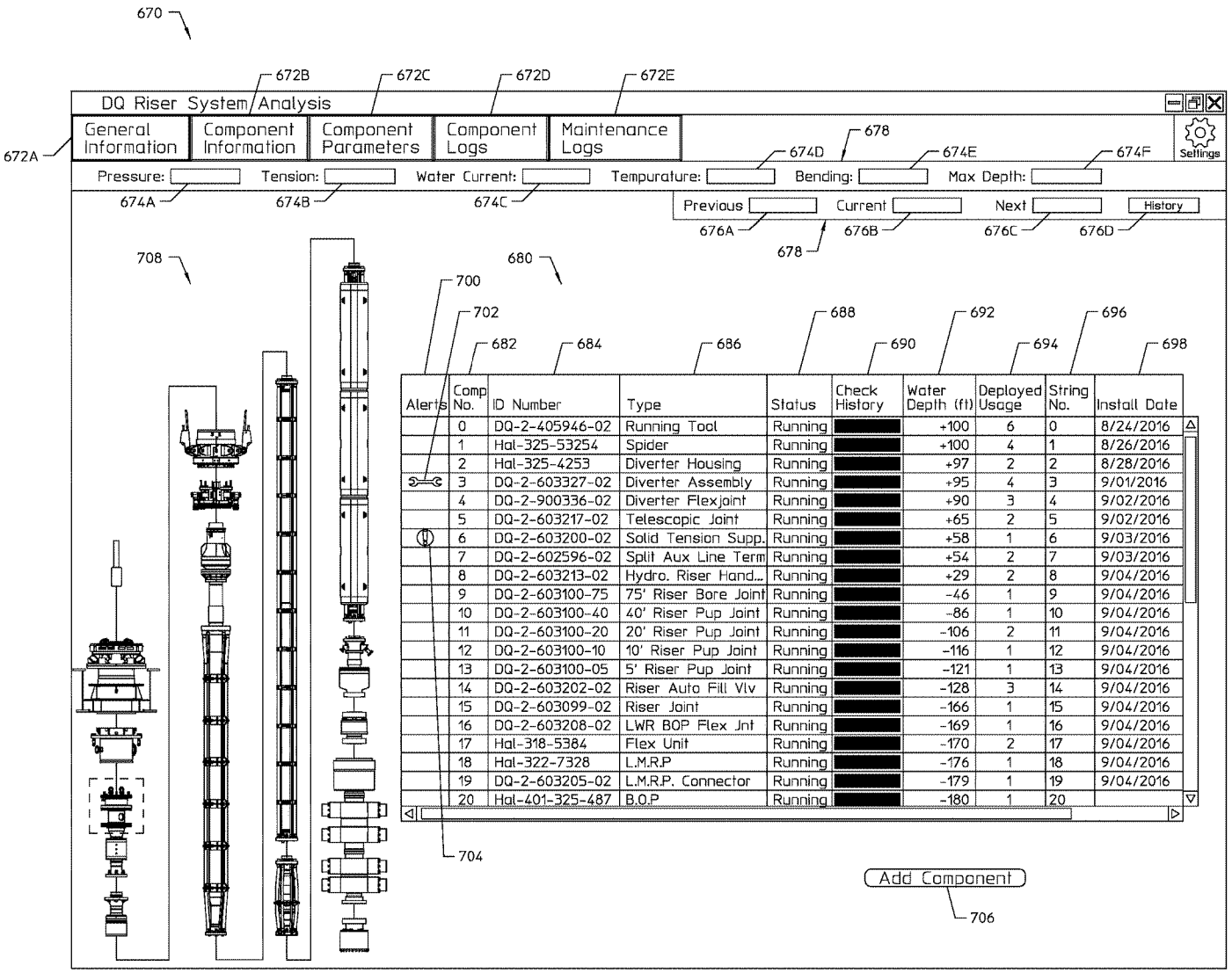
FIG. 27 shows an information overview screen of a MLMS, in accordance with certain embodiments of the present disclosure.

After a riser assembly is selected via the riser identification number, the MLMS may display a riser main screen 670, an example of which is shown in FIG. 27. The riser main screen 670 may include general information associated with the data collected from various components (i.e., equipment assets) of the selected riser assembly. In embodiments where the MLMS is only communicatively coupled to a single riser assembly, the MLMS may display the riser main screen 670 directly upon a user logging into the system, since no other risers are available for selection.

The riser main screen 670 may include, among other things, a number of different tabs 672A, 672B, 672C, 672D, and 672E, with each tab 672 opening a screen with different information regarding the components of the particular riser assembly. The riser main screen 670 is associated with the tab 672A and includes "General Information" about the riser components. The riser main screen 670 provides a general overview of the information collected for each of the riser components and/or any internal tools being lowered through or positioned in the riser assembly. The tab 672B leads to a screen providing "Component Information", which may include any live data collected at sensors within the riser assembly and/or internal tools during operation. The tab 672C leads to a screen providing "Component Parameters", in which the user may specify parameter thresholds for which alerts will be issued and how the alerts will be issued. The tab 672D leads to a screen providing "Component Logs", which may contain the history of a particular riser component or internal tool during one or more deployments. The tab 672E leads to a screen providing "Maintenance Logs", which may contain a list of maintenance items to be completed and a log of past maintenance that has been performed. It should be noted that other arrangements of screens and/or tabs may be provided to organize information that is stored in and/or determined by the MLMS. The disclosed MLMS user interface is not limited to the implementation provided in this and the following screens.

The riser main screen 670 may feature a list of current riser information 674. This current riser information 674 may include parameters associated with the riser assembly taken as a whole, instead of any one constituent riser component. At least some portions of the current riser information 674 may be calculated by the MLMS based on sensor information received from the multiple sensors disposed throughout the components of the riser assembly and/or tools internal to the riser assembly. Some other portions of the current riser information 674 may be determined based on sensor measurements taken at the surface level such as, for example, an entire weight of the riser assembly or a total depth of the riser assembly as calculated based on the number of riser joints connected via the spider assembly. The current riser information 674 may include pressure 674A, tension 674B, water current 674C, temperature 674D, bending stress 674E acting on the riser assembly, and/or a maximum depth 674F of the riser assembly. It should be noted that the current riser information 674 that is displayed on the riser main screen 670 may include additional or different parameters than those that are illustrated and listed herein. The current riser information 674 may include any desired parameters that are either directly sensed via sensors communicatively coupled to the MLMS or determined via processing by the MLMS based on sensor readings.

In addition, the riser main screen 670 may include sequencing information 676. The sequencing information 676 may include identification information of one or more riser components and/or internal tools provided in a particular sequence as determined by the MLMS. The MLMS may determine a preferred sequence of riser components to be added in series to form the riser assembly, based on information (e.g., stresses, weight, number of hours in use since recertification) associated with and stored with the component identification number in the MLMS database. The sequencing information 676 may also include a list of functions to be performed during the installation or removal of each riser component. The sequencing information 676 may also include a preferred sequence of tools to be lowered through the internal bore of the riser assembly and/or operations to be performed via such tools.

As illustrated, the riser main screen 670 may show a previous step 676A in the sequence that had just been performed to construct or deconstruct the riser assembly or perform other operations, a current step 676B in the sequence that is currently being performed, a next step 676C in the sequence to be performed, and a sequence history button 676D that, when selected by the user, may provide a pop-up screen showing the history of sequences of riser components utilized in other riser deployments. The sequencing information 676 displayed on the riser main screen 670 may inform the user as to which riser component is to be picked up and added next to the riser assembly, and which functions are to be performed on, within, or through the riser components. The MLMS may output an alert to the user in the event that the user selects the wrong riser component to attach to the riser assembly based on the identification information read from the riser component's identification tag via the running tool. Similarly, the MLMS may output an alert to the user in the event that the user selects the wrong internal tool to run through the riser assembly based on identification information read from the tool's identification tag via a running tool.

In some embodiments, the riser main screen 670 may include indicators associated with one or more parts of the sequencing information 676. These indicators may light up in specific colors (e.g., red, yellow, and green) or patterns in a manner for instructing the user to perform riser construction/deconstruction operations in the correct order according to a predetermined sequence. One example of such indicators being used to instruct the user and during a riser construction operation will now be provided.

The process may involve providing an identified component (first, next, or previous in the sequence) to retrieve and/or run in. The component identification information may be read, identified, and/or verified using the MLMS. The MLMS may receive a signal indicative of the identification of the component (e.g., from an electronic identification reader on the running tool or from a handheld scanner device). The MLMS may access and check the load history and status of the identified component. A green highlight or other notification may be displayed on the riser main screen 670 (or other screen of the MLMS) to indicate that the desired component has been located. Upon receiving this indication, the user may install the riser handling tool on the component and lock the tool into the component. Once the handling tool is locked into the component, a green highlight notification may be displayed on the MLMS screen indicating that the tool is locked and ready to move and/or test the attached component. The handling tool may test the component at this time if needed. Then the handling tool may lift/maneuver the component to the rig floor. A green highlight or other notification may be displayed on the MLMS screen indicating that the component is ready to be lowered into the riser coupling system.

The process may then include lowering the component to a desired height via the handling tool. A green highlight or other notification may be displayed on the MLMS screen indicating that the component is at the desired height and ready to be oriented. The handling tool may orient the component with respect to the spider so that the component can be landed on the spider or on the previously installed component held in the spider. A green highlight or other notification may be displayed on the MLMS screen indicating that the component is in the desired orientation and ready to be lowered/landed in the riser coupling system. The handling tool then lands the component, and the MLMS screen shows a green indication that the component has landed and is ready to be locked to the previously attached component.

From this point, the riser coupling system may extend the spider dogs into engagement with the component, and the MLMS screen shows a green indication that the spider dogs are extended. The rise coupling system may extend the spider connecting tool and operate the tool to connect the riser component to any previous component, and the MLMS screen shows a green indication that the connecting tool is extended and operating to connect the riser components. After making the connection, the spider connecting tool may be retracted, and the MLMS screen shows a green indication that the connecting tool is retracted and the riser assembly is ready to run/test.

At this point, any desired testing of the riser and auxiliary lines may be performed using the riser handling tool, as described above. If the complete test is passed, a green indication will be provided on the MLMS screen. However, if the test is failed, the MLMS screen shows a red highlight on this test step. This notifies the user to repeat the test, visually inspect the connection, and/or remove and return the added component to a storage area and repeat the running sequence with a different component. Once the test has yielded satisfactory results regarding the connection formed, the handling tool may pick up the connected riser string. The MLMS screen shows a green indication for performing the next step in the sequence or a red indication for stopping and evaluating the warning if a problem has occurred based on sensor data received at the MLMS. The last few steps in the process may include retracting the spider dogs, lowering the riser string to a predetermined height via the handling tool, extending the spider dogs back toward the riser string, landing the riser string on the spider, and releasing the riser handling tool from the riser string. During or at the completion of each of these steps, the MLMS screen shows a green indication instructing the user to perform the next step in the sequence or a red warning indication instructing the user to stop/evaluate the warning if a problem has occurred based on sensor data received at the MLMS. This series of steps may be repeated for each additional riser component that is added to the riser string during construction of the riser assembly, as well as all internal tools that are run through and/or actuated within the riser assembly.

At the end of riser assembly construction, additional steps may include the following: landing the riser string on a subsea wellhead, connecting the BOP connector of the riser assembly to the wellhead; pulling on the riser assembly (overpull) to ensure that the riser assembly has been connected to the wellhead, testing the BOP connector gasket; engaging the tensioner system to support the weight of the riser assembly; installing a riser auxiliary line to the termination joint; testing the auxiliary lines, disengaging the telescopic joint to telescope and allow for compensation equipment to engage with the tensioner; picking up the riser joints above the telescopic joint and landing them in the spider; connecting the diverter to the riser assembly, lowering the diverter to the diverter house; locking the diverter in the housing; testing the valves/packers of the diverter; running a BOP test tool inside the riser string; and testing the BOP. During or at the completion of each of these steps, the MLMS screen shows a green indication instructing the user to perform the next step in the sequence or a red warning indication instructing the user to stop/evaluate the warning if a problem has occurred based on sensor data received at the MLMS. The MLMS may include a manual override feature that allows the user to continue performing riser operations even after receiving a red (warning) indication. The user may choose to override the warning if they consider the severity of the warning to be relatively low.

Once the complete riser assembly has been installed and tested, drilling on the inner casing strings can begin. As discussed above, the MLMS may receive information from the internal sensors on the BOP connector that are interacting with drilling tools, components, drill pipe communication subs, and other tools lowered through the riser assembly. In addition, the MLMS may output control signals for operating the tools lowered through the riser assembly via the communication system on the riser assembly. It should be noted that the sequence described in detail above may be reversed to enable retrieval of the riser assembly. However, testing of the hydraulic flow lines through the riser assembly may not be required during retrieval.

As illustrated, the current riser information 674 and the sequencing information 676 may be displayed in one or more horizontal bars 678 across the top of the main riser screen 670. As illustrated in FIGS. 28-31, the horizontal bar(s) 678 may be visible at the top of each of the other screens accessible from the main riser screen 670. That way, a user may set parameters, review logs, add maintenance tickets, and perform other operations on the MLMS all without losing sight of the current operating information for the riser assembly and internal tools, and/or the current sequence of riser components being connected.

The riser main screen 670 may include overview information (listed in an information table 680) for the different riser components and internal tools that are present in the selected riser assembly. The overview information may include, for example, "component number" 682, "identification number" 684, "type" 686, "status" 688, a "check history" button 690, "water depth" 692, "deployed usage" number 694, "string number" 696, "installation date" 698, and "alerts" 700. It should be noted that additional information or a different set of information associated with each riser component or internal tool may be output to the riser main screen 670. The user may configure the program to output the desired parameters associated with the components of the riser assembly and any internal tools lowered therethrough in the overview information table 680.

The component number 682 displayed within the information table 680 may be a unique identification number associated with a riser component that is present in the selected riser assembly, or an internal tool which is presently located within or below the riser assembly. In some embodiments, the component number 682 may just be the unique identifier detected from an ID tag placed on the component. In other embodiments, the component number 682 may be a unique number that is assigned to the particular component via the MLMS. The MLMS may store each unique component number 682 within its database. New component numbers 682 are assigned as new riser components are added to the system (e.g., via detection of their ID tags by the running tool or via manual entry into the database by a user) or as new tools are lowered through the riser assembly. As a result, no riser components or internal tools that are or have previously been used in the one or more riser assemblies will have the same component number 682. The various sensor data, history, maintenance information, and logs associated with each component may be stored in the database of the MLMS and linked to the component number 682. The unique component numbers 682 for the riser components and internal tools may enable inventory and lifecycle management of the components over multiple deployments in a riser assembly.

The type 686 displayed within the information table 680 represents the type of equipment asset for each component in the riser assembly. The different types 686 of components may perform different functions within the riser assembly, as described above. The identification number 684 displayed within the information table 680 may be an identification number associated with the particular type 686 of component. For example, the identification number 684 may include letters representing the manufacturer of the component and a company part-number identifying the component type supplied by the manufacturer. The status 688 indicates the current status of the component, such as "running" for when the riser components are connected together and deployed or the internal tool is being lowered through the riser. The check history button 690, when selected, may call up an associated component log or maintenance log (e.g., by changing from the general information tab 672A to the component log tab 672D or maintenance log tab 672E).

The water depth 692 indicates the depth below or height above water at which a riser component is currently positioned in the riser assembly. This water depth 692 of a given component may change as new components are added to construct the riser assembly or removed to deconstruct the riser assembly. The deployed usage 694 represents the number of times the riser component or internal tool has been deployed within a riser assembly. The string number 696 represents the relative position of the riser component within the overall riser assembly. For example, the running tool may have the number "0" position in the riser assembly, the component connected immediately below the running tool may have the number "1" position, and so forth throughout construction and operation of the riser assembly. The install date 698 may represent the day that the particular riser component is added during construction of the riser assembly. The alerts 700 may provide one or more indications of maintenance (702) needing to be performed on a particular riser component or internal tool, or of a riser component or internal tool where the on-board sensor measurements are approaching or exceeding a limit (704).

As shown, the overview information may be output on the display in the form of a table of values associated with each of the riser components within the selected riser string. This table 680 may be a pop-up window on the riser main screen 670. The values of the overview information may be automatically populated into the information table 680 based on sensor readings received at the MLMS. For example, as new components are added to the riser assembly or new tools lowered therethrough, the smart running tool may automatically read the identification information from each new component and send the identification information to the MLMS for storage and determination of other information. The MLMS may determine and store the component number 682, identification number 684, and type 686 of the riser component or internal tool component based on the identification tag information. The MLMS may determine the string number 696 for riser components based on the order in which the identification tags are read from subsequently added riser components engaged by the smart handling tool. The MLMS may determine the water depth 692 for riser components based on the string number 696 and the types 686 of components that are connected together end to end in the riser assembly. The MLMS may take a time reading upon identification of each of the riser components or internal tools via the smart handling tool to determine the installation date 698. The MLMS may access historical records of previous riser assemblies to determine the deployed usage 694 of each of the riser components or internal tools.

An "Add Component" button 706 may be provided on the riser main screen 670 and used to manually add a new riser component or internal tool and its associated information into the data fields of the information table 680. This may be desirable in the event that not all components of the riser assembly include identification tags to be read by the smart handling tool. This could be the case, for example, if there are pre-existing riser components in the riser assembly that are not tagged, or if only a select few of the riser components are fitted with identification tags. Adding the information associated with un-tagged riser components or internal tools may help the MLMS keep a more accurate service projection of the riser assembly.

For each new component added, a user may enter the component number 682, the identification number 684, and/or the type 686 into the information table 680 so as to identify and provide information about the new component. In some instances, the user may also input a string number 696 to specify a location within the riser string of a particular riser component. In other instances, the MLMS may automatically populate this information based on the timing for when the new information is input in the process of constructing the riser assembly. Based on the added component information, the MLMS may automatically populate other areas of the overview information such as the status 688, water depth 692, deployed usage 694, and installation date 698. In addition to the Add Component button 706, the riser main screen 670 may also include a "Remove/Replace" button (not shown).

The riser main screen 670 may include a riser assembly graphic 708 displayed thereon. The riser assembly graphic 708 may feature images or schematics of each riser component (e.g., running tool, spider, diverter housing, diverter assembly, various flex joints, telescopic joint, bare riser joints, buoyant riser joints, LMRP, BOP, etc.) being used in the selected riser assembly. The riser assembly graphic 708 may display any of the riser components described above in reference to FIG. 11. The riser assembly graphic 708 may include different arrangements of the riser components or additional types of riser components than those shown in FIG. 11. The riser assembly graphic 708 may illustrate the riser component images arranged in the same order as the actual components making up the riser assembly. As shown, large groups of similar riser components (e.g., bare riser joints, buoyant riser joints, etc.) may be illustrated as a single stack within the riser assembly graphic 708. The riser assembly graphic 708 may also illustrate internal tool components and their relative locations within or below the riser assembly components.

In some embodiments, the riser assembly graphic 708 may include numbers positioned next to the different riser components shown in the riser assembly graphic 708. This is generally illustrated via the numbers "0", "3", and "4" shown next to the images of the running tool, the diverter assembly, and the diverter flex joint, respectively. These numbers may correspond to the component number 682 associated with each riser component. The component number 682 may be determined via the MLMS based on the identification of the riser component obtained using sensors on the running tool, as described above. In addition to (or in lieu of) component numbers 682, the numbers on the riser assembly graphic 708 may correspond to the string number 696 associated with the position of each riser component.

The MLMS may use the riser assembly graphic 708 to display alerts and status updates corresponding to particular riser components or internal tools. For example, when maintenance is required on a component in the riser assembly, the image of that component may light up or turn red on the riser graphic 708. Similarly, when one of the riser components or internal tools is malfunctioning or operating outside of its pre-selected parameter bounds, the image of that component may light up or turn red on the riser graphic 708. The riser assembly graphic 708 may prompt a user to select the corresponding component within the list of components and review any alerts for the component when maintenance or remedial operations are needed. In some embodiments, the components in the graphic 708 may each be assigned one of three colors (red, yellow, or green) based on where the real-time sensor readings for the components fall within predetermined ranges (e.g., envelopes) of operating parameters set for the components. This may provide an easy method for visual inspection of components based on the graphic 708, thereby allowing a user to quickly address problems with the riser or internal tools as they occur.

The MLMS may generally be designed so that a user can select the real-time information associated with any given component or group of components in the riser assembly by selecting (e.g., clicking with a mouse) the image of that component or group of components on the riser assembly graphic 708. The display may show a pop-up of the component number 682 and other information associated with the selected component as stored in the database of the MLMS. In some instances, the information table 680 may be a dynamic table that is controllable by a user selecting one or more parts in the riser assembly graphic 708. For example, upon selection of one or more riser components or internal tools from the graphic 708, the MLMS may filter the overview information table 680 so that the table only includes the information relevant to the selected components. Entire groups of riser components (e.g., all bare riser joints and/or buoyant riser joints) may be selected by clicking the appropriate component group shown in the riser assembly graphic 708. The riser assembly graphic 708 may be present on other screens in addition to the riser main screen 670, as shown in subsequent FIGS. 28-31.

Figure 28:
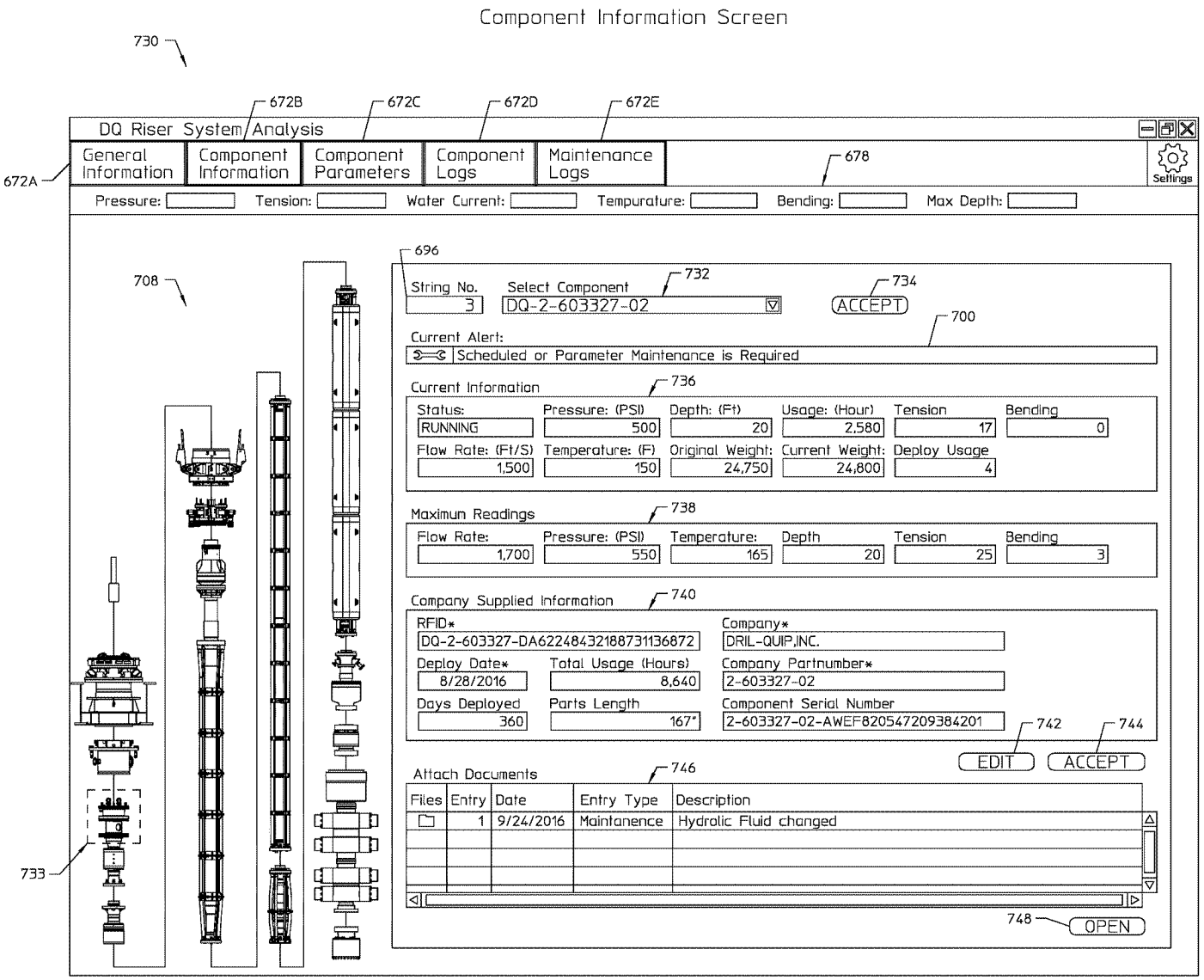
FIG. 28 shows a component information screen of a MLMS, in accordance with certain embodiments of the present disclosure.

FIG. 28 shows a component information screen 730 that displays detailed information collected from sensors on a single component of the riser assembly in real time. The component information screen 730 may be brought up by selecting a single component from the riser main screen 670 of FIG. 27 (either in the overview information table or on the riser assembly graphic 708) then selecting the component information tab 672B. In addition, the component information screen 730 may be brought up by first selecting the component information tab 672B and then choosing a riser component or internal tool using a drop-down menu 732 and Accept button 734. Upon selecting a desired component, the image of the component may be highlighted (733) or change color in the riser assembly graphic 708 so as to provide a visual indication of the selected component. It should be noted that the illustrated component information screen 730 is merely representative of certain types of information the MLMS may display to a user upon the selection of a component. Information other than what is shown, or not including all that is shown, in the illustration may be provided on the screen in other embodiments.

The component information screen 730 may display the string number 696 associated with the selected component. The component information screen 730 may also display any current alerts 700 associated with the selected component, such as scheduled maintenance or alerts due to parameters exceeding pre-set thresholds. A brief description of the current alerts 700 may be included on the component information screen 730. The component information screen 730 may also display current information 736 associated with the component, as either read from sensors or determined by the MLMS based on readings from sensors on the component and/or smart handling tool. The current information 736 may include, for example, status of the component, pressure measurements, depth of the component relative to sea level, time in use, tension, bending stress, flow rate, temperature, original weight measurement (e.g., as taken via the smart handling tool), current weight measurement (e.g., as taken via the smart handling tool), and/or deployed usage. The weight measurements may change over time, generally increasing with an increase of time spent under water due to the riser joint slowly absorbing some of the water. As the weight of certain riser components increases over time, it may be desirable to fit the riser assembly with additional buoyant riser joints during future deployments when the heavier riser components are being re-used.

The component information screen 730 may also include maximum readings 738 for certain sensor parameters (e.g., flow rate, pressure, temperature, water depth, tension, and bending stress). This may signal the user to review the history of a component that has a maximum sensor reading approaching or exceeding a desired parameter limit. The component information screen 730 may further include company supplied information 740 associated with the component. Such company supplied information 740 may include, for example, an RFID tag number, company name, deploy date, total number of hours in use, company part-number, days deployed, length of the part, and component serial number. Edit and Accept buttons 742 and 744 may be included to allow changes to be made manually to the company supplied information 740.

The component information screen 730 may also include an attached documents table 746 for viewing and accessing various documents associated with the riser component or internal tool that have been stored in the MLMS. The attached documents table 746 may provide the user a simple way to access records for servicing, maintenance, refurbishing, or replacement of each riser component or internal tool. Selecting one of the listed attachments and pressing the Open button 748 may direct the user to an appropriate component log or maintenance log associated with the attachment.

Using the data collected via sensors disposed throughout the riser assembly and/or input by a user, the MLMS may project the next time that any of the components (e.g., strings of riser joints, internal tools, etc.) will need to be serviced or recertified. This date/time may be projected based on either the default API standards or parameter limits input to the MLMS by the user. The MLMS, as discussed above, may determine a desired maintenance schedule for maintaining, recertifying, and/or recycling riser components or internal tools based on the stresses acting on these components as detected via their sensors.

Figure 29:
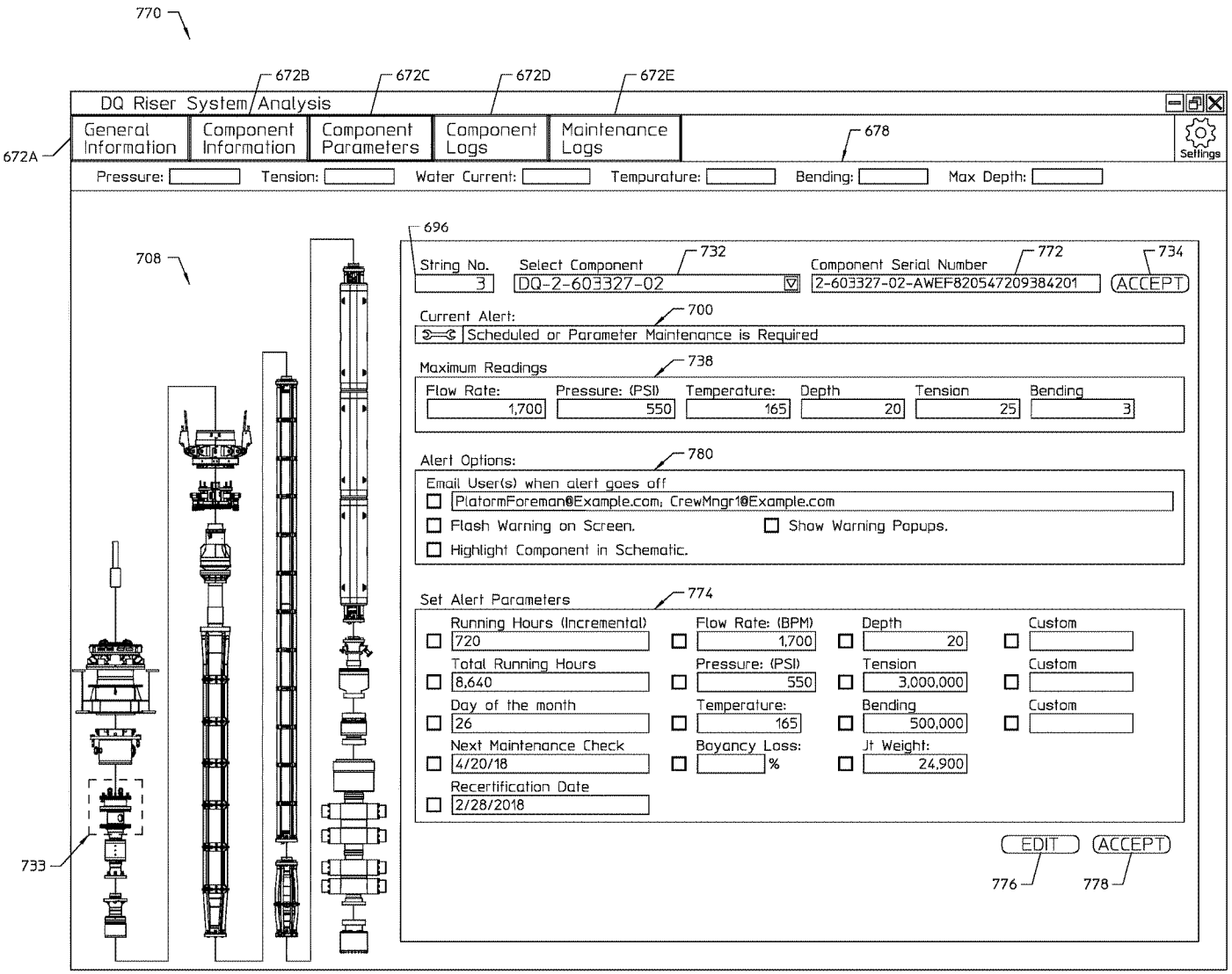
FIG. 29 shows a component parameter screen of a MLMS, in accordance with certain embodiments of the present disclosure.

FIG. 29 shows a component parameters screen 770 that displays detailed information regarding acceptable operational parameters for a particular riser component or internal tool. The component parameters screen 770 may be brought up by selecting a single component of the riser assembly from the riser main screen 670 of FIG. 27 (either in the overview information table or on the riser assembly graphic 708) then selecting the component parameters tab 672C. In addition, the component parameters screen 770 may be brought up by first selecting the component parameters tab 672C and then choosing a component using a drop-down menu 732 and Accept button 734, or inputting a serial number 772. Upon selecting a desired component, the image of the component may be highlighted (733) or change color in the riser assembly graphic 708 so as to provide a visual indication of the selected component. It should be noted that the illustrated component parameters screen 770 is merely representative of certain parameters the MLMS may display to a user upon selection of a riser component or internal tool. Parameters other than those shown, or not including all of those shown, in the illustration may be provided on the screen in other embodiments.

Similar to the component information screen, the component parameters screen 770 may include the string number 696 associated with the selected component, the current alerts 700, if any, associated with the selected component, and the maximum readings 738 for certain sensor parameters (e.g., flow rate, pressure, temperature, water depth, tension, and bending stress). In addition, the component parameters screen 770 may include an alert parameter setting tool 774 that enables a user to select the sensor parameters for which the user wishes the MLMS to output alerts. Such parameters may include, for example, a number of running hours, a total of running hours, a day of the month, a date of the next scheduled maintenance check, a recertification date, a flow rate, a pressure, a temperature, a buoyancy loss, a water depth, a tension, a bending load, a weight of the riser component, and one or more customizable parameter entries. There may be different lists of parameters that are monitored depending on the type of riser component or internal tool that has been selected.

The alert parameter setting tool 774 may include check boxes beside each of the available parameters which the user may wish to monitor during riser operations. The check boxes allow the user to select which parameters will trigger an alert if their limit is approached or exceeded. Certain parameters may be of greater importance than others in the monitoring of certain components making up the riser assembly or of components located in certain string positions. The alert parameter setting tool 774 may also display values of operational thresholds for each of the parameters that will set off an alert for the riser component or internal tool. The alert parameter setting tool 774 may enable the user to edit the operational thresholds for each parameter being monitored by the system using the Edit and Accept buttons 776 and 778. The operational threshold values displayed in the alert parameter setting tool 774 may be initially set to an industry default (i.e., API standards). However, the user may override this initial setting by editing the alert parameters and setting a lower or more conservative threshold for the component. In the event the live feed data received from a sensor on the component is outside the selected/set parameters, the MLMS will output an alert.

The component parameters screen 770 may also include an alert options setting tool 780 to enable a user to select how they wish to receive the alert if the component is operating outside the set parameters. Such alert options may include, for example, having an email sent to a particular email address (which the user may set), flashing a warning across the screen, highlighting or changing a color of the corresponding component in the riser assembly graphic 708, and displaying a warning pop-up window. Other types of alerts may be selected as well. The alert options setting tool 780 may include check boxes beside each of the available options through which the MLMS may alert the user. The check boxes allow the user to select one or more ways in which the MLMS will output an alert if one of the selected parameter limits is approached or exceeded. The alert may notify the user that the component has reached its maximum allowable stresses based on live sensor feedback, and that the component should be sent out for refurbishment.

Figure 30:
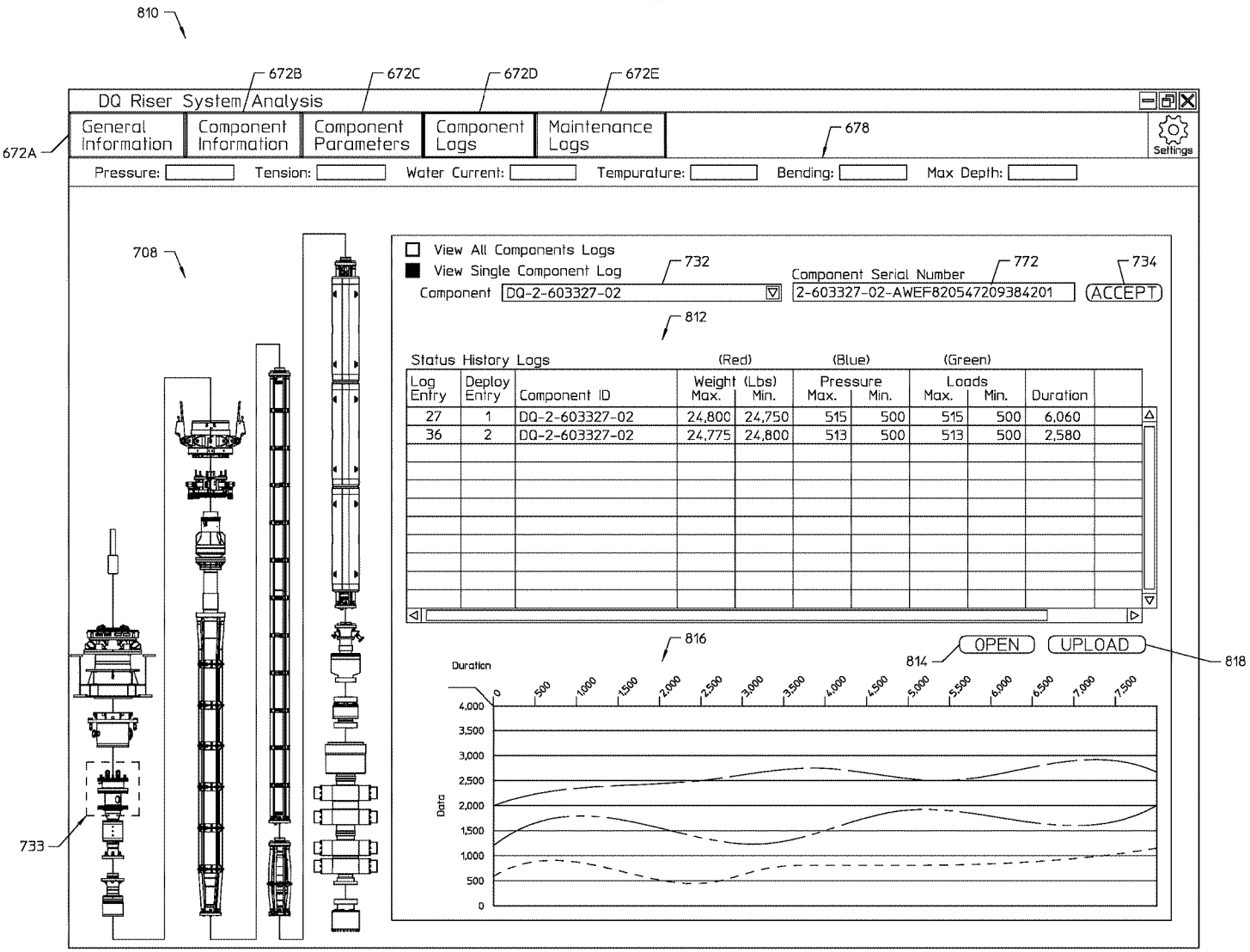
FIG. 30 shows a component log screen of a MLMS, in accordance with certain embodiments of the present disclosure.

FIG. 30 shows a component log screen 810 that displays detailed information regarding sensor readings taken for one or more riser components and/or internal tools during their deployment. The component log screen 810 may be brought up by selecting a single component of the riser assembly from the riser main screen 670 of FIG. 27 (either in the overview information table or on the riser assembly graphic 708) then selecting the component log tab 672D. In addition, the component log screen 810 may be brought up by first selecting the component log tab 672D and then choosing a component using a drop-down menu 732 and Accept button 734, or inputting a serial number 772. The component log screen 810 may also include an option for selecting "View All Component Logs", instead of just the logs for a single component.

Upon selecting a desired riser component or internal tool, the image of the component may be highlighted (733) or change color in the riser assembly graphic 708 so as to provide a visual indication of the selected component. It should be noted that the illustrated component log screen 810 is merely representative of certain types of logs the MLMS may store and display to a user. Different types, numbers, or layouts of historical logs may be provided on the screen.

The component log screen 810 may include a history log table 812 for the selected component (or all riser components and/or internal tools). The history log table 812 may store multiple log entries that are added throughout operation of the component. Each log entry, as shown, may correspond to a different deployment of the same component. The log entries stored in the table 812 may include sensor data taken from one or more sensors on-board the riser component or internal tool over time during the deployment of the component. The history log table 812 may generally include information such as the log entry, deployment entry, component identification number (or component number), duration of operation, and maximum and minimum sensor measurements taken during the duration. The sensor measurements may include, for example, weight, pressure, and loads on the component. However, other sensor measurements may be taken as well depending on the type of riser component or internal tool and what internal/external sensors are located thereon. The component log screen 810 may include an Open button 814 that allows a user to select one of the component history logs from the table 812. Opening a particular history log may cause the component log screen 810 to display the log data entry on a plot 816. This allows a user to visually inspect the trend of sensor measurements on the particular piece of equipment throughout its deployment.

The component log screen 810 may also include an Upload button 818 that allows a user to upload sensor information to the MLMS and store the sensor information as a component log entry. This may be utilized, for example, when sensor information is read into the MLMS after the component is pulled to the surface or from an ROV that is brought to the surface.

The above described logs of historical sensor data from the riser components may be analyzed and used to develop riser load predictions for future deployments. For example, historical logs of readings taken at the top (e.g., at the tensioner/telescopic rod) and bottom (e.g., at the BOP connector) of the riser assembly over a period of years may provide enough information to predict large forces (e.g., vortex induced vibrations) that can be expected over the length of the entire riser assembly.

Keeping the riser data logs may also provide valuable information to users looking to tailor the placement of sensors on riser components for optimized riser data collection. Specifically, the riser data logs may be reviewed to determine where along the length of the riser assembly the detected sensor measurements are redundant and where the largest fluctuations of sensor readings occur. That way, a user may put together a riser assembly with riser components having built-in sensors placed where the larger fluctuations are expected to occur (e.g., at the top and bottom). At locations toward the center of the riser assembly, it may only be desirable for every other, every third, every fifth, or every tenth riser joint to be outfitted with onboard sensors to collect meaningful data representative of the overall riser assembly.

Figure 31:
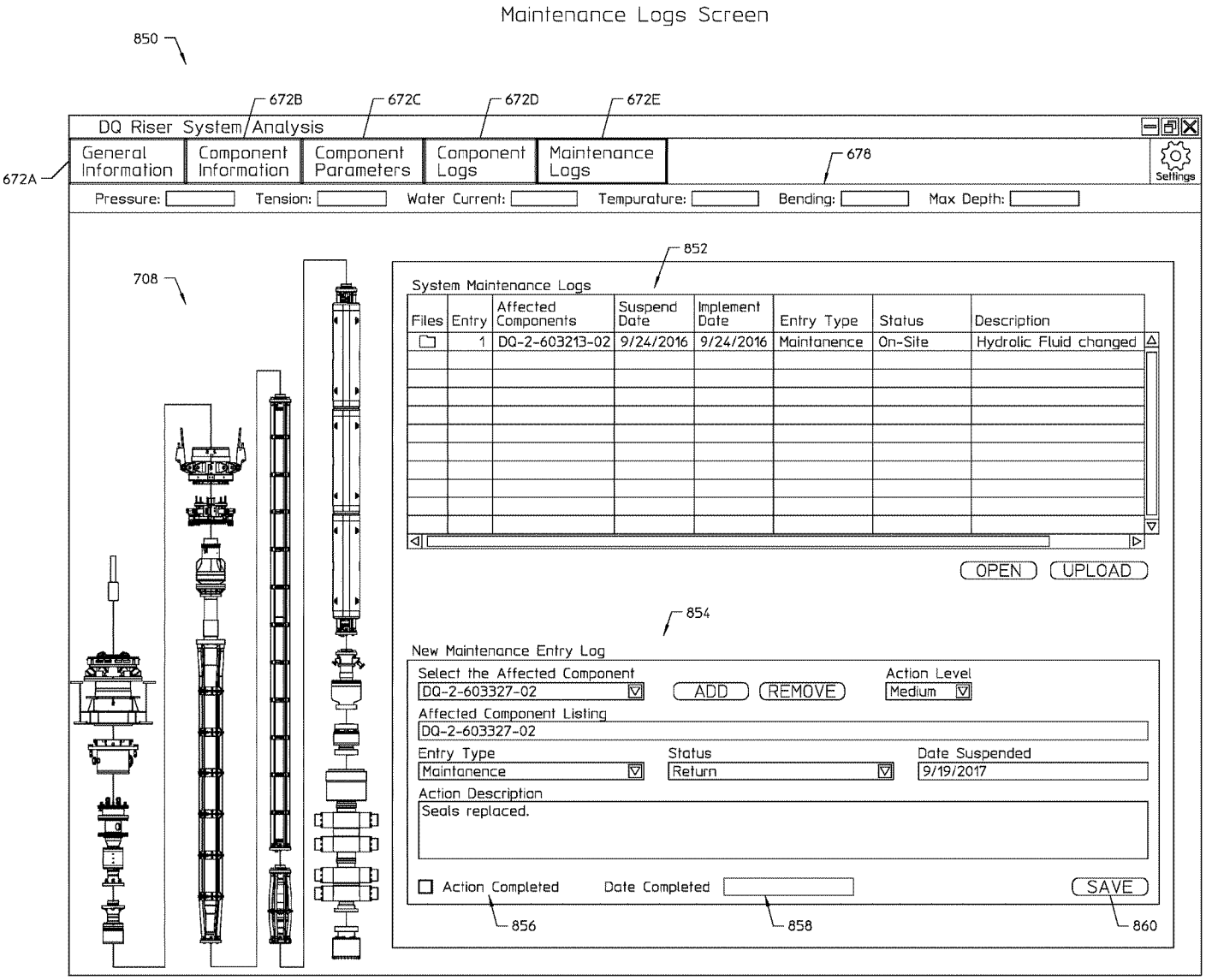
FIG. 31 shows a maintenance log screen of a MLMS, in accordance with certain embodiments of the present disclosure.

FIG. 31 shows a maintenance log screen 850 that displays detailed information regarding pending maintenance requests/tickets and maintenance that has already been performed on one or more riser components. The maintenance log screen 850 may be brought up by selecting the maintenance log tab 672E, or by selecting an alert that is displayed on one of the other screens. The maintenance log screen 850 may include a table of maintenance logs 852 that have previously been saved to the system. This table includes entries for each maintenance ticket that has been created in the MLMS and subsequently addressed by a user.

New maintenance entries or tickets 854 may be shown on the maintenance log screen 850. When the MLMS detects that a riser component is in need of maintenance or recertification, the system may automatically generate a new maintenance ticket 854 on this screen and output a maintenance alert on one or more of the other screens. In other instances, a user may manually generate a new maintenance ticket 854 using an Add or Remove button. Each new maintenance ticket 854 may include identification information for the riser component that is affected, a type of entry (e.g., maintenance), a status (e.g., returned to the string, sent for recertification), a date suspended, and an action description detailing what maintenance is needed on the component. In addition, the maintenance tickets 854 may include an action level (e.g., low, medium, or high) indicating the level of seriousness of the required maintenance. When a user has removed the riser component from the string and performed the requested maintenance, the user may log in to the MLMS, select "Action Completed" 856 on the maintenance ticket 854, fill out the date completed 858, and click the Save button 860 to save the completed maintenance ticket as a new entry in the maintenance log 852.

As mentioned above, the MLMS may build a running sequence for the riser components to construct and/or deconstruct the riser assembly based on the remaining lifecycle of riser components, their placement within the riser assembly, and subsea environmental conditions. The MLMS may similarly build a sequence for lowering internal tools through the riser assembly and operating the tools at a desired depth. The MLMS may collect relevant data regarding stresses on the riser components and/or internal tools and their positions within the riser assembly during one or more deployments and store this data with the component identification numbers. Based on this information, the MLMS may determine a particular running sequence that will cycle through components in a way that allows the components to be used and maintained more efficiently. For example, while the riser assembly is being used and monitored during a deployment, the MLMS may determine a running sequence for the next riser deployment based on the sensor measurements being collected and the resulting lifecycle considerations such as how long each particular riser component has been undergoing loads above a certain threshold.

The disclosed MLMS may enable a customer to set their own preferred limits/levels of tool/equipment operating pressure ratings and loads for internal tools lowered through the riser assembly. In addition, industrial regulations may be programmed into the system. The MLMS may record, monitor, and provide warnings when an internal tool or component lowered through the riser is being operated outside of the preset environment limits that have been set for a particular well or field. All signals, commands, and processing of internal tools may be recorded and/or monitored in the MLMS and compared to requirements that are either preselected by industrial standards and regulations or by customer specifications.

The well construction and completion operations may be predefined and monitored via the MLMS throughout the field, system, or lifecycle of particular internal tool components. As discussed above, the MLMS may output warnings when equipment of the internal tools reaches a time for maintenance or replacement. In this manner, all aspects of the well construction, completion, and production operations may be monitored live, or as needed by an ROV. Information is recorded into the MLMS along with identification information for all environment and structural elements both in the riser assembly and in tools lowered through the riser assembly and/or secured in the well. The MLMS may record all actions, operations, readings, maintenance, replacement of parts, installations, tests performed, and any other information that has been sensed.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Even though the figures depict embodiments of the present disclosure in a particular orientation, it should be understood by those skilled in the art that embodiments of the present disclosure are well suited for use in a variety of orientations. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that the particular article introduces; and subsequent use of the definite article "the" is not intended to negate that meaning.

What is claimed is:

1. A method, comprising:

running a tool through at least a portion of an internal bore of a riser assembly associated with a well, the riser assembly comprising a plurality of riser components;

outputting a control signal from a first wireless communication interface disposed in the riser assembly and along the internal bore of the riser assembly, wherein the first wireless communication interface is coupled to a communication system disposed in the riser assembly;

providing the control signal from a monitoring and lifecycle management system (MLMS) located at a surface to the communication system through the riser assembly;

receiving the control signal at a second wireless communication interface disposed on the tool; and actuating at least one equipment component of the tool in response to the second wireless communication interface receiving the control signal.

2. The method of claim 1, wherein the at least one equipment component is at least one component selected from the list consisting of: a sleeve, an injection valve, a connector, a seal, a valve in a flowbore of the tool, a choke, and a packer.

3. The method of claim 1, wherein the at least one equipment component is actuated via an actuator comprising a solenoid or an electric motor.

4. The method of claim 1, further comprising providing another control signal from a remote operated vehicle (ROV) to the communication system in the riser assembly.

5. The method of claim 1, further comprising:

detecting a parameter via a sensor disposed on the tool;

providing a sensor signal indicative of the detected parameter from the sensor to the second wireless communication interface on the tool; and communicating the sensor signal from the second wireless communication interface on the tool to the first wireless communication interface in the riser assembly.

6. The method of claim 5, further comprising communicating the sensor signal to the monitoring and lifecycle management system (MLMS) located at the surface via the communication system through the riser assembly.

7. The method of claim 5, further comprising communicating the sensor signal to an ROV via the communication system in the riser assembly.

8. The method of claim 5, wherein the detected parameter is an environmental parameter comprising a pressure, flow rate, temperature, or fluid composition.

9. The method of claim 5, wherein the detected parameter is a parameter indicative of an operation being completed within the tool via actuation of the at least one equipment component.

10. The method of claim 1, wherein the first wireless communication interface in the riser assembly is communicatively coupled to the second wireless communication interface on the tool via an inductive coupling.

11. A system, comprising:

a riser assembly comprising a plurality of riser components, wherein the riser assembly comprises an internal bore;

a first wireless communication interface disposed in the riser assembly and along the internal bore of the riser assembly;

a communication system disposed in the riser assembly, wherein the communication system is coupled to the first wireless communication interface, wherein the communication system is coupled, through the riser assembly, to a monitoring and lifecycle management system (MLMS) located at a surface;

a tool for use within a well, wherein the tool is disposed at least partially within the internal bore of the riser assembly;

a second wireless communication interface disposed on the tool and configured to receive a control signal output from the first wireless communication interface; and at least one equipment component of the tool configured to be actuated in response to the second wireless communication interface receiving the control signal.

12. The system of claim 11, further comprising an actuator disposed on the tool and communicatively coupled to the second wireless communication interface, wherein the actuator is configured to actuate the at least one equipment component in response to the second wireless communication interface receiving the control signal.

13. The system of claim 12, wherein the actuator is a solenoid or an electric motor.

14. The system of claim 12, wherein the at least one equipment component is at least one component selected from the list consisting of: a sleeve, an injection valve, a connector, a seal release component, a valve in a flowbore of the tool, a choke, and a packer.

15. The system of claim 11, wherein the communication system of the riser assembly communicatively couples the first wireless communication interface to the MLMS.

16. The system of claim 11, wherein the communication system comprises a remote operated vehicle (ROV) connection to communicatively couple the first wireless communication interface to an ROV.

17. The system of claim 11, further comprising a sensor disposed on the tool and communicatively coupled to the second wireless communication interface, the sensor configured to detect an environmental parameter comprising a pressure, flow rate, temperature, or fluid composition.

18. The system of claim 11, further comprising a sensor disposed on the tool and communicatively coupled to the second wireless communication interface, the sensor configured to detect a parameter indicative of an operation being completed within the tool via actuation of the at least one equipment component.

19. A system, comprising:

a first wireless communication interface disposed in a riser assembly and along an internal bore of the riser assembly;

a communication system coupled to the first wireless communication interface, wherein the communication system is disposed in the riser assembly; and a second wireless communication interface disposed on a tool and configured to receive a control signal output from the first wireless communication interface when the tool is at least partially within the internal bore of the riser assembly;

wherein the tool is configured to actuate an equipment component thereof in response to the second wireless communication interface receiving the control signal.

* * * * *